US006843527B2

(12) United States Patent
Nelson et al.

(10) Patent No.: US 6,843,527 B2
(45) Date of Patent: Jan. 18, 2005

(54) MULTI-FUNCTIONAL PORTABLE FOLDING ROCKING CHAIR

(76) Inventors: Gregory G. Nelson, 318 Stonehedge Dr., #22A, Murray, UT (US) 84107; Lynn H. Nelson, 824 N. Tremont St., Trementon, UT (US) 84337

( * ) Notice: Subject to any disclaimer, the term of this patent is extended or adjusted under 35 U.S.C. 154(b) by 151 days.

(21) Appl. No.: 09/796,851

(22) Filed: Mar. 1, 2001

(65) Prior Publication Data

US 2001/0052719 A1 Dec. 20, 2001

Related U.S. Application Data

(63) Continuation-in-part of application No. 09/014,062, filed on Jan. 27, 1998, now Pat. No. 6,354,657.

(51) Int. Cl.[7] ..... A47C 4/00

(52) U.S. Cl. ..... 297/18; 297/56; 297/129

(58) Field of Search ..... 297/16.1, 16.2, 297/18, 56, 57, 30, 19, 423.24, 423.22, 452.13, 423.28, 423.26, 42, 45, 46, 47, 20, 53, 27, 41, 38, 39

(56) References Cited

U.S. PATENT DOCUMENTS

| | | | | | |
|---|---|---|---|---|---|
| 940,233 | A | | 11/1909 | Bruflat | |
| 1,928,991 | A | * | 10/1933 | Bishop | 297/18 |
| 1,969,313 | A | | 8/1934 | Meeker | |
| 2,203,610 | A | * | 6/1940 | Bascom et al. | 297/18 |
| 2,300,692 | A | | 11/1942 | Olsen | |
| 2,504,515 | A | | 4/1950 | Gantner et al. | |
| 2,507,609 | A | | 5/1950 | Miles | |
| 2,567,341 | A | | 9/1951 | Martin | |
| 2,675,059 | A | | 4/1954 | Martin | |
| 2,710,642 | A | * | 6/1955 | Fauser | 297/18 |
| 2,741,298 | A | * | 4/1956 | Roberts, III | 297/18 |
| 3,004,793 | A | | 10/1961 | Loomis | |
| 3,338,625 | A | * | 8/1967 | Jung-Shien | 297/18 |
| 3,388,919 | A | | 6/1968 | Waag | |
| 3,822,913 | A | | 7/1974 | Raver | |
| 3,828,992 | A | | 8/1974 | Cerchione | |
| 3,997,213 | A | | 12/1976 | Smith et al. | |
| 4,118,064 | A | | 10/1978 | Robeson | |
| 4,392,598 | A | | 7/1983 | Dixon | |
| 4,487,345 | A | | 12/1984 | Pierce et al. | |
| 4,523,773 | A | | 6/1985 | Holtz | |
| 4,523,774 | A | | 6/1985 | Dickerson | |
| 4,699,422 | A | | 10/1987 | Yamasaki | |
| 4,720,029 | A | | 1/1988 | Varanakis | |
| 4,733,905 | A | | 3/1988 | Buickerood et al. | |
| 4,773,574 | A | | 9/1988 | Burgard | |
| 4,795,068 | A | | 1/1989 | Blean | |
| 4,836,938 | A | | 6/1989 | Kobasic | |
| 4,972,981 | A | | 11/1990 | Gex | |
| 5,004,134 | A | | 4/1991 | Barry | |
| 5,016,792 | A | | 5/1991 | Jay | |
| 5,209,381 | A | | 5/1993 | Jay | |
| D338,779 | S | | 8/1993 | Albert | |
| 5,253,921 | A | | 10/1993 | Boulet | |

(List continued on next page.)

*Primary Examiner*—Peter M. Cuomo
*Assistant Examiner*—Stephen Vu
(74) *Attorney, Agent, or Firm*—Brian R. Rayve

(57) ABSTRACT

A rocking chair having an elongate flexible seat supported at opposite ends by a pair of oppositely inclined, diagonally disposed frames. Each frame includes a U-shaped tube interconnected connected by a plurality of cross members and is pivotally interconnected with the other at the sides of each intermediate the ends by pairs of upper and of lower siderails. The frames nest one within the other such that the chair may be folded into a compact unit for storage. A fold-out footrest nests within the other frames to act as a back support when the chair is used without the footrest deployed. A pair of wheels can be mounted to the front legs on reversible axles such that when the chair is pinned in the upright position the chair functions as a wheelchair. When the chair is in the folded position with the footrest deployed, the chair acts as a wheeled cart.

32 Claims, 35 Drawing Sheets

Figure 1:
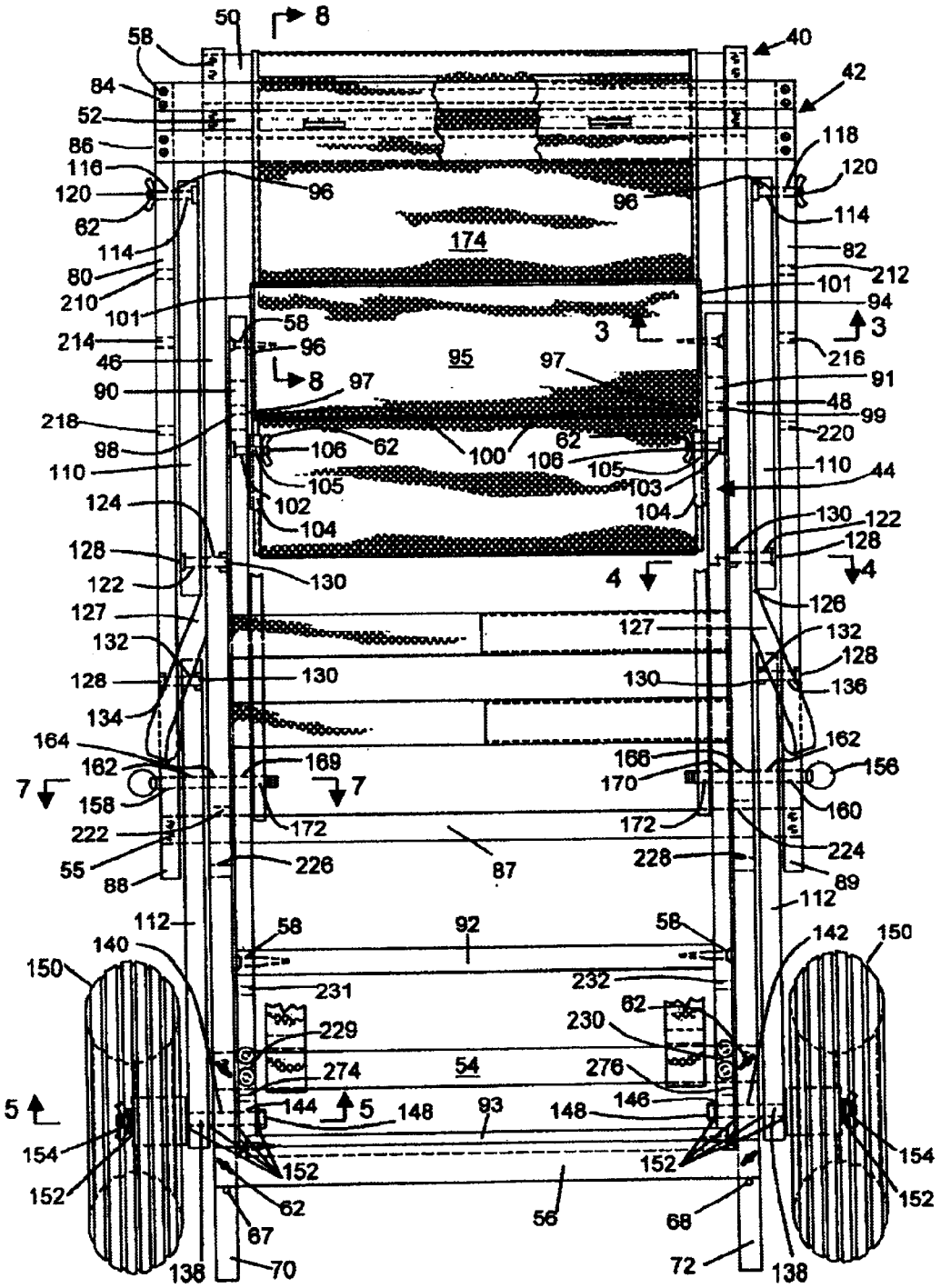

U.S. PATENT DOCUMENTS 5,265,892 A 11/1993 Said
5,289,958 A 3/1994 Jay
5,297,708 A 3/1994 Carpenter
5,303,975 A 4/1994 Asato
5,310,246 A * 5/1994 Tseng ..... 297/359
5,332,283 A 7/1994 Gray
5,381,941 A 1/1995 Brune
5,409,291 A 4/1995 Lamb
5,464,268 A * 11/1995 Levrangi ..... 297/57
5,492,255 A 2/1996 Gansky et al.
5,499,760 A 3/1996 Pielocik
5,513,900 A * 5/1996 Iglesias ..... 297/463.1
5,527,088 A 6/1996 MacLean
5,536,064 A 7/1996 MacLean
5,538,318 A 7/1996 MacLean
5,544,793 A 8/1996 Harrop
5,547,246 A 8/1996 Lambert
5,570,829 A 11/1996 Harrison
5,573,155 A 11/1996 Sadler
5,588,696 A 12/1996 Jay et al.
5,597,101 A 1/1997 Barber et al.
5,971,474 A * 10/1999 Chang ..... 297/56

* cited by examiner

MULTI-FUNCTIONAL PORTABLE FOLDING ROCKING CHAIR

RELATED APPLICATION

This application is a continuation-in-part of U.S. patent application Ser. No. 09/014,062 filed Jan. 27, 1998 now issued as U.S. Pat. No. 6,354,657 on Mar. 12, 2002.

BACKGROUND OF THE INVENTION

1. Field

The invention is in the field of portable collapsing or folding rocking chairs and chaise lounges for use indoors and outdoors such as for camping and which chair may also function as a backpack, cart, wheelchair, or cot.

2. State of the Art

Portable collapsing rocking chairs of the type which have a flexible rectangular seat supported at opposite ends by oppositely inclined, diagonally disposed frames interconnected by a pair of upper and lower chains are well known. The frames of these chairs each typically have a pair of parallel elongate side members interconnected and held in a spaced relationship by at least one cross member, one frame nesting within the other. The pairs of upper and lower chains interconnect the respective side members intermediate the ends thereof to form what is called a saddle hinge which allows the chair to be oscillated or rocked since there is no fixed pivot between the respective frames. Likewise, wheeled carts, and wheeled chairs are well known.

In U.S. Pat. No. 4,118,064 issued to Robeson is disclosed a wooden rocking chair wherein the upper ends of the elongate side members and the ends of cross members of each frame are held together by means of interfitting wedge and groove connections which allow disassembly of the frames so as to form a compact bundle for transport or storage. A stool of similar construction is also disclosed.

In U.S. Pat. No. 1,969,313 issued to C. E. Meeker is disclosed a wooden rocking chair wherein the elongate side members and the cross members of each frame are held together by means of the upper end of each side member being tapered to mate with tubular sockets at the ends of the upper cross members. One frame also has a lower cross member pivotally and releasibly connected at respective ends thereof to the lower portion of one frame such that the chair can be disassembled and the lower cross member folded to form a compact bundle for transport or storage.

In U.S. Pat. No. 4,733,905 issued to Buickerood et al. is disclosed a two-wheeled, non-rocking chair which has four U-shaped tubular metal frame members which form a folding frame. The individual frame members pivot relative to one another so as to additionally form a wheeled cart with elevated handle, a carrier for elongate objects, or be collapsed into a more compact unit for storage.

In U.S. Pat. No. 4,487,345 issued to Pierce et al. is disclosed a backpack having a wooden frame, a pack, and shoulder straps, wherein the frame unfolds to form a reclining chair which also functions as a stand for holding the pack in an upright position. The chair does not oscillate nor rock and has fixed reclining positions.

In U.S. Pat. No. 3,828,992 issued to Cerchione is disclosed a backpack having a tubular metal folding frame, a pack, and shoulder straps, wherein the frame unfolds to form a sleeping cot with the pack stowed there below. The frame has two elongate sections hingedly connected together by a short section with a flexible sleeping surface stretched therebetween. When used as a backpack one elongate section to which the shoulder straps are connected fits against the back of the user with the other long section to which the pack is attached spaced from and parallel thereto, the two being interconnected by the short section over the top of the pack.

Various types of chaise lounges having a single elongate seat which supports person head to foot are also known but none having the construction and features of the present invention.

SUMMARY OF THE INVENTION

In accordance with the invention, a folding rocking chair and chaise lounge of the type having a pair of oppositely inclined, diagonally disposed frames, one frame being of such width as to nest one within the other with the frames interconnected at the sides thereof by a pair of upper and lower siderails. Each frame has a pair of elongate side members held in a fixed, spaced relationship by one or more cross members. A rectangular, longitudinally flexible seat extends between and is connected at opposite ends thereof to cross members at the upper ends of the respective frames. A folding footrest may also be provided which likewise nests within the frames and which forms a chaise lounge when an extra-long seat is utilized. The footrest can be of adjustable length to accommodate persons of differing heights. The nesting of the frames allows the chair to be folded into a compact rectangular unit about two and one half inches thick for storage or transport, with the unit being maintained in the folded position by pins which fit into corresponding apertures in the respective frames.

The first frame, or backrest frame, comprises a pair of elongate side members laterally connected by one or more cross members, typically both upper and lower cross members, the upper portion of the backrest frame being adapted for receiving and supporting a user's back in conjunction with the flexible seat, and a lower portion which functions as the front legs of the chair. The second frame, or seat frame, comprises a pair of elongate side members laterally connected by one or more cross members, typically both upper and lower cross members, the upper portion of the seat frame being adapted for receiving and supporting a user's buttocks and legs in conjunction with the flexible seat, and a lower portion which function as the rear legs of the chair. The backrest frame and the seat frame are typically constructed from naturally finished or unfinished wood, particularly hardwoods such as oak or maple for strength and rigidity. The members of each frame are joined together such as by corrosion resistant stainless steel or zinc plated metal screws and may also be glued together for added strength. The frames may alternatively be made from metal, plastic, composites, or other similarly rigid types of material available in solid or tubular sections. The frames can also each be made from metal tubing or bar stock bent into a U-shape such that the side members and one or more cross members are integral therewith.

The backrest frame and seat frame are maintained in the oppositely inclined, diagonally disposed orientation by means of a pair of upper and a pair of lower siderails. The siderails are typically substantially rigid wooden members constructed from naturally finished or unfinished wood, particularly hardwoods such as oak or maple though metal, plastics, and composite materials may also be used. Each upper siderail is connected such as by using bolts and nuts or sleeved rivets, at one end to an upper portion of the respective backrest frame side member and at the opposite end to an upper portion of the respective seat frame side member. Each lower siderail is connected such as by using bolts and nuts or sleeved rivets, at one end to a lower portion of the respective backrest frame side member and at the opposite end to a lower portion of the respective seat frame side member. The substantially rigid upper and lower siderails are typically all the same length with their connection points to the respective frame side members in the same longitudinal position on the side members of the respective frames for the pair of upper siderails and for the pair of lower siderails. This configuration allows the chair to fold properly into a compact unit. While substantially rigid siderails are preferable, flexible siderails such as metal chains, nylon rope, and cables may be used, though the chair will not fold as easily and extra retaining pins may be necessary to hold the chair in the folded position. When flexible siderails are used such as chains, the effective length thereof can easily be changed such by attachment the desired number of links of the chain between a pair of hook connections attached to the respective frame side members. This allows the various chair positions to be achieved without having the multiple alternate attachment points for the siderails.

Since the backrest frame and the seat frame are not pivotally connected at a fixed point such as where the frames cross, a saddle hinge is formed wherein the effective pivot point can move relative to the frames so as to allow an oscillating or rocking motion to be effected by a user of the chair. As the chair is rocked from a forward position rearward, the angle of the respective backrest frame and the seat frame change from a relatively upright chair with a generally more vertical backrest frame and a generally more horizontal seat frame to a rearward reclining position with the backrest frame in a generally more horizontal position with the seat frame in a generally more vertical position. The chair can be held in one or more predetermined positions so as to not rock by providing apertures in the respective backrest frame and seat frame side members, which apertures are positioned so as to align when the chair is in the desired position such that a pin can be inserted into each pair of apertures. While the chair can be pinned in any functional position thereof including when the seat is horizontal, typically there are provided apertures in the respective side members for the chair to have at least a forward chair position, an intermediate chair position, and a reclining chair position.

The chair can be equipped to be rocking or fixed type chair with foot support by utilizing a fold-out footrest of fixed or adjustable length to which the seat is not attached and which nests within the backrest and seat frame and which is pinned in place such that when the chair is in the folded position it forms the same compact unit for storage and transport. The chair can be equipped to be a chaise lounge by using an extra-long seat which attaches to the foot support on the footrest rather than to the seat frame. The reclining chair may be used with the footrest in a deployed position wherein a padded foot support member pivotally adjusts to support a user's feet in the various chair positions or in a pinned and folded or stowed position wherein the foot support member serves as a padded back support for the user. The footrest has two versions primarily for aesthetic appeal, one with a generally rectangular frame and a second having a T-shaped frame both of which essentially function the same as a foot rest. The footrest frames may be made from wood or alternatively from metal, plastic, composites, or other similarly rigid types of material available in solid or tubular sections. The footrest frames can also each be made from metal tubing or bar stock bent into a U-shape such that the side members and one or more cross members or the foot support are integral therewith.

Either footrest may be maintained in an elevated position relative to the floor surface or ground by attaching one of the cross members of the backrest frame in such a position as to contact the footrest frame when the foot support of the footrest is at a comfortable user height for the majority of the chair positions. Multiple vertical positions may be attained by providing removably attached cross members with multiple positions therefor such that the footrest frame contacts the cross members when at different angles, depending on the position of the cross members. The cross members might be in one position when the chair is reclined, and the cross members moved to another position when in the forward chair position. Rubber or plastic pads are typically attached to the footrest frame or the backrest frame so as to act as a cushion between and prevent damage to the frames when the footrest is being lowered.

One or two support legs pivotally connected to the footrest, at a point along the length thereof may likewise be used to maintain the footrest in an elevated position. The support legs contact the floor to help to prevent the chair from tipping over as a person enters or exits the chair. This is a safety feature which works even when the support legs are at a shorter length than required for the particular chair position since as the person enters or exits the chair the legs are still able to touch the ground before an unstable position is reached. On the first version of the footrest, two support legs are used, one on each footrest frame side member, and on the second version one center support leg located between the longitudinal members is used. The support legs may span between the footrest frame completely to the ground to maintain the footrest at a given height above the ground in a particular chair position or may span only partially to act as an anti-tipping device. The support legs can be pivoted to a retracted position substantially parallel to the ground and held there such as by friction at the pivot, a clip, or a pin. The support legs may be of fixed length or of adjustable length with an extendible lower leg with a ground contacting pad such as to be capable of contacting the ground in multiple chair positions.

There are four versions of the rectangular, longitudinally flexible seat on which a user sits, the first three of which are typically made of cloth such as canvas or nylon and the fourth made of substantially rigid slats. Each of the versions of the seat are longitudinally flexible so as to form a comfortable seat which conforms to the back, legs, and buttocks of a user seated therein. The cloth version seats typically have a sheet of resilient foam core sandwiched between one folded-over or a pair of canvas sheets with a sewn seam around the perimeter thereof so as to completely encase the foam core. Alternatively, the seat may be constructed using a thicker open-cell type foam core and made airtight such as by using plastic coated cloth with a glued or heat-sealed perimeter seam and sealing air valve to form an air mattress such as the well known THERMOREST type air mattresses manufactured by several different companies. Air can be admitted or exhausted from the foam in such air mattress seat so as to customize the feel thereof. Also, a separate THERMOREST or other type of air mattress may be laid on top of any of the seat versions for added comfort and may be fixed or removably attached thereto such as by using VELCRO or other type of fastening means.

In the first version of the seat, the ends of the cloth seat are attached to one or more upper cross members of each frame such as by wrapping an end portion of the seat around the respective upper cross member and sewing it back to the seat so as to envelope the respective cross member. The respective cross members may be made to be removably attached such as by bolts and wingnuts to the respective side members so as to allow removal of the seat from the rest of the chair such as for laundering.

The second version of the seat is of substantially the same construction as the first version thereof, but has doubled-over cuff portions at each end thereof of sufficient width as to fit over the upper portion of the backrest and the seat frames including the respective upper cross members and the upper portion of the respective side members. This version of the seat is securely held in place by the cuffs yet may be easily removed by sliding the cuffs off the upper portions of the respective frames without necessitating the removal of any cross members.

The third version of the seat converts the rocking chair with footrest into a chaise lounge. This version of the seat is generally rectangular in shape but of longer length so as to extend from the backrest upper cross members to the footrest. The attachment of the seat to the respective upper cross members and footrest such as by using VELCRO loop pads glued to the upper cross members and to the footrest and VELCRO loop pads sewn or riveted to the footrest, though other methods of attachment to the upper backrest can be utilized such as described above and those same methods adapted to fit on the footrest.

The fourth version of the seat comprises a plurality of substantially rigid, laterally extending bars or slats, typically rectangular in cross-section and made of wood. The slats each have at least a pair of lateral apertures therethrough, one near each end thereof, which extend longitudinally relative to the frames. A flexible member, typically a nylon rope, extends through each aperture at one side of the slats with a pair of knots tied therebetween each, with a second flexible member extending through each aperture at the opposite end thereof with a pair of knots therebetween, the ends of each flexible member tied or otherwise connected to the respective backrest and seat upper cross members. The knots maintain the slats evenly spaced along the flexible member and allow greater flexibility of the seat. Other types of spacers may be used in place of the knots such as tubular spacers made of wood, metal, or plastic.

The chair may be equipped with a pair of wheels pivotally connected to the lower portion of the backrest frame on individual axles and which axles may be reversed so as to not extend from the chair when wheels are not required. The wheels are the rubber pneumatic type or the wooden type for more decorative use such as poolside, though most any type wheel including the plastic and solid rubber types will work.

The wheeled chair has four main uses, the first of which is to allow easier transport of the chair both in the folded position and when in the chair position. In the folded position a user merely grasps the upper portions of the folded backrest and seat frames, tilts the folded chair and pushes or pulls the chair to a new location. The lower portion of the backrest frame, or front legs thereof, may be made of such length as to extend beyond the outer diameter of the wheel when the folded chair is in a vertical position such that in such position the chair will rest on the front legs with the wheels off the ground so as to not inadvertently roll, and will roll only when tipped at a sufficient angle off of vertical for the wheels to touch the ground. When in the chair position, the wheels allow the chair to easily be moved by grasping and lifting the backrest frame such that the lower portion of the seat frame, or the rear legs, lift from the ground such that only the wheels contact the ground. After the chair is moved, the backrest frame is lowered such that the rear legs again contact the ground. If the support legs are deployed they along with a pair of straps connecting the backrest and seat frames help prevent the chair from tipping too far forward to a position wherein the chair might roll backwards on the wheels or tip. Also, the lower ends of the backrest frame side members touch the ground when the chair is tipped forward sufficiently so as to help prevent rolling of the chair on the wheels.

The second main use of the wheels is to allow the chair to be used as a wheeled hauler for carrying equipment and as a wheelchair for moving a person. The chair with wheels can be used to haul equipment placed on the seat or footrest thereof in any position. A wheelchair position is achieved by tilting the backrest frame forward into the upright chair position and locking it there by inserting a pair of locking pins into the apertures in the backrest and seat frame side members. As such, a person can be wheeled around quite easily with little effort.

The third main use of the wheels is to allow the chair, when equipped with the first version of the footrest, to be used as a cart such as to move heavy items. The cart position is achieved by opening or unfolding only the footrest while the backrest frame and the seat frame remain in a closed or folded position. A load is supported on the upper portion of the footrest frame with the aid of one or more removable flexible or rigid bands which may be placed laterally around the footrest frame so as to help support the load in those areas of the footrest frame which lack cross members. Substantially rigid cross members may also be built into the footrest frame if desired. The cart is tilted like a standard hand cart so as to lift the load onto the wheels for transport. If the first version of the adjustable position footrest mechanism is used, either position may be utilized depending on the desired angle between the backrest and seat frames with the footrest frame in the cart position. Optional short folding legs may be used at the ends of each footrest frame longitudinal member to prevent the footrest frame from touching and possibly being abraded by the ground.

The chair can also be equipped for hiking and camping by attaching a removable pack to the rear of the chair with removable shoulder straps which attach to an upper cross member of the seat frame and to a lower cross member of the backrest frame. A removable belt can also be attached to the backrest frame lower cross member to further secure the frames to the user. The pack is typically removably attached to the bottom surface of the seat by means such as VELCRO hook and loop pads to the bottom surface of the seat and the pack. The pack can be attached adjacent the area of the seat behind a person's back and shoulders when used as a chair or a backpack, or below a person's buttocks when used as a chair for easy access such as to beverages or other items held therein. The pack may also be removably attached to the top surface of the seat if desired. The pack may be used to hold such items as an umbrella, a mist bottle, water bottles, etc. An optional configuration especially for camping and hiking allows the frames and the siderails to telescope and collapse such that the overall length of the folded chair shortens and extends by up to about twelve inches or more.

Both wooden and tubular metal chairs can be constructed which utilize upper siderails which are of adjustable length relative to the backrest and seat frames. The tubular metal chair preferably utilizes U-shaped tubular members which integrally include the respective side members and one respective cross member for each of the backrest, seat, and footrest frames, along with another cross member connected across the open end of the respective U-shaped member. The upper siderails of the tubular metal chair is preferably of adjustable length relative to the backrest and seat frames by means of being of adjustable length, comprising first and second end portions which are longitudinally movable relative to each other such as by being tubes which closely telescope together, and being lockable in a fixed position relative to each other using an adjustment mechanism such as a spring clip disposed within an innermost of the first and second portions which includes a head that extends into a hole through a wall of the innermost of the first and second end portions which is selectively engageable through the hole into each of a plurality of linearly disposed holes of a wall of an outermost of the first and second portions to releasibly lock the first and second end portions in a plurality of linear positions.

On the wooden chair, the upper siderails are preferably of adjustable length relative to the backrest and seat frames by means of corresponding end portions of each upper siderail being of adjustable mounting position on one of the backrest and seat frames, preferably the backrest frame, using ratchet plates. A pair of elongate armrests can be being pivotally connected to the respective upper siderail at one end adjacent the backrest frame, and at the other end using a respective support mechanism, preferably a folding brace connected to the upper siderail to selectively retain the end of the respective armrest in an elevated and a lowered position.

Both the tubular metal and the wooden chairs preferably include a footrest, the tubular metal footrest typically comprising a U-shaped tubular member with a foot support pivotally connected across the open end thereof. The footrest can also be made of three telescoping tubular members comprising two tubular side members and a truncated U-shaped tubular cross member which interconnects the side members. The footrest is retained at the desired height of a plurality thereof by means of a pair of variable incline ratchet assemblies including a ratchet plate connecting the footrest to the backrest frame. A pivotally mounted U-shaped release plate allows release of the ratchet plate without necessitating gripping in hand the ratchet plate directly. The wooden embodiment utilizes a wooden footrest and similar variable incline ratchet assemblies.

While the chair shown herein accommodates a single user, the respective frames and seat can be made wider and stronger such as to accommodate larger persons as well as two or more persons sitting in the chair at the same time. Likewise, multiple chairs can be linked together side-by-side or otherwise so as to provide seating for multiple persons.

THE DRAWINGS

Figure 2:
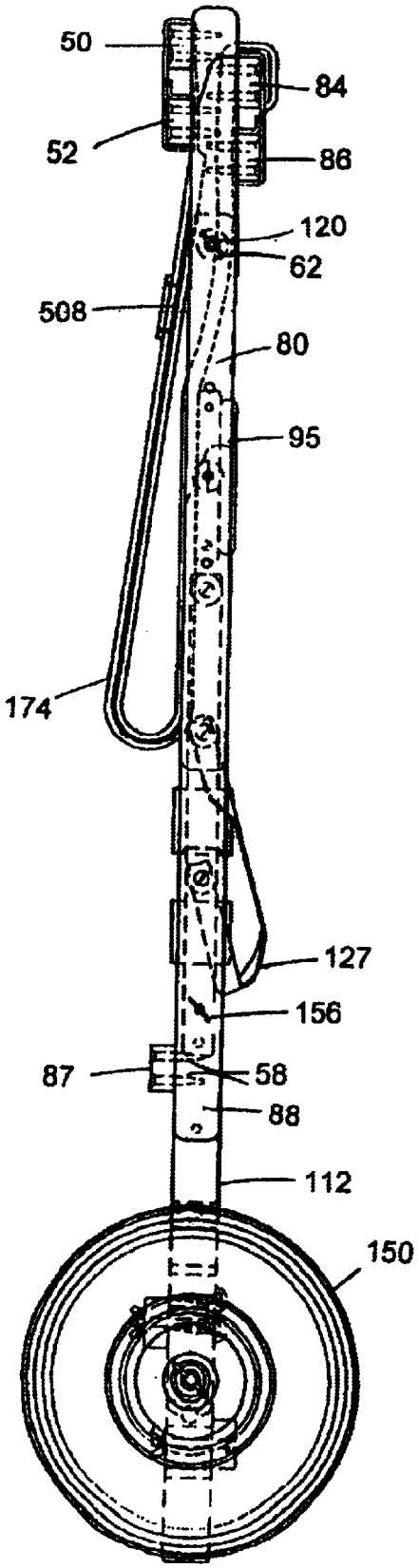
Figure 3:
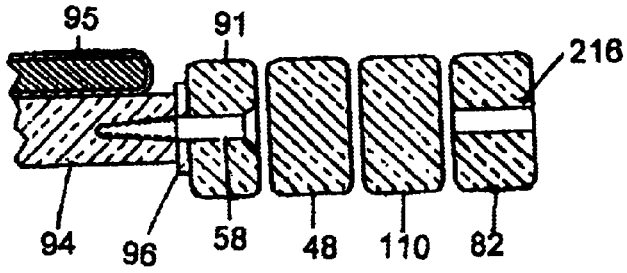
Figure 4:
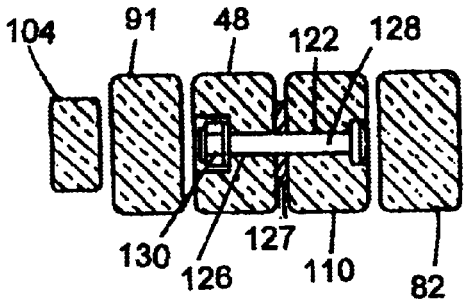
Figure 5:
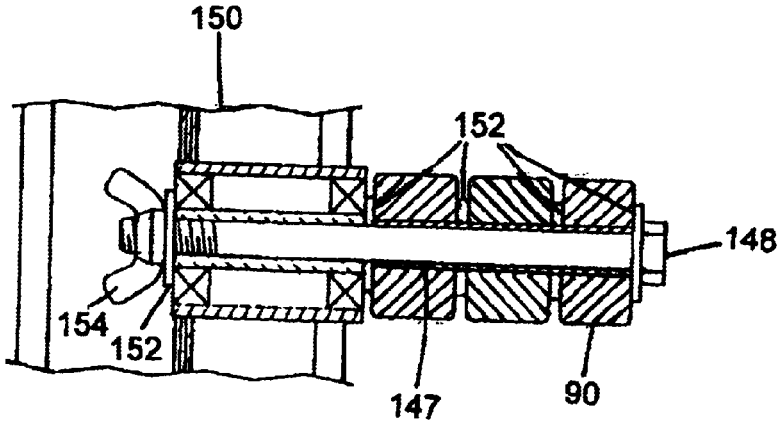
Figure 6:
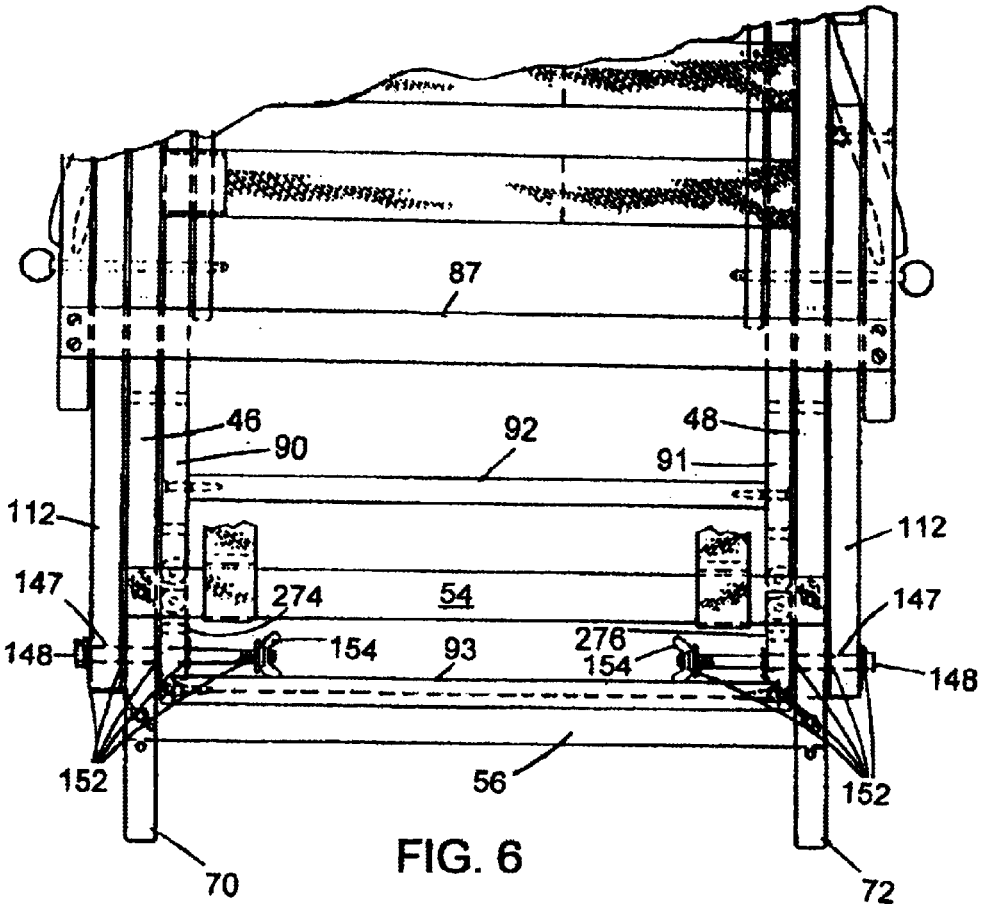
Figure 7:
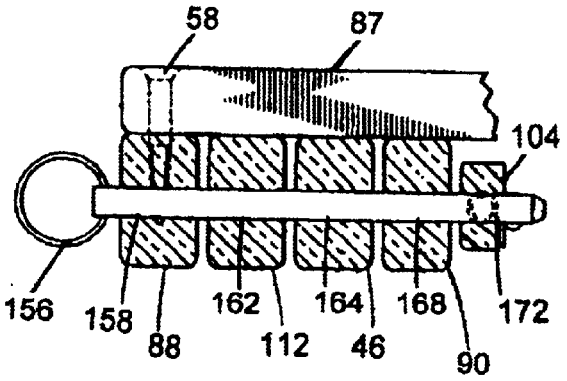
Figure 8:
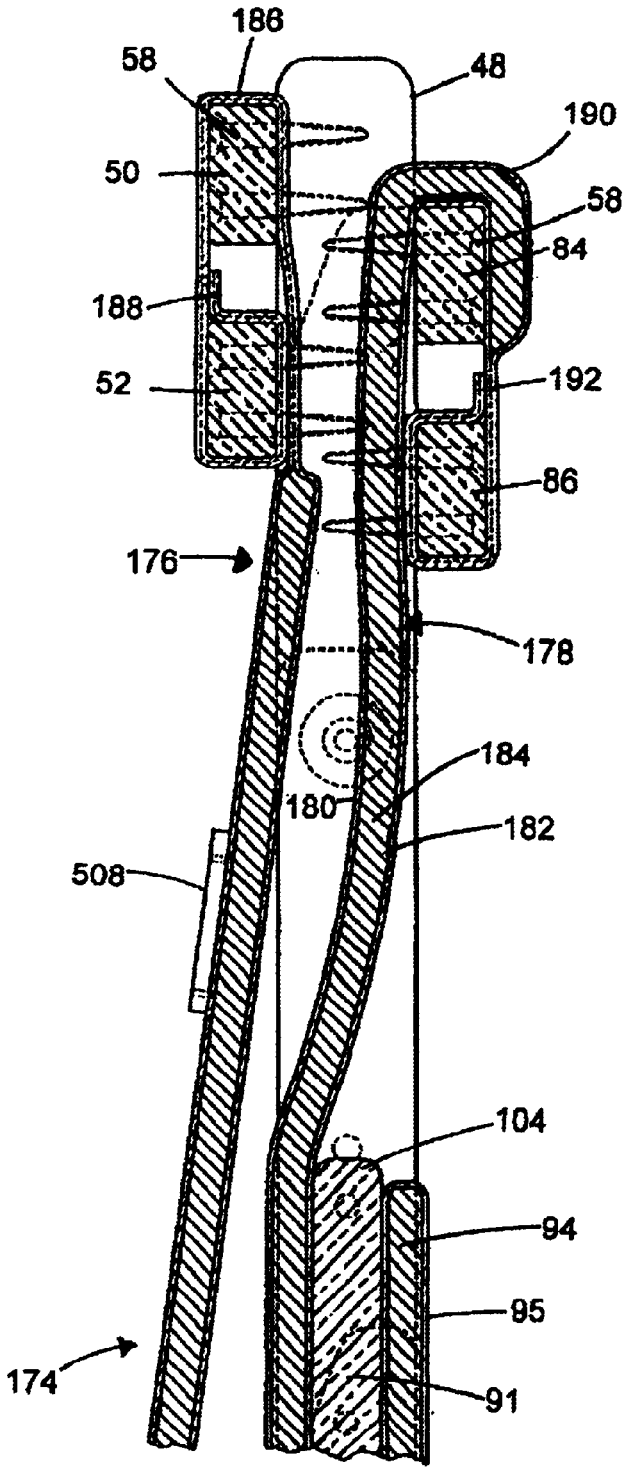
Figure 9:
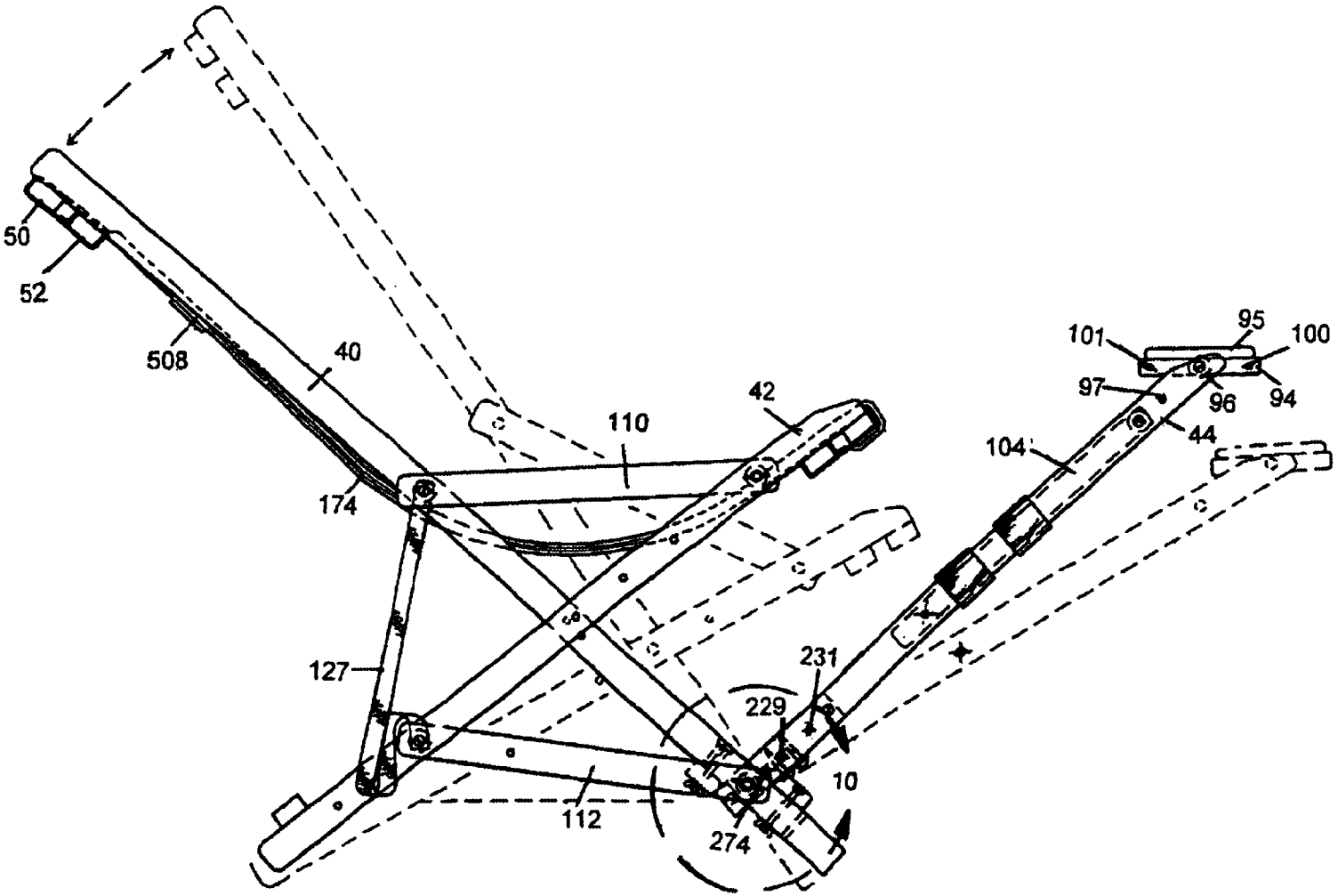
Figure 10:
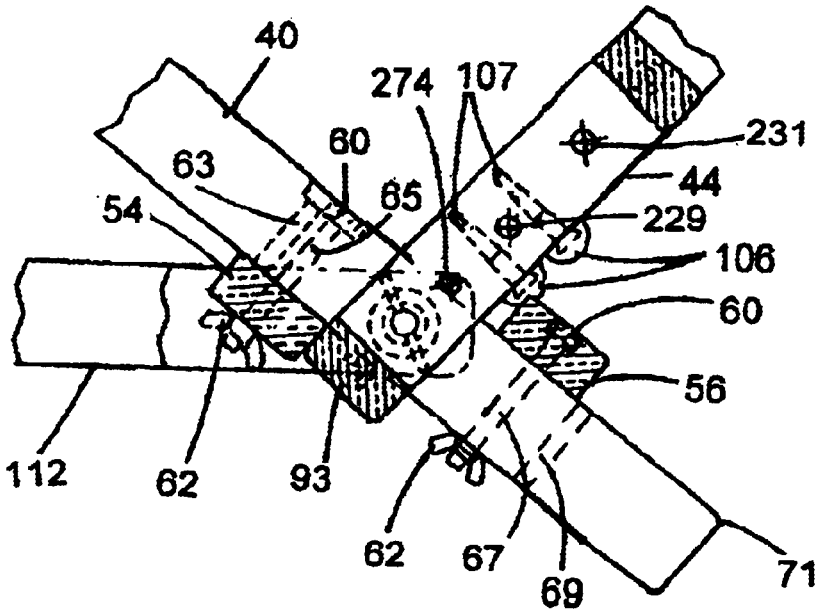
Figure 12:
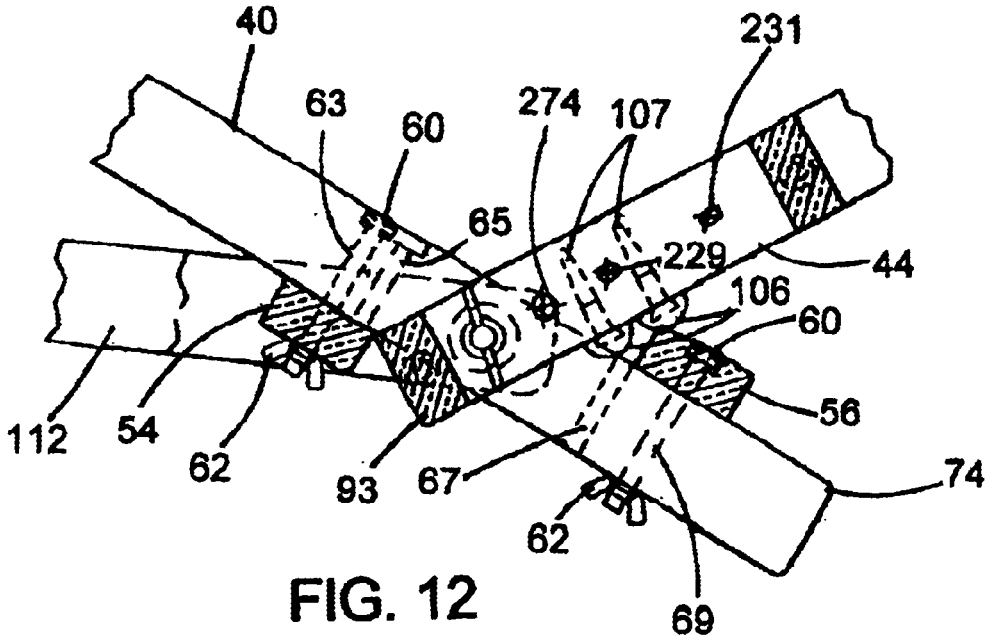
Figure 11:
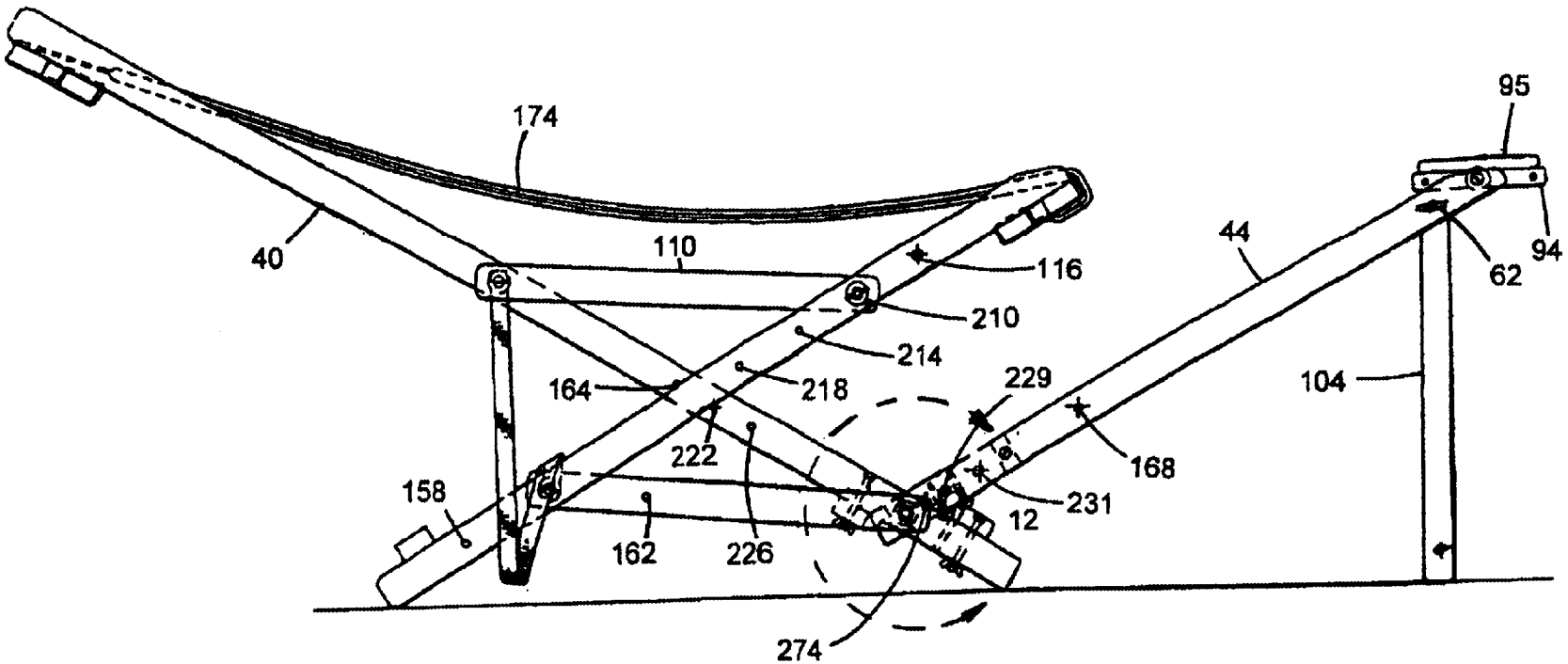
Figure 13:
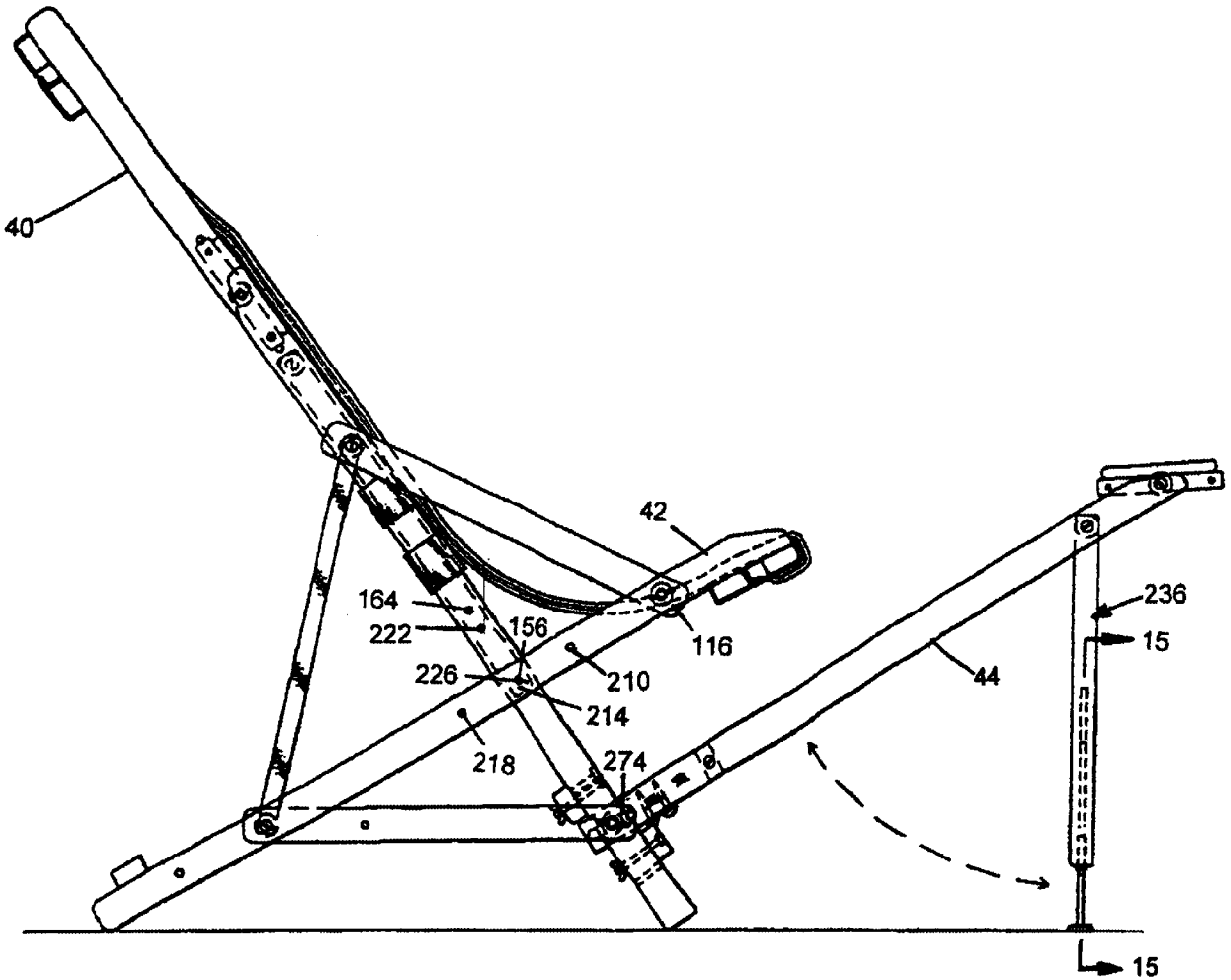

The best mode presently contemplated for carrying out the invention is illustrated in the accompanying drawings, in which:

FIG. 1 is a front elevational view of a first embodiment of the invention in the folded state and with wheels;

FIG. 2, a side elevational view corresponding to FIG. 1;

FIG. 3, a fragmentary view in lateral horizontal sectional view taken on the line 3—3 of FIG. 1 showing the pivotal mounting of the foot support and showing the frames;

FIG. 4, a fragmentary view in lateral horizontal section taken on the line 4—4 of FIG. 1 showing a main pivot and the frames;

FIG. 5, a fragmentary view in lateral horizontal section taken on the line 5—5 of FIG. 1 showing an axle and the frames;

FIG. 6, a fragmentary rear elevational view of the chair with the wheels removed and the wheel axles in the reversed or stowed position;

FIG. 7, a fragmentary view in lateral horizontal section taken on the line 7—7 of FIG. 1 showing a locking pin and the frames;

FIG. 8, an enlarged fragmentary view in longitudinal vertical sectional view taken on the line 8—8 of FIG. 1 showing the seat and cross members;

FIG. 9, a side elevational view of the chair in the unfolded position with the footrest deployed and showing the relative motions as the chair rocks;

FIG. 10, an enlarged fragmentary view taken from FIG. 9 showing the lower portions of the backrest and footrest frames, and a connecting member, with the footrest frame in the higher position with the backrest lower cross member in the higher position;

FIG. 11, a side elevational view of the chair with the footrest extended and the upper siderails pinned in the second aperture of the seat frame side members for a cot position with the seat essentially horizontally disposed and taut and with the footrest in a lower position;

FIG. 12, an enlarged fragmentary view taken from FIG. 11 showing the lower portions of the backrest and footrest frames, and a connecting member, with the footrest frame in the lower position with the backrest lower cross member in the lower position;

FIG. 13, a side elevational view of the chair with the footrest extended and the backrest and seat frames pinned in the third aperture for a semi-reclining position and with the adjustable legs deployed.

Figure 14:
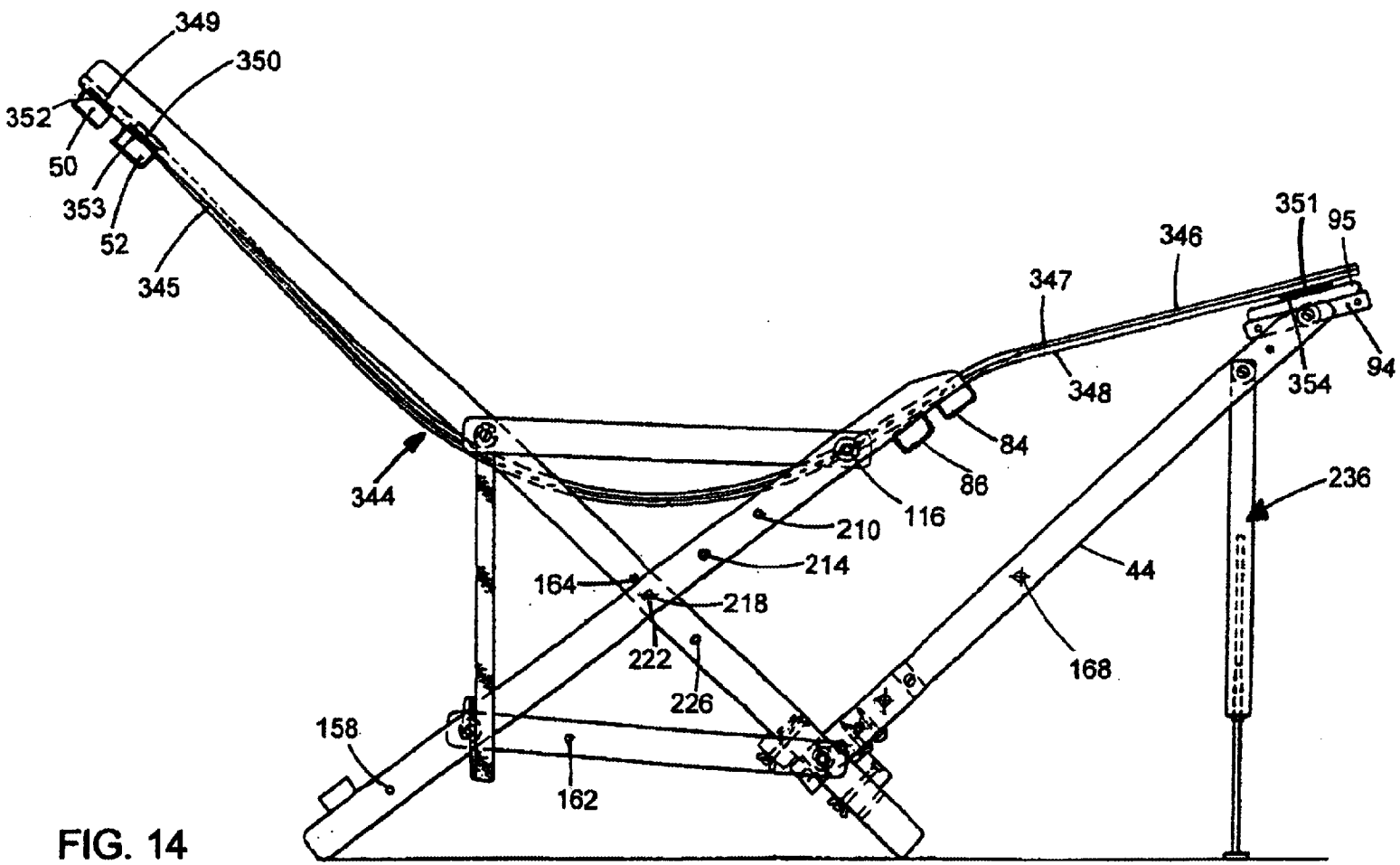
Figure 15:
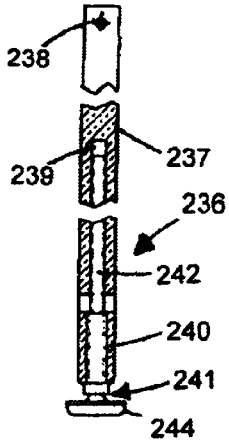
Figure 16:
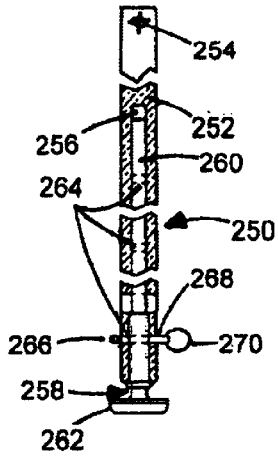
Figure 17:
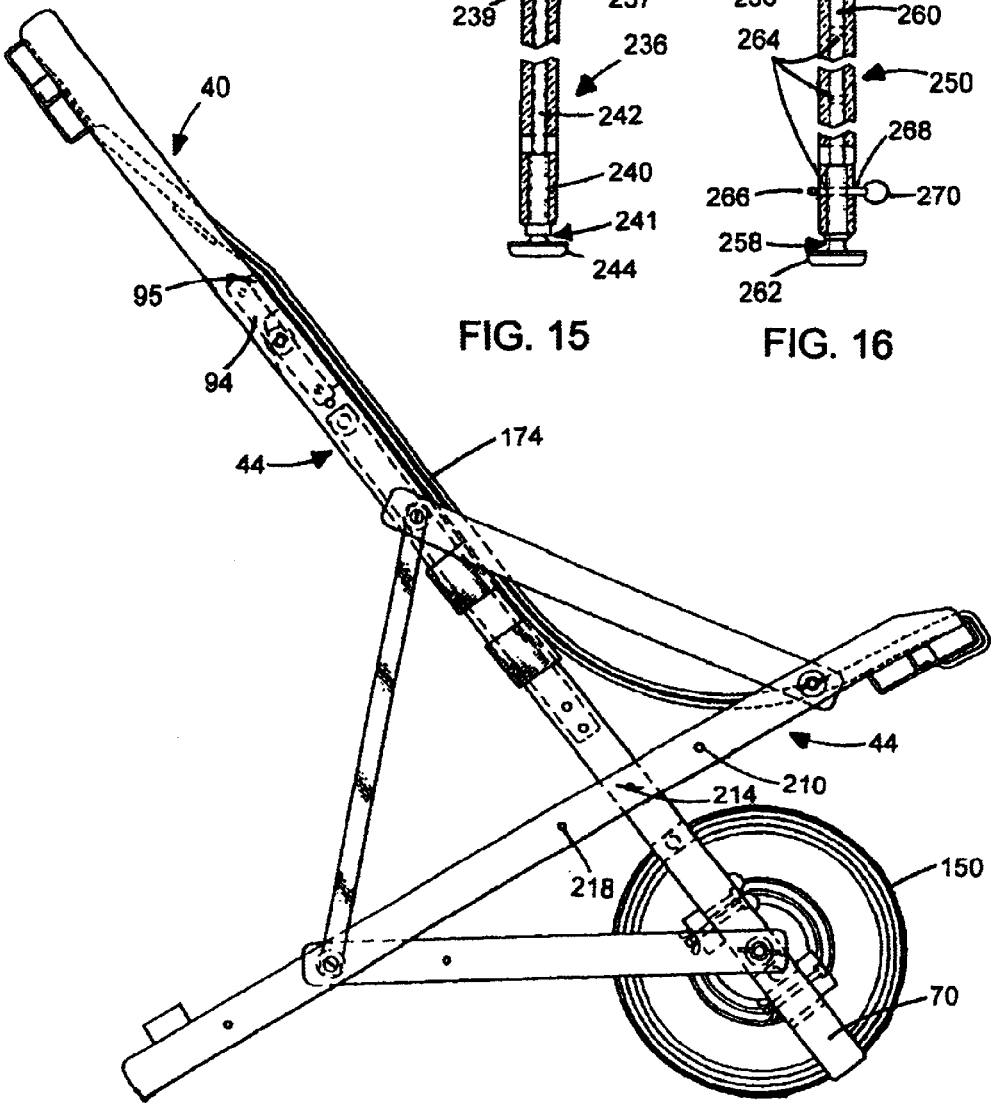
Figure 18:
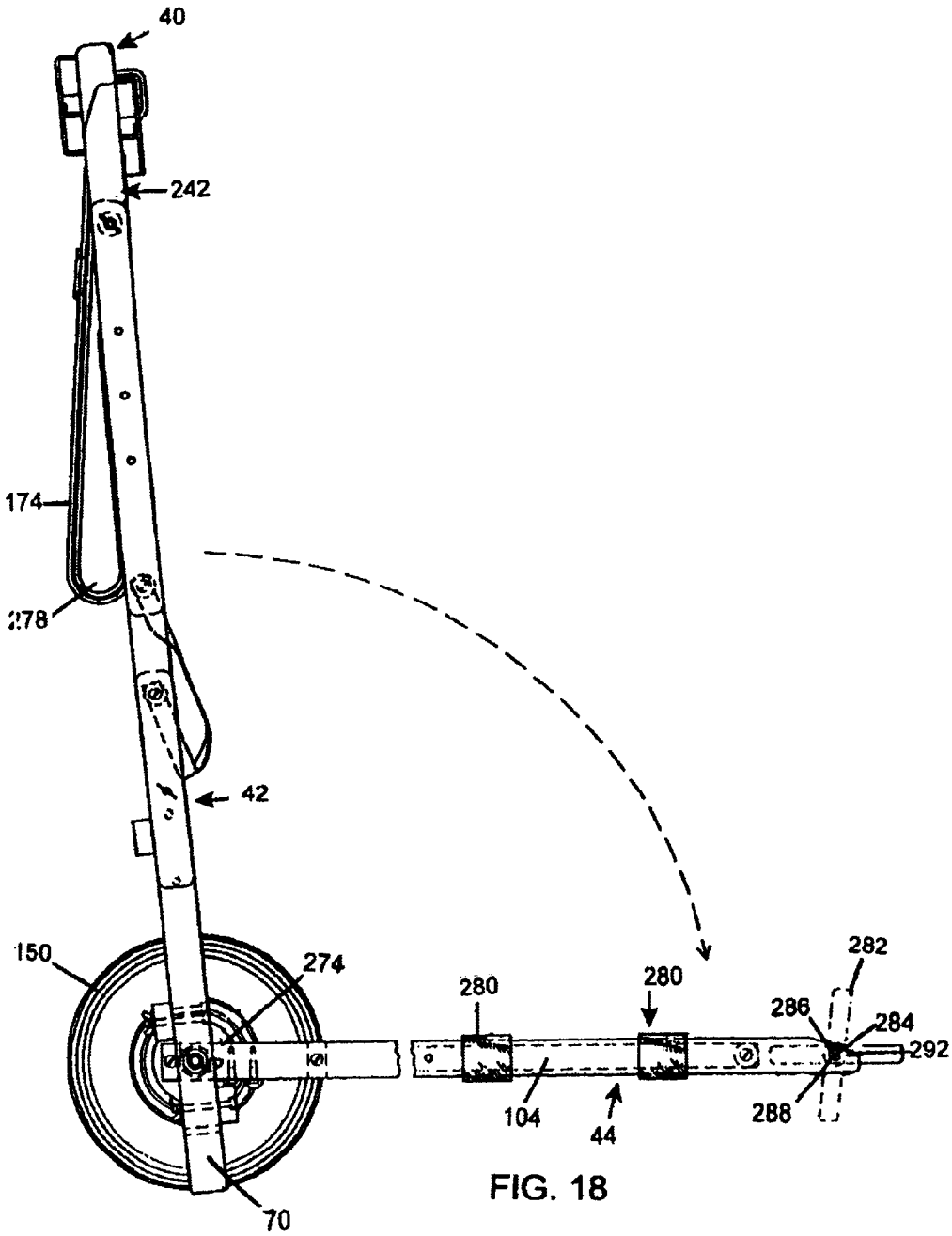
Figure 19:
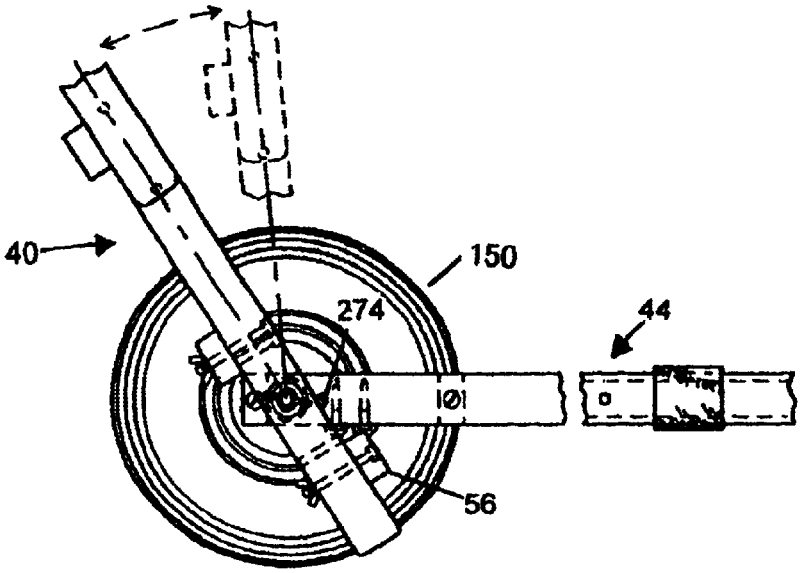
Figure 20:
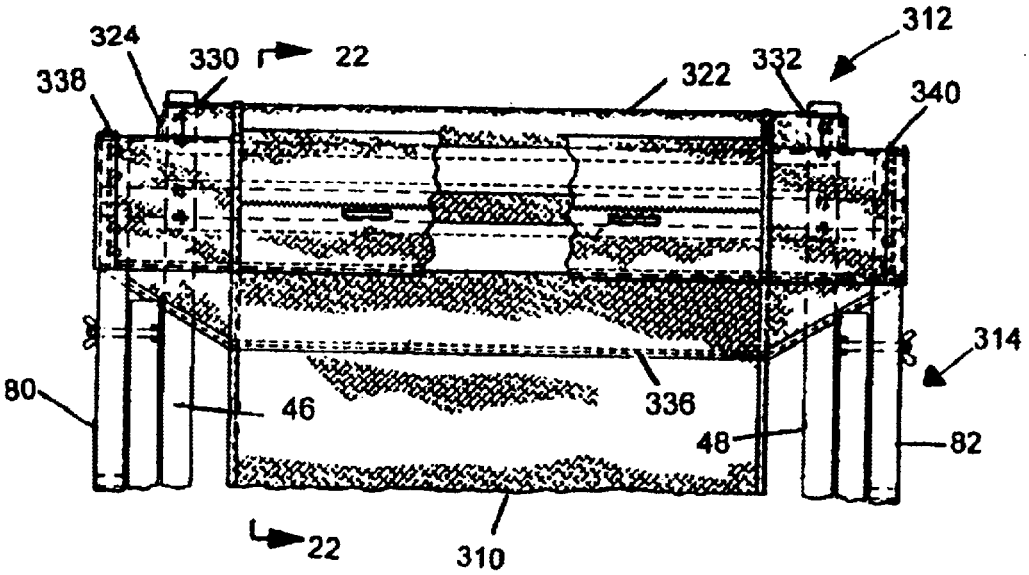
Figure 21:
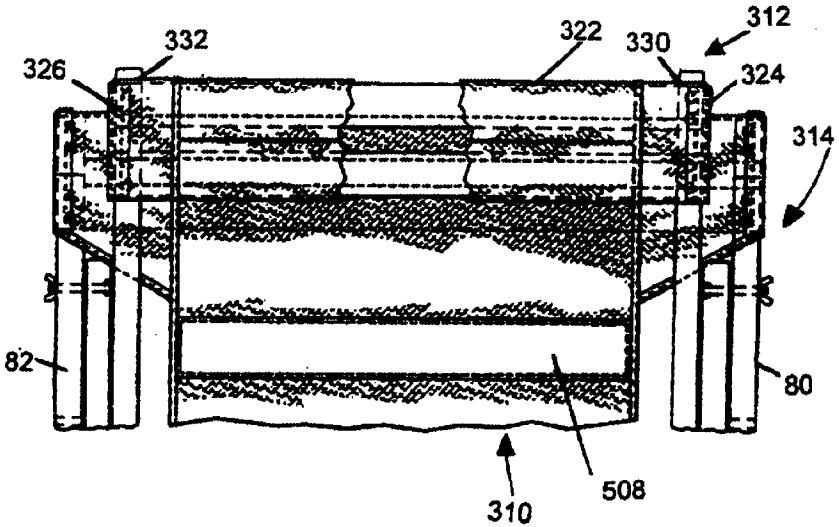
Figure 22:
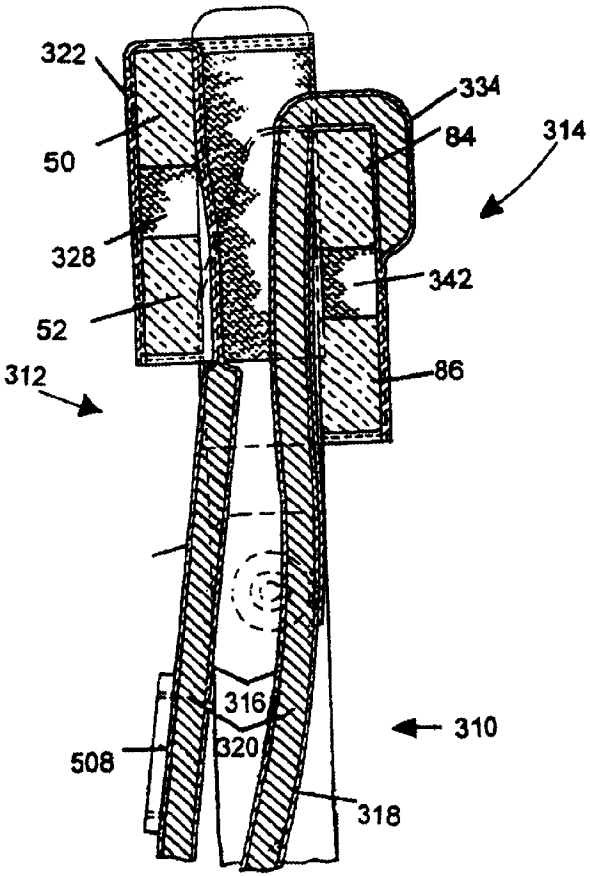
Figure 23:
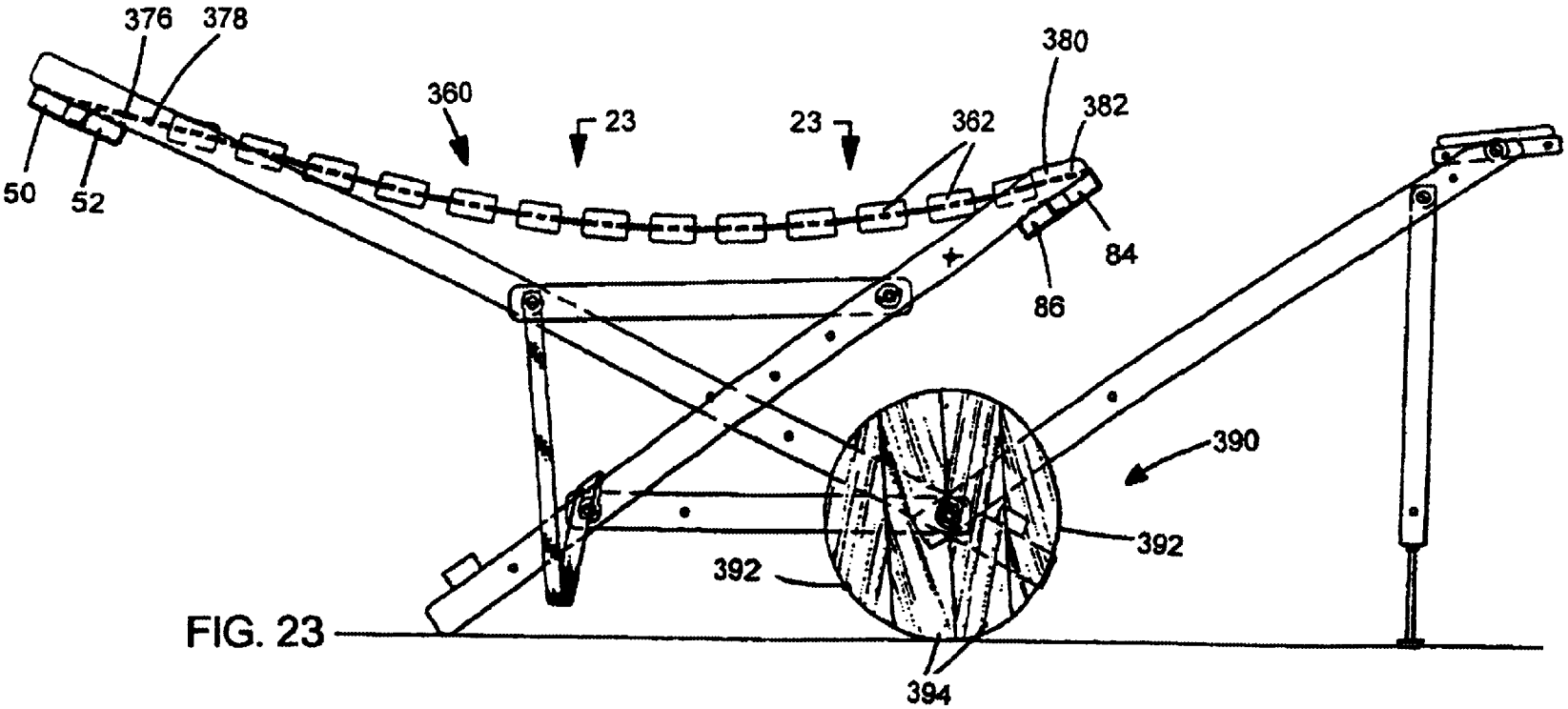
Figure 24:
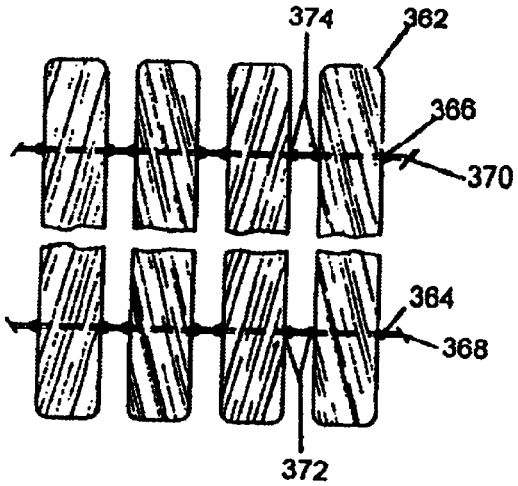

FIG. 14, a side elevation view of the chair equipped as a chaise lounge with full-length seat spanning from backrest to footrest, and with the footrest extended, the backrest and seat frames pinned in the fourth aperture for a reclining position more horizontal than in FIG. 13, and the footrest higher with the adjustable legs extended;

FIG. 15, a fragmentary lateral vertical section view taken on the line 15—15 of FIG. 13, showing the first version of the adjustable length legs which version has a threaded foot and insert;

FIG. 16, a partially broken lateral section view showing the second version of the adjustable length legs which version has pinned foot;

FIG. 17, a side elevation view of the chair with one wheel removed for clarity with the footrest stowed and the backrest and seat frames pinned in the third aperture for a wheel chair position and for use as a wheeled hauler;

FIG. 18, a side elevation view with one wheel removed for clarity showing the backrest and seat frames pinned in the stowed position and the footrest used as a cart with the foot supports in the stowed position;

FIG. 19, a fragmentary view corresponding to FIG. 18 showing the two positions of the footrest in the cart position based on the position of the backrest frame lower cross member;

FIG. 20, an enlarged fragmentary front elevation view of a first alternate version of the seat having attachment pockets;

FIG. 21, a fragmentary rear elevation view corresponding to FIG. 20;

FIG. 22, a fragmentary longitudinal vertical section taken on line 22—22 of FIG. 20 showing the details of the pockets and frames;

FIG. 23, a side elevation view of a version of the chair having a wooden slat seat and wooden wheels such as for use by a pool;

FIG. 24, an enlarged fragmentary longitudinal horizontal view taken on the line 24—24 of FIG. 23 showing the details of the wooden slats and the ropes.

Figure 25:
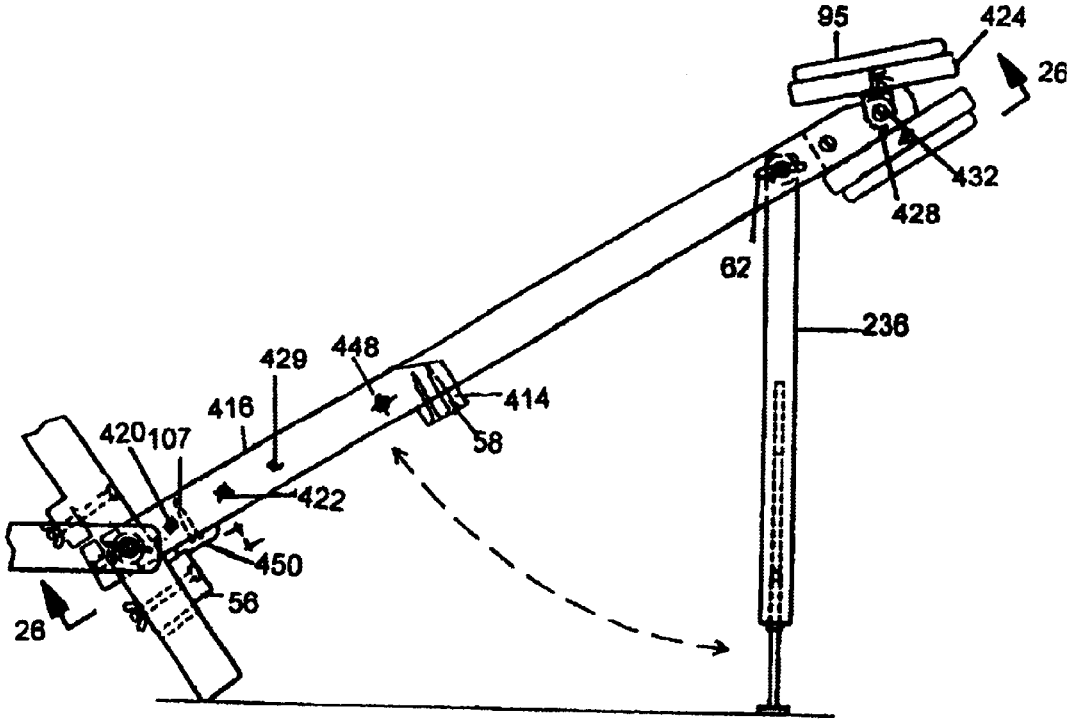
Figure 26:
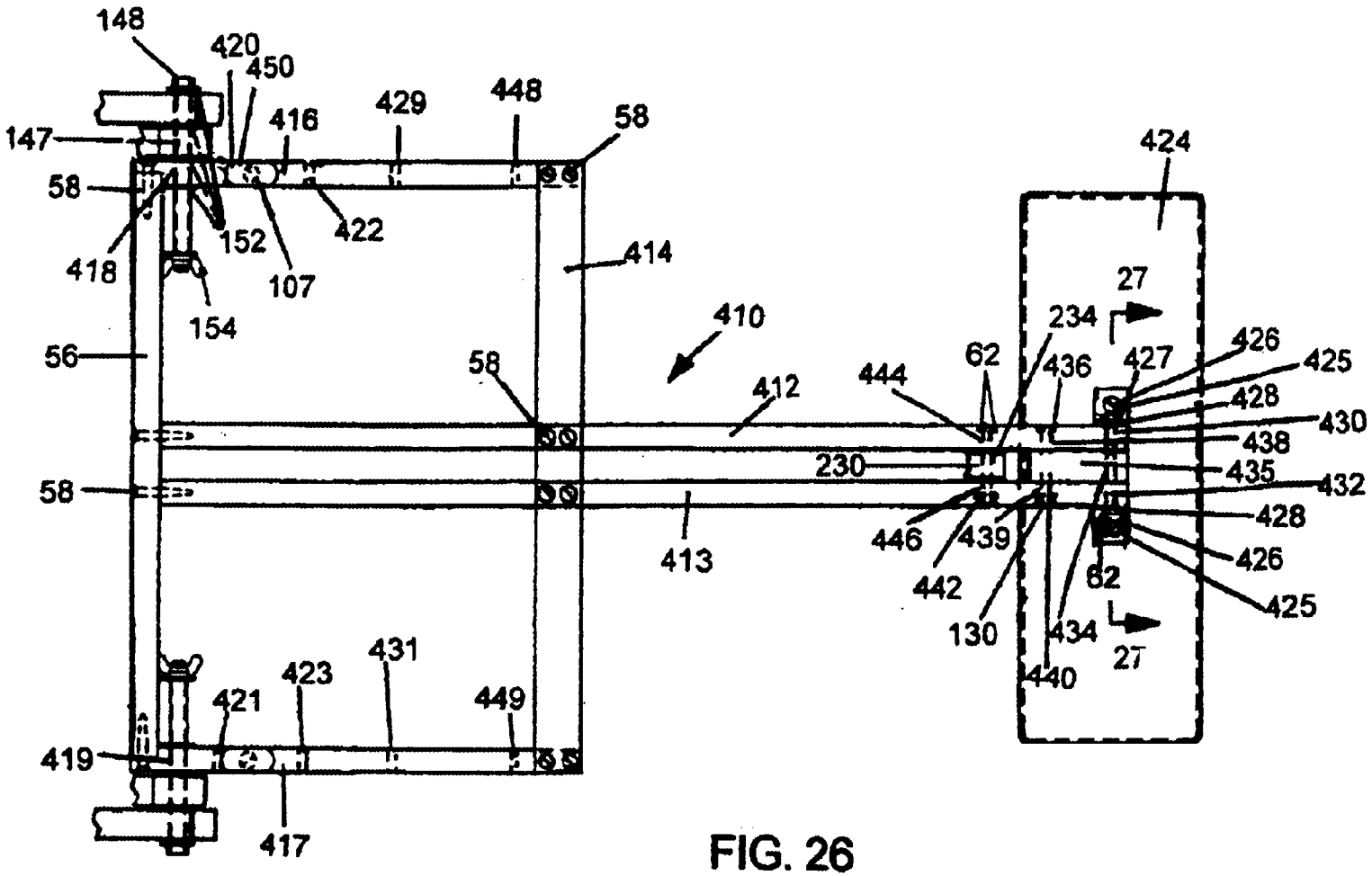
Figure 27:
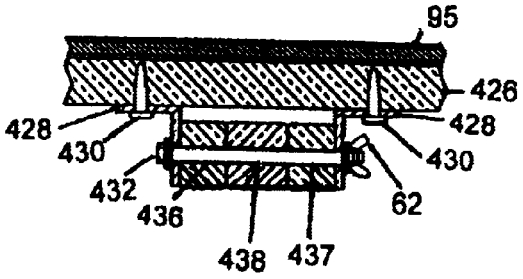
Figure 28:
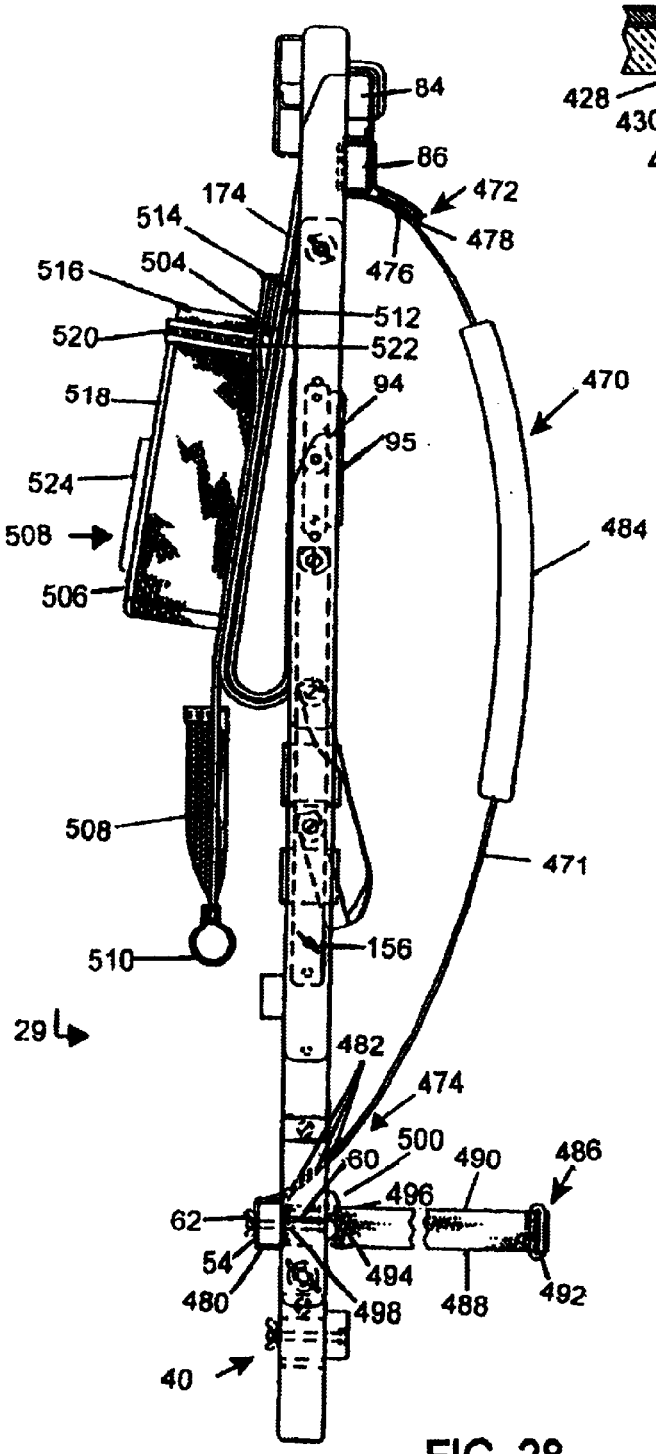
Figure 29:
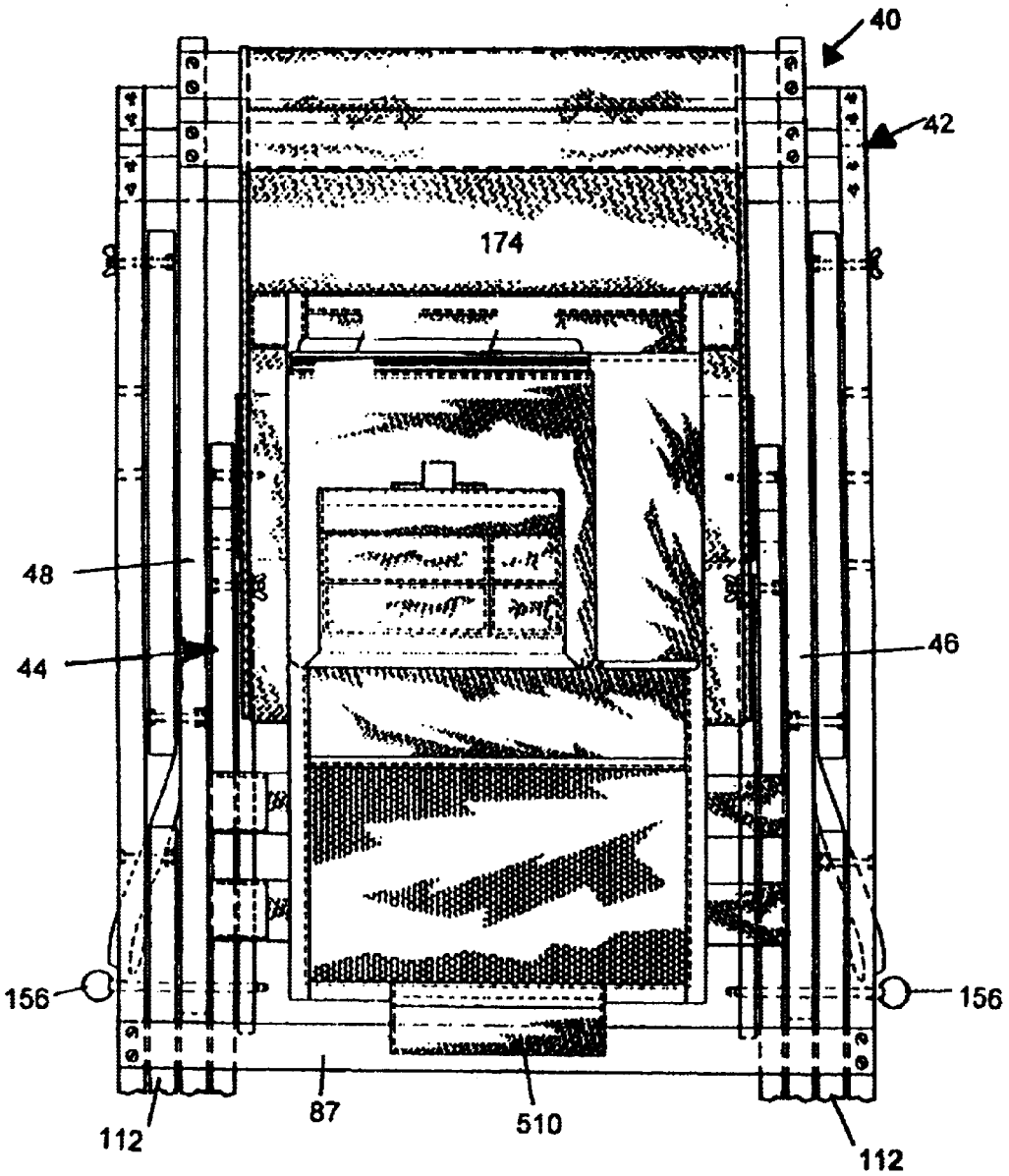
Figure 30:
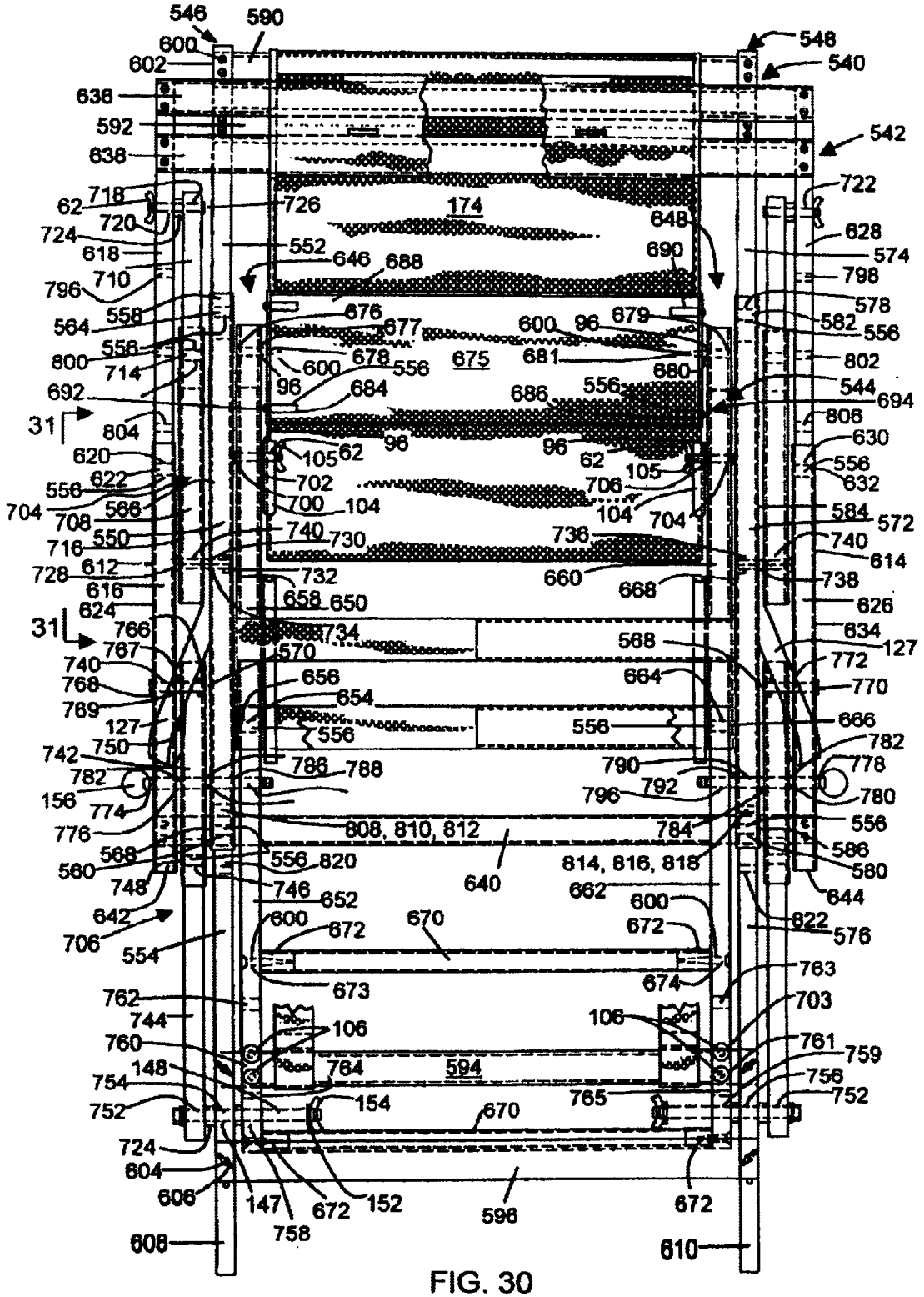
Figure 33:
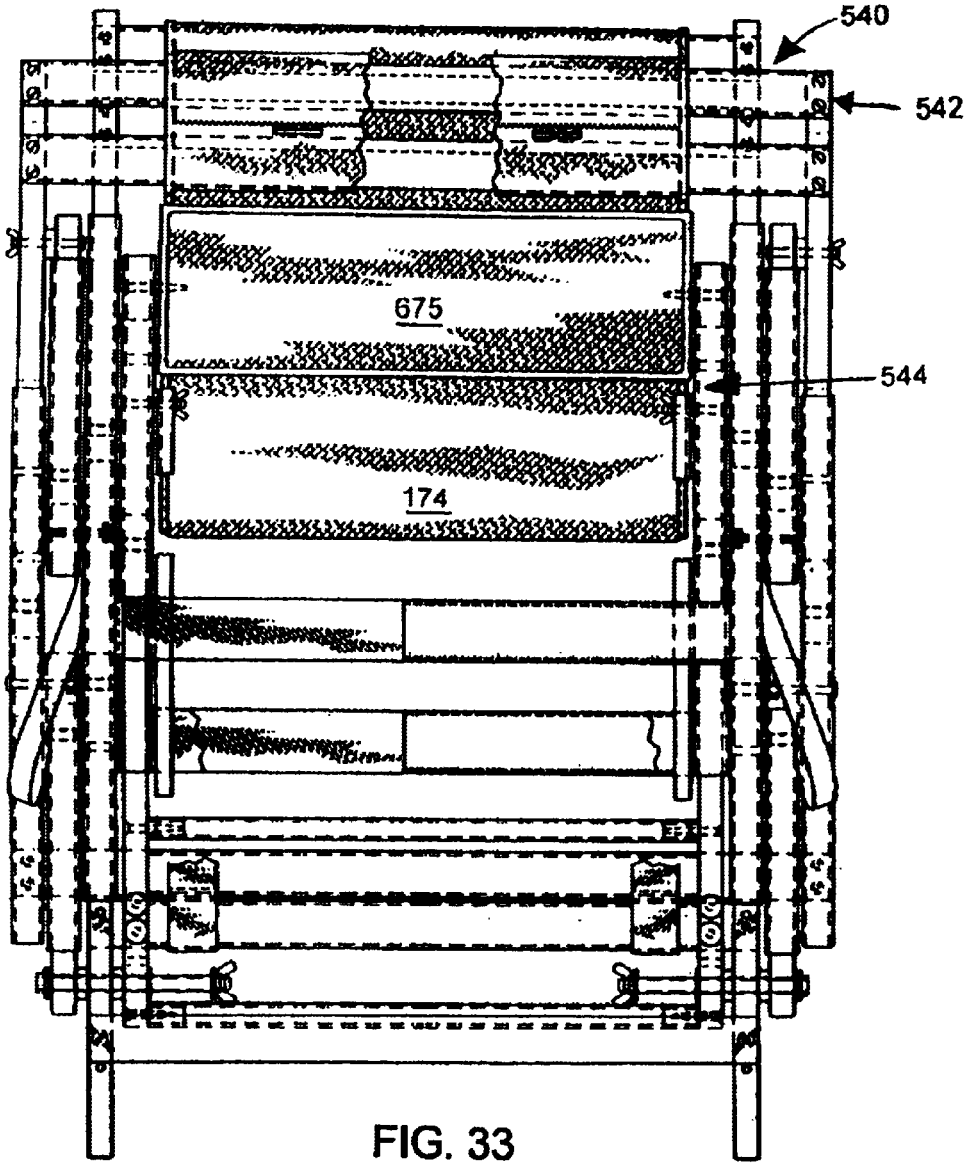
Figure 31:
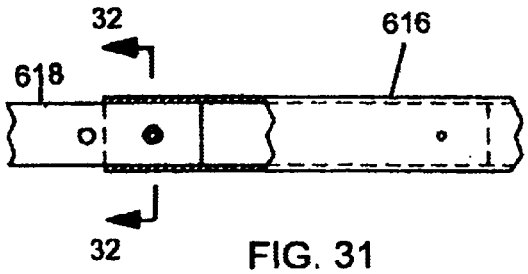
Figure 32:
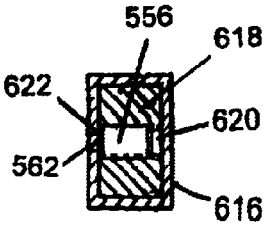
Figure 34:
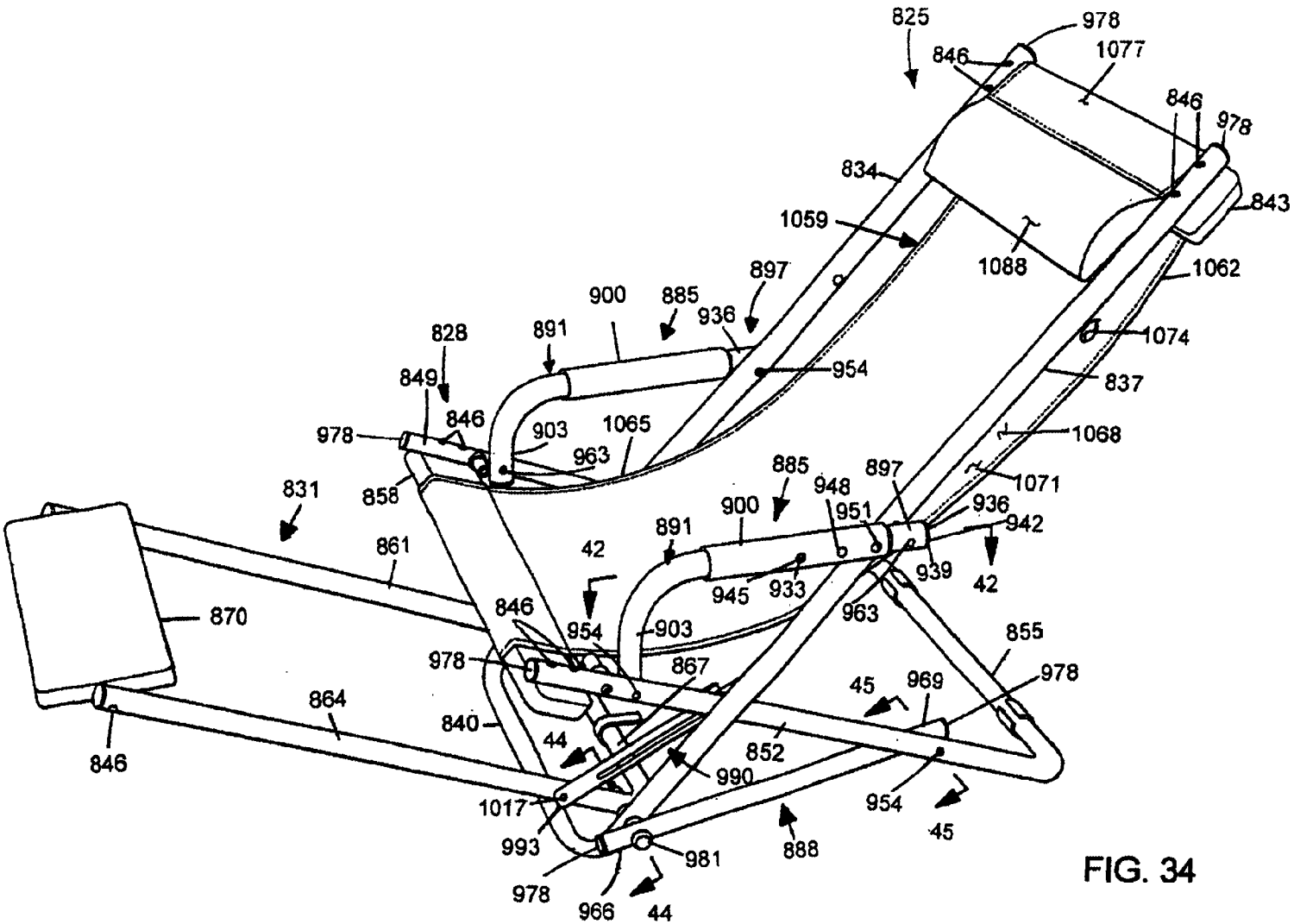
Figure 35:
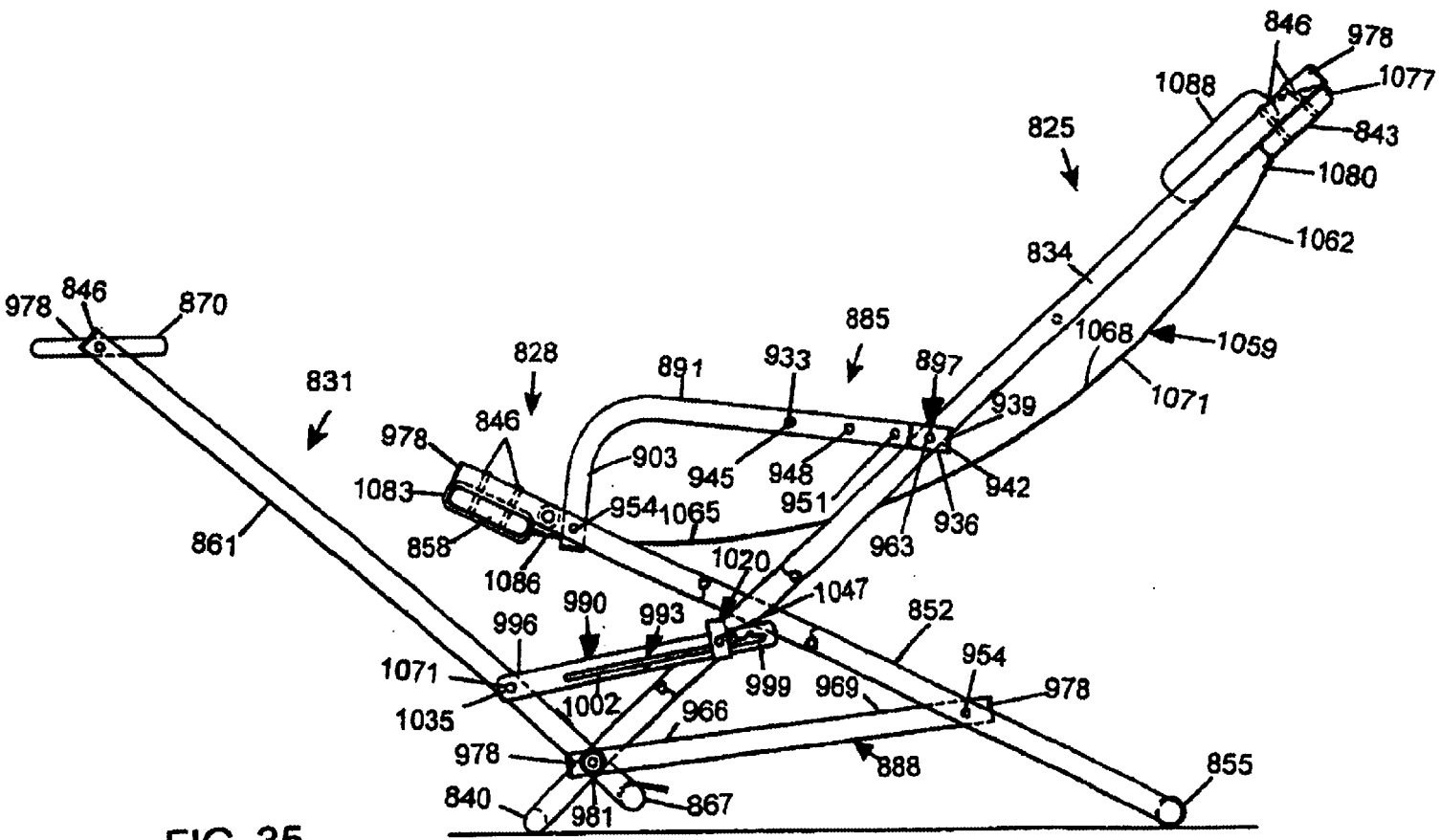
Figure 36:
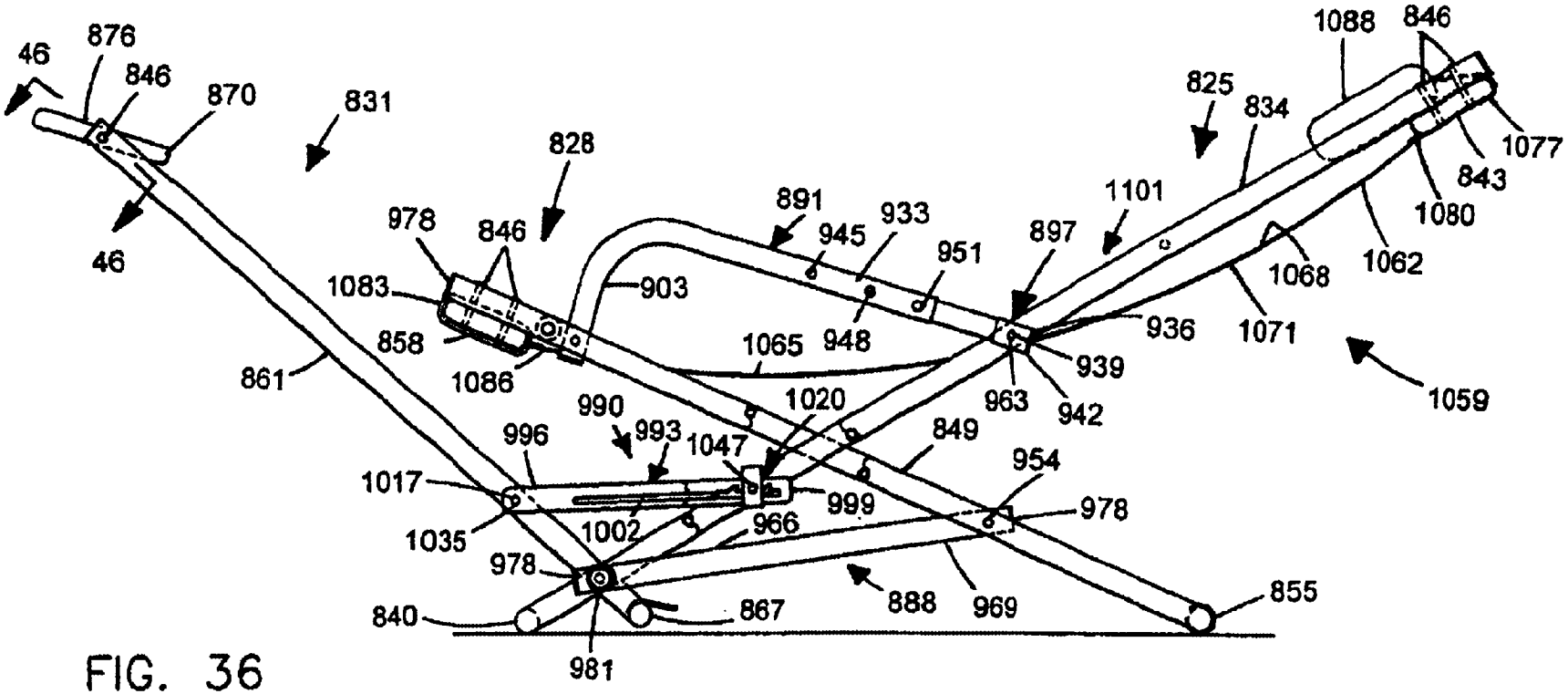
Figure 38:
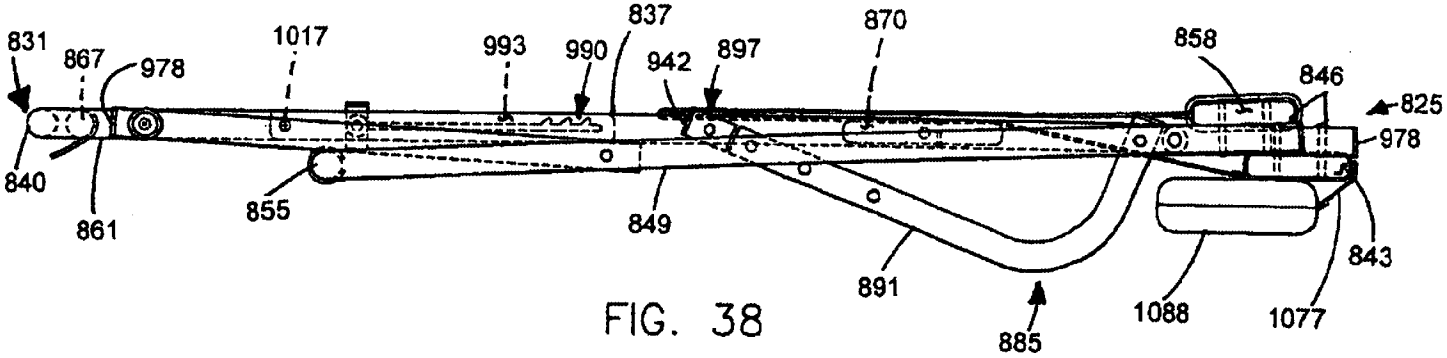
Figure 37:
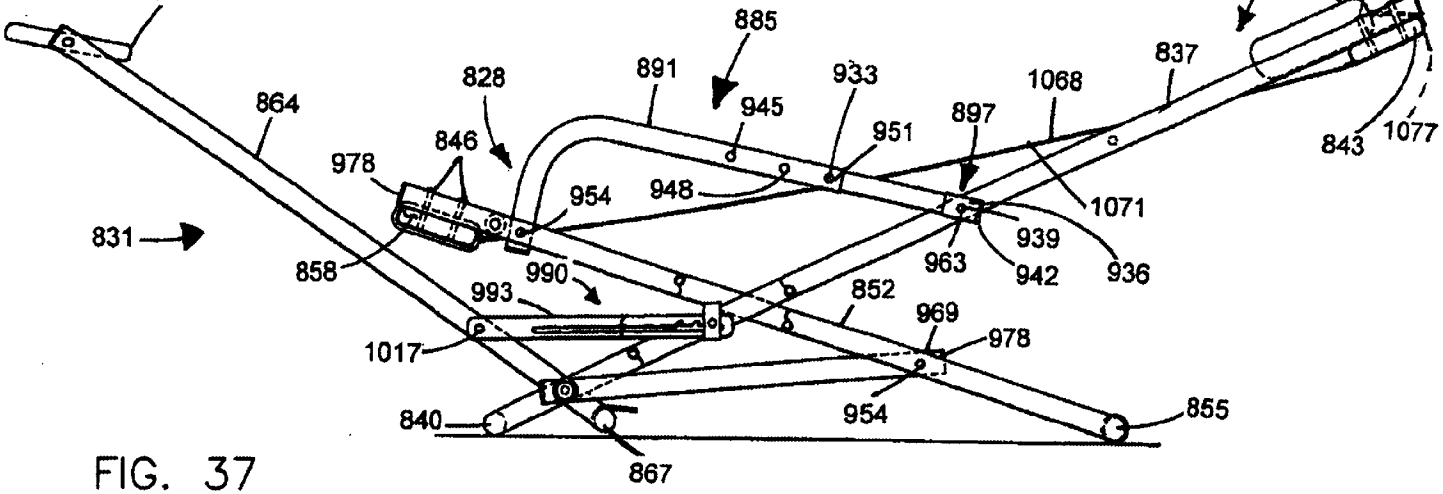
Figure 39:
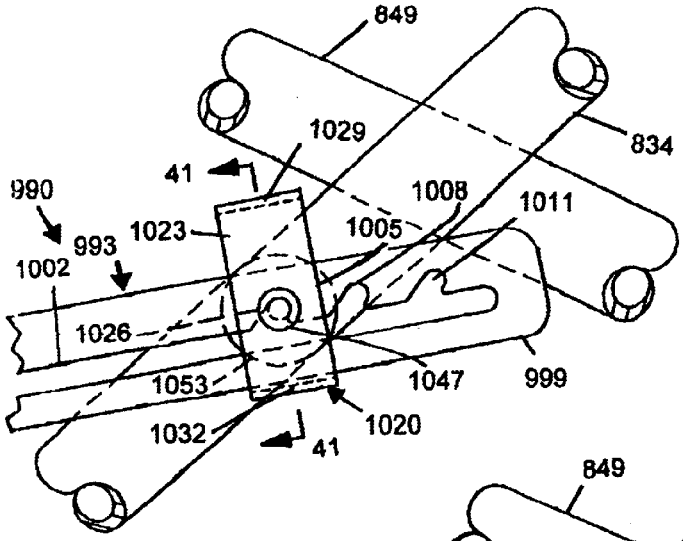
Figure 40:
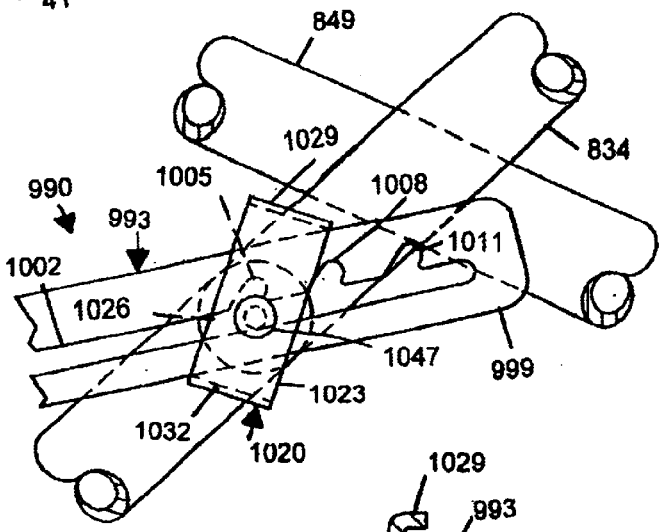
Figure 41:
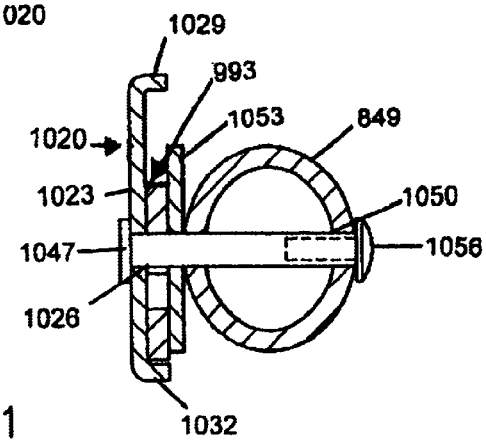
Figure 42:
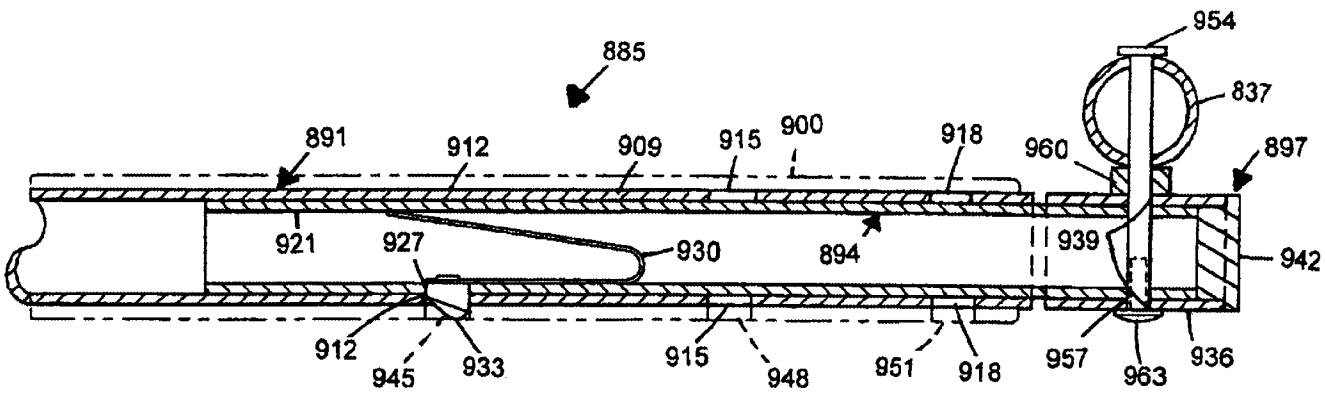
Figure 43:
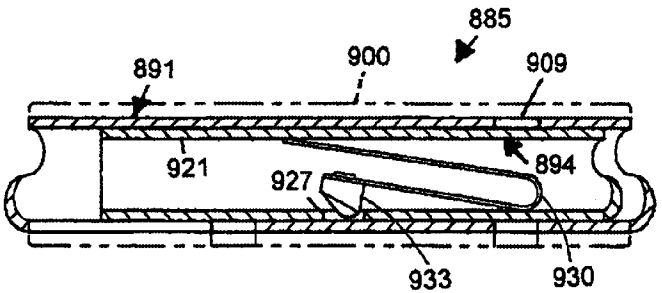
Figure 44:
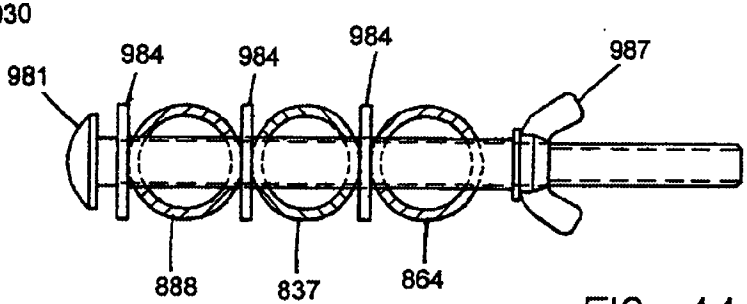
Figure 45:
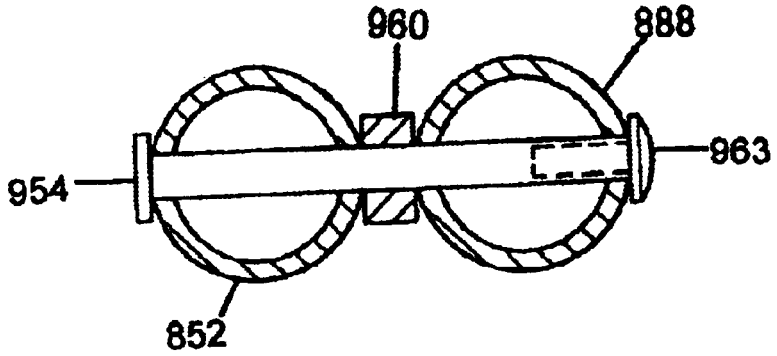
Figure 46:
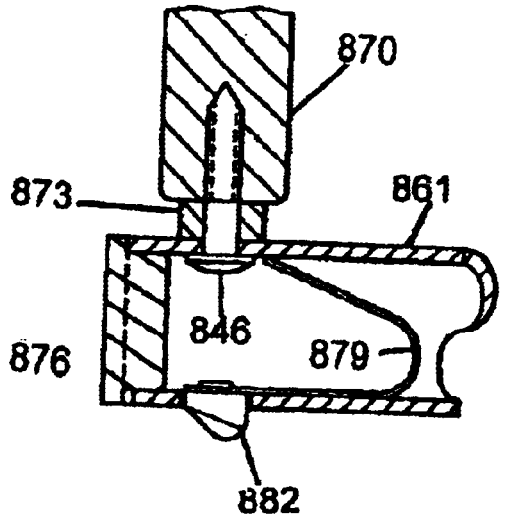
Figure 47:
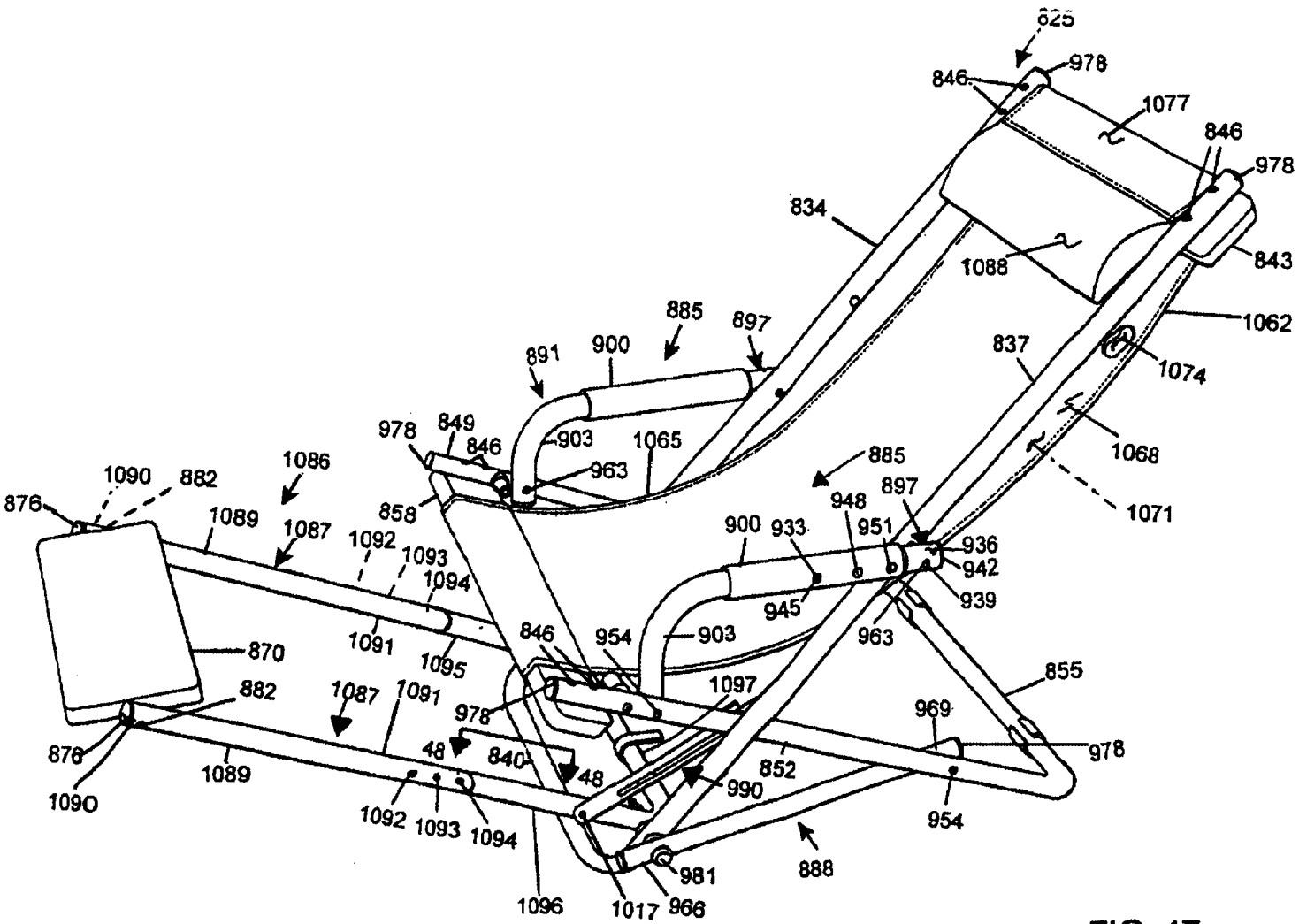
Figure 48:
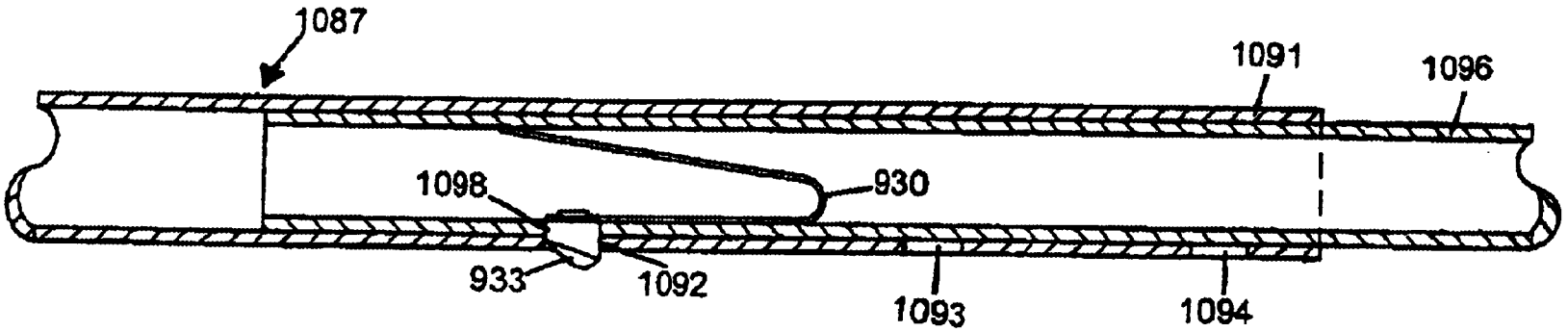
Figure 49:
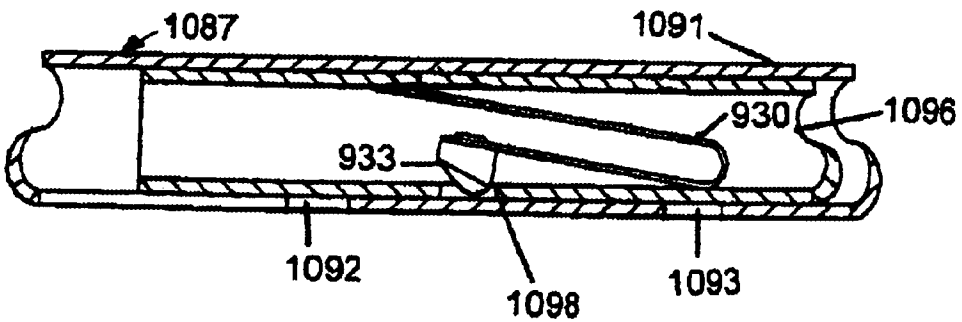
Figure 50:
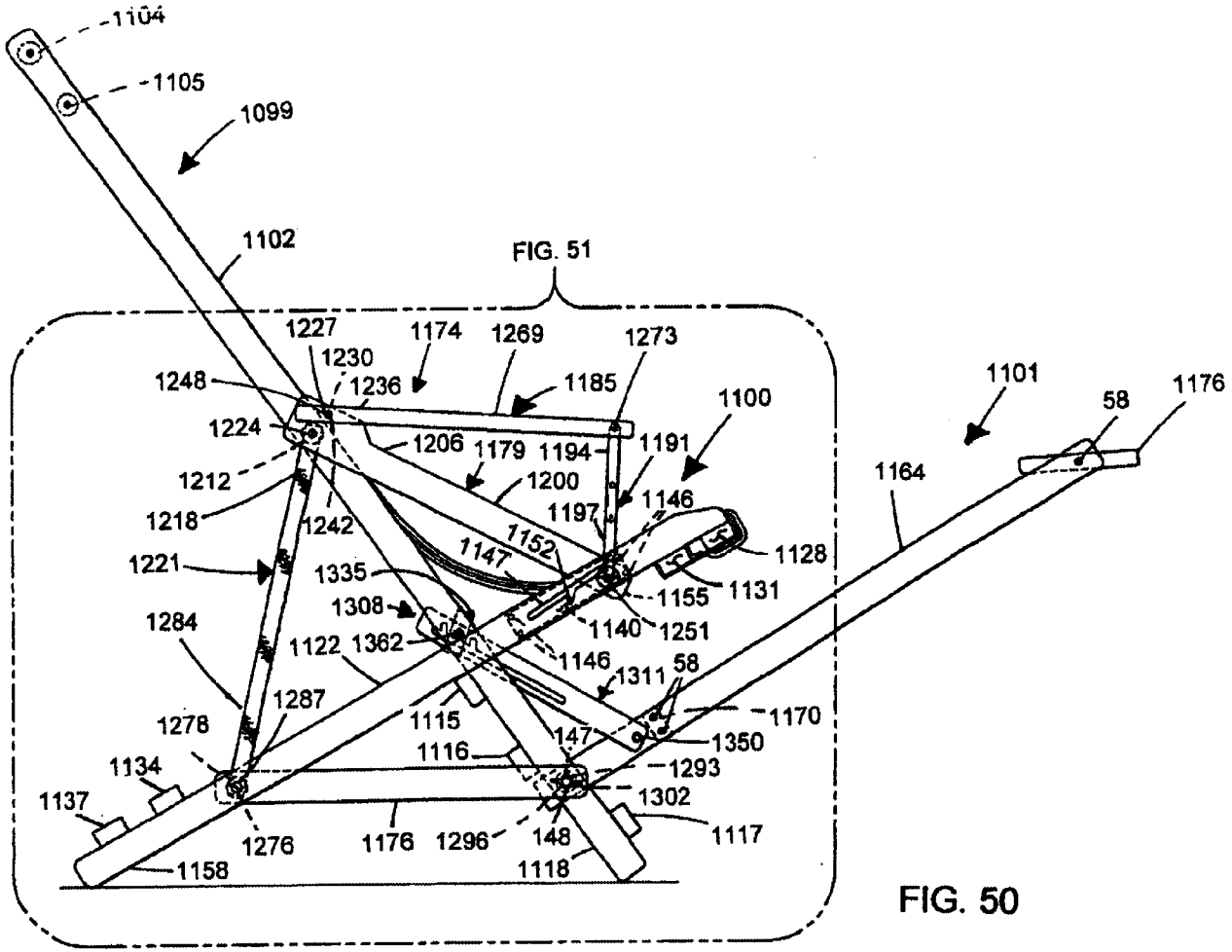
Figure 51:
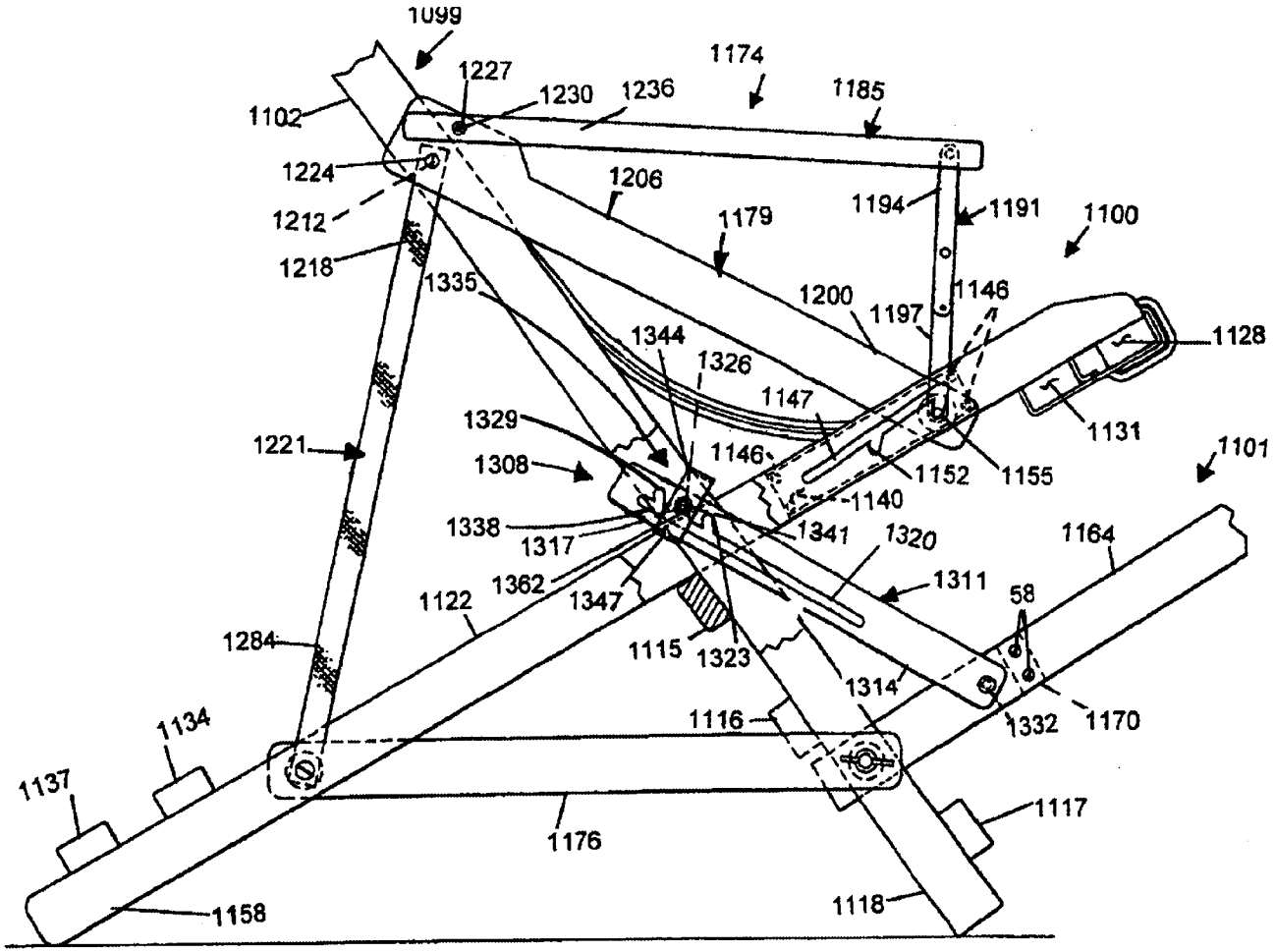
Figure 52:
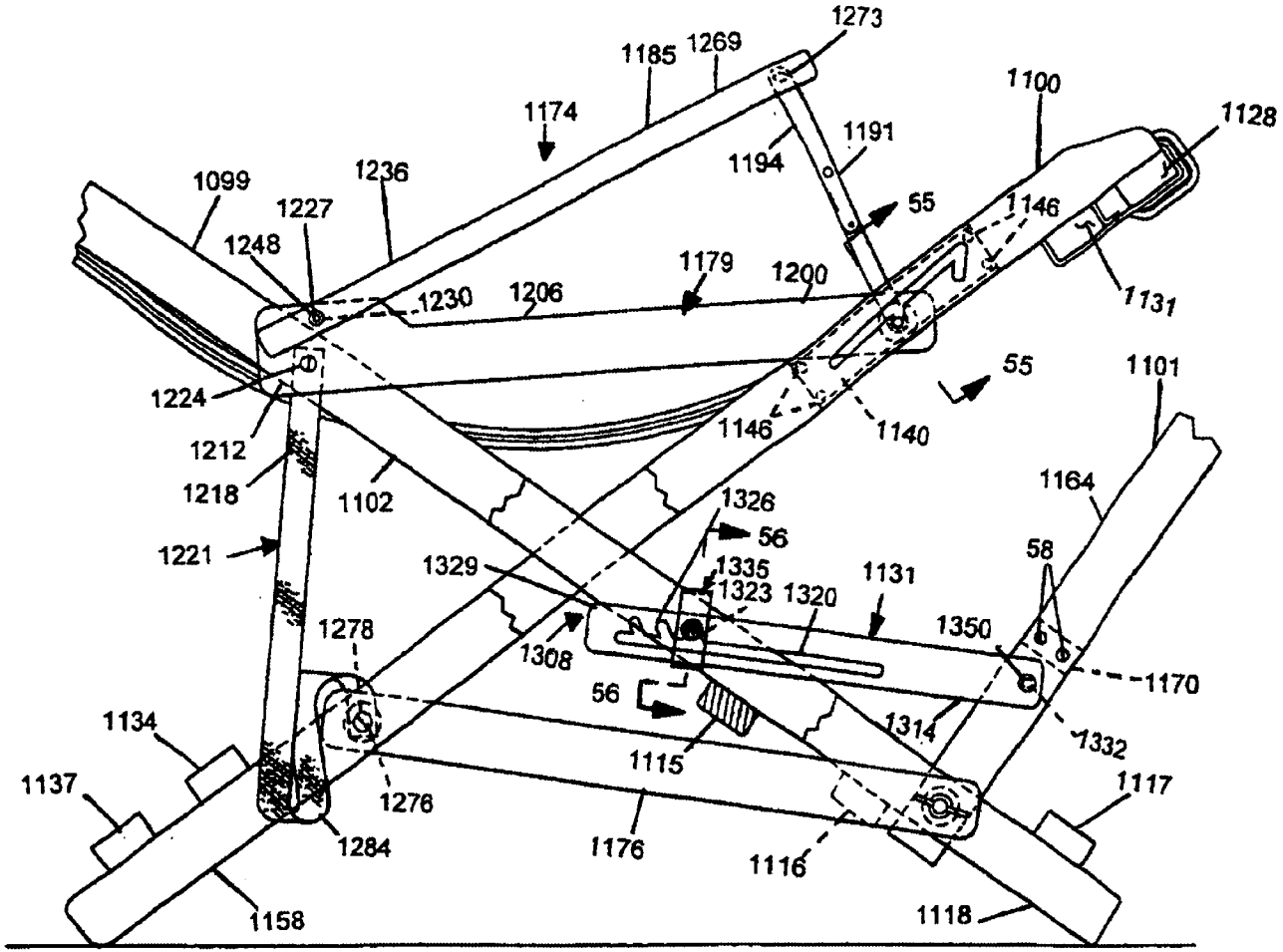
Figure 53:
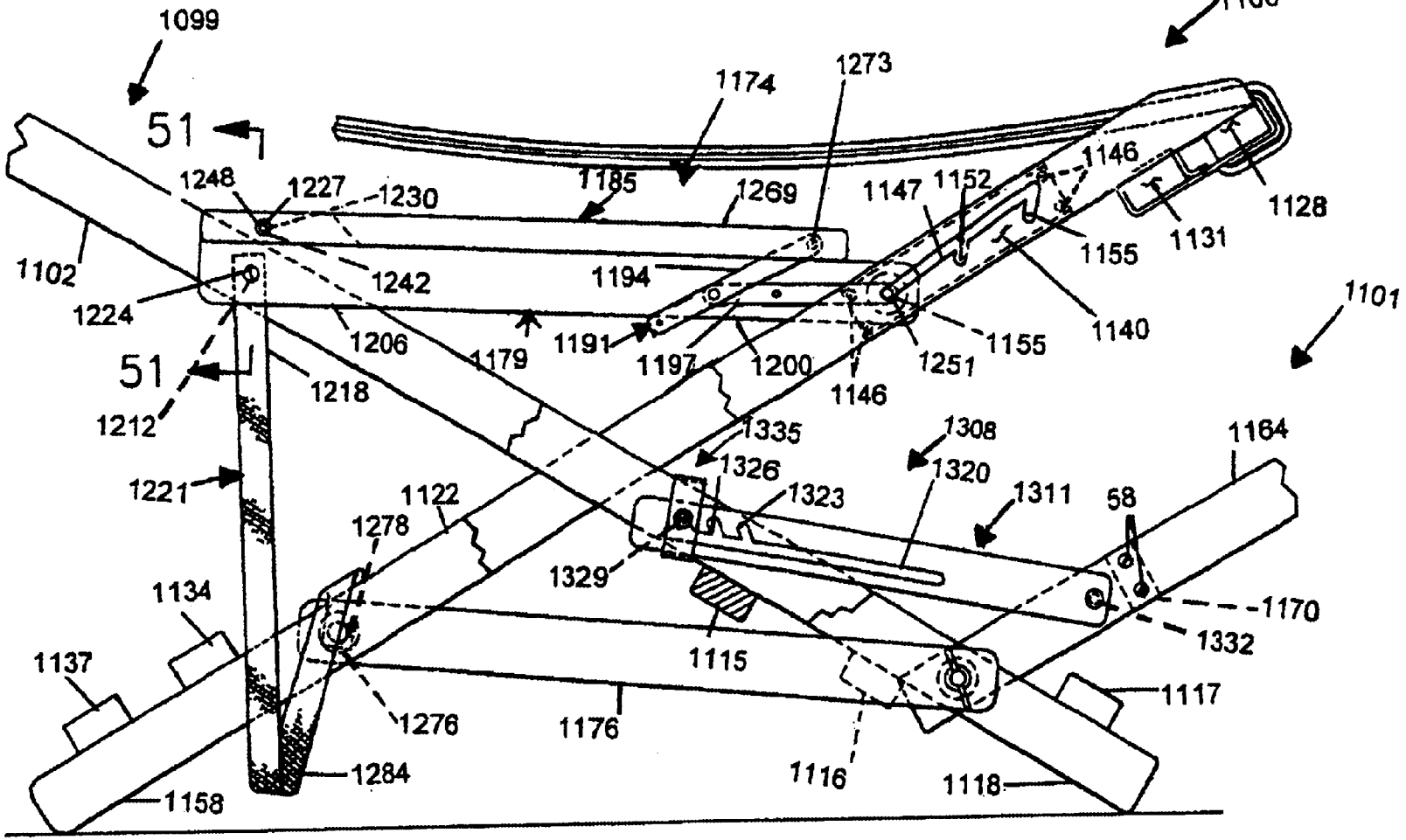
Figure 54:
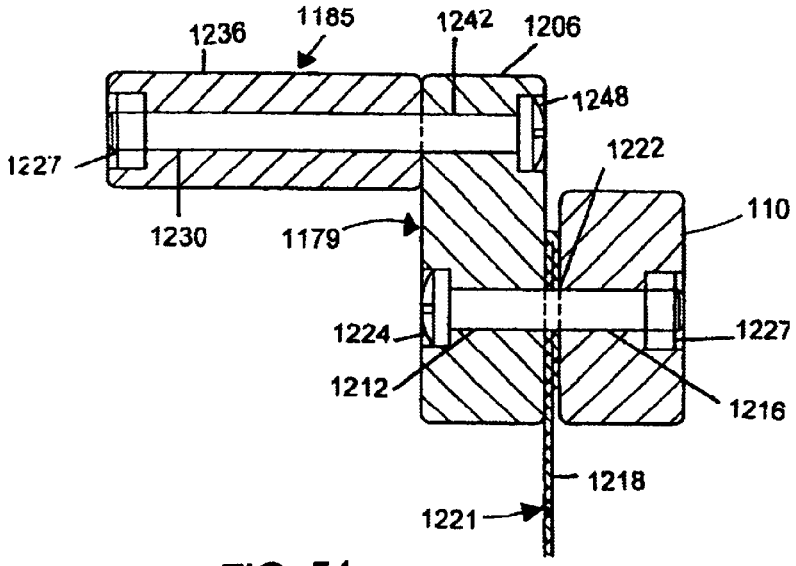
Figure 55:
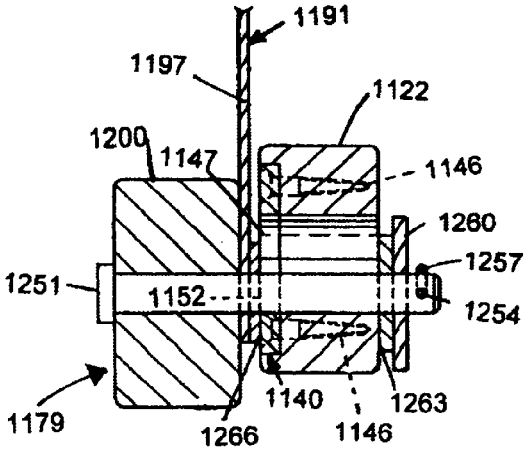
Figure 56:
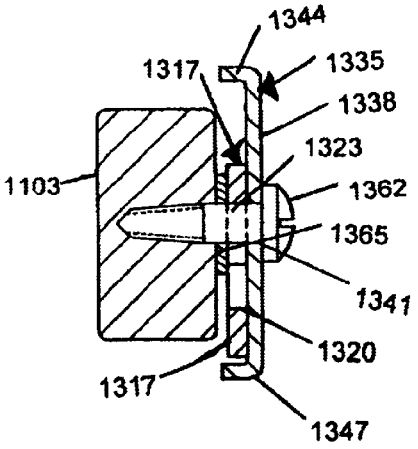

FIG. 25, a fragmentary side elevation view of an alternative version T-shaped footrest frame;

FIG. 26, a fragmentary bottom view taken on the line 26—26 of FIG. 25;

FIG. 27, a fragmentary lateral vertical section taken on the line 27—27 of FIG. 26;

FIG. 28, a side elevation view with a backpack, shoulder straps, and a belt attached as for hiking;

FIG. 29, a fragmentary rear elevation view corresponding to FIG. 28;

FIG. 30, a front elevation view of a second embodiment of the invention having telescoping backrest, seat, and footrest frames and siderails, as for use in backpacking with the frames shown in the extended position;

FIG. 31, a fragmentary longitudinal vertical section view taken on the line 31—31 of FIG. 30 showing the details of a typically telescoping section;

FIG. 32, a lateral vertical section view taken on the line 32—32 of FIG. 31 showing a typical spring-loaded plunger;

FIG. 33, a front elevation view corresponding to FIG. 30 with the frames and siderails shown in the retracted position;

FIG. 34, a perspective view of a third embodiment of the invention in the unfolded position with the footrest deployed;

FIG. 35, a side elevational view of the chair in the unfolded position in a most upright position with the footrest deployed in a highest position;

FIG. 36, a side elevational view of the chair in the unfolded position in a middle reclined position with the footrest deployed in a middle height position;

FIG. 37, a side elevational view of the chair in the unfolded position in a most reclined position with the footrest deployed in a lowest height position;

FIG. 38, a side elevational view of the chair in a folded position;

FIG. 39, a fragmentary side elevational view to an enlarged scale corresponding to FIG. 35 showing the release tab in the unreleased position;

FIG. 40, a fragmentary side elevational view corresponding to FIG. 39 showing the release tab in the released position;

FIG. 41, a lateral vertical sectional view taken on the line 41—41 of FIG. 40 showing the details of the release tab and the associated mounting hardware;

FIG. 42, a fragmentary longitudinal horizontal sectional view taken on the line 42—42 of FIG. 34 showing the spring locking clip in the locking position;

FIG. 43, a fragmentary longitudinal horizontal sectional view corresponding to FIG. 42, but wherein the spring locking clip is in the unlocked position;

FIG. 44, a lateral vertical sectional view to an enlarged scale taken on the line 44—44 of FIG. 34 showing the mounting of a front lower pivot pin to the tubes of the frames;

FIG. 45, a lateral vertical sectional view to an enlarged scale taken on the line 45—45 of FIG. 34 showing the mounting of a rear lower pivot pin to the tubes of the frames;

FIG. 46, a fragmentary longitudinal vertical sectional view to an enlarged scale taken on the line 46—46 of FIG. 36 showing the details of the pivotal mounting of the footrest to the footrest frame;

FIG. 47, a perspective view corresponding to FIG. 34, but having an extendible length footrest utilizing spring locking clips;

FIG. 48, a fragmentary longitudinal horizontal sectional view taken on the line 48—48 of FIG. 47 showing the spring locking clip in the locking position;

FIG. 49, a fragmentary longitudinal horizontal sectional view corresponding to FIG. 48, but wherein the spring locking clip is in the unlocked position;

FIG. 50, a side elevational view of a chair which utilizes ratchet assemblies and folding armrests, being in the unfolded position with the seat in a most upright position with the footrest deployed in a middle height position;

FIG. 51, a fragmentary side elevational view to an enlarged scale taken on the line 51—51 of FIG. 50 partially broken to show the details of the ratchet assembly;

FIG. 52, a fragmentary side elevational view to a further enlarged scale corresponding to FIG. 51, but in a middle reclined position and with the footrest in a highest elevated position;

FIG. 53, a fragmentary side elevational view corresponding to FIG. 51, but in a most reclined position with the footrest in a lowest elevated position, and with the arm rests lowered;

FIG. 54, a fragmentary lateral vertical sectional view taken on the line 54—54 of FIG. 53 showing the details of the pivotal connection of the armrest and backrest frame;

FIG. 55, a fragmentary lateral vertical sectional view taken on the line 55—55 of FIG. 52 showing the details of the pivotal connection of an upper siderail a side member of the seat frame; and FIG. 56, a lateral vertical sectional view taken on the line 56—56 of FIG. 52 showing the pivotal connection of a ratchet plate and a release plate to a side member of the backrest frame.

DETAILED DESCRIPTION OF THE ILLUSTRATED EMBODIMENTS

The overall structure of the folding rocking chair and chaise lounge first embodiment is best seen in FIGS. 1 and 2 wherein is shown a backrest frame 40, a seat frame 42, and a footrest frame 44.

Backrest frame 40 comprises a pair of elongate side members 46 and 48, a pair of upper cross members 50 and 52, and a pair of lower cross members 54 and 56. All of the members of backrest frame 40 are typically made from hardwood, and are attached together such as by screws 58, except for cross members 54 and 56 which are removably attached such as by bolts 60 and wingnuts 62 inserted through a plurality of apertures either 63 and 64 or 65 and 66, and either 67 and 68 or 69 and 70 (FIG. 10), to maintain footrest frame 40 at one or the other of two elevational heights as will be explained subsequently. The lower portion of each of side members 46 and 48 comprise front legs 71 and 72, respectively.

Seat frame 42 comprises a pair of elongate side members 80 and 82, a pair of upper cross members 84 and 86, and a lower cross member 87. All of the members of seat frame 42 are typically made from hardwood, and are attached together such as by screws 58. The lower portion of each of side members 80 and 82 comprise rear legs 88 and 89, respectively.

Footrest frame 44 comprises a pair of elongate side members 90 and 91, a pair of lower cross members 92 and 93. All of the members of footrest frame 44 are typically made from hardwood, and are attached together such as by screws 58. A foot support 94 is pivotally attached to footrest frame side members 90 and 91 as by screws 58 and washers 96 (FIG. 3). Foot support 94 is held in a stowed position parallel to side members 92 and 93 while not in use by a pair of conventional spring-loaded plungers 97 one each fitted into apertures 98 and 99 of footrest side members 90 and 91, respectively, which selectively mate with one or the other pair of matching detentes 100 or 101 in foot support 94 (FIG. 9). A pair of recessed apertures 102 and 103 extend through footrest side members 90 and 91. A pair of elongate footrest legs 104 selectively support footrest frame 44, each having an upper aperture 105 and which are pivotally attached to footrest side members 90 and 91 by means of bolts 106 extending through the respective apertures 102 and 105 or 103 and 105 and removably secured by wingnuts 62. A pair of rubber or plastic pads 106 are attached to each of footrest side members 90 and 91 so as to cushion the contact with the backrest lower cross member 56 in each of two positions (FIG. 10).

Backrest frame 40 and seat frame 42 are connected together so as to form the basic rocking chair by a pair of upper siderails 110 and a pair of lower siderails 112. Upper and lower siderails 110 and 112 are typically substantially rigid members. Each of upper siderails 110 have a recessed aperture 114 which aligns with an aperture 116 or 118 in seat frame side members 80 and 82, respectively, with a washer 97 therebetween, and through which a bolt 120 is disposed and removably held in place by a wingnut 62. Each of upper siderails 110 also have a recessed aperture 122 which aligns with a recessed aperture 124 or 126 in backrest frame side members 46 and 48, respectively, with an end of a retaining strap 127 having a aperture (not shown) therebetween and through which a bolt 128 is disposed and held in place by a nut 130 (FIG. 4).

Each of lower siderails 112 have a recessed aperture 132 which aligns with a recessed aperture 134 or 136 in seat frame side members 80 and 82, respectively, with the opposite end of retaining strap 127 therebetween, and through which a bolt 128 is disposed and removably held in place by a nut 130. Each of lower siderails 112 also have an axle aperture 138 which aligns with an axle aperture 140 and 142 in backrest frame side members 46 and 48, respectively, and with axle apertures 144 and 146 in footrest frame side members 46 and 48, and through which a sleeve or bushing 147 and a bolt or threaded axle 148 is disposed (FIG. 5). A pair of wheels 150, typically of the rubber pneumatic type, are disposed on threaded axles 148 with washers 152 and retained thereon by wingnuts 154. Wheels 150 are used in certain chair configurations and may be removed for storage and threaded axles 148 may be reversed such that they do not protrude from the sides of the chair (FIG. 6).

When upper and lower siderails 110 and 112 are substantially rigid members, the placement of the connections thereof to the respective side members must be designed such that the chair folds properly and opens to the desired positions. In such case, typically the attachment points of the pair of upper siderails 110 and the pair of lower siderails 112 to the respective backrest frame and seat frames 40 and 42 are substantially the same on each side of the chair such that the respective pairs of siderails are parallel. Likewise, the distance between apertures 114 and 122 of upper siderails 110 and between apertures 132 and 138 of lower siderails 112 will typically be substantially equal, with upper and lower siderails 110 and 112 being generally parallel to the ground in the chair position to allow the chair to fold up properly. Other configurations wherein the backrest frame 40 and seat frame 42 properly fold and nest together with upper and lower siderails 110 and 112 are also possible.

Once the chair is folded, a pair of pins such as ring handled, spring ball bearing pins 156 are inserted through the respective apertures 158 and 160 of seat frame 42 side members 80 and 82, apertures 162 of lower siderails 112, apertures 164 and 166 of backrest frame 40 side members 46 and 48, apertures 168 and 170 of footrest frame 44, and apertures 172 of footrest legs 103 so as to retain the chair in the closed or stowed position (FIG. 7). By removing pins 156 the chair can be easily be unfolded, especially when the upper and lower siderails 110 and 112 are substantially rigid. If upper siderails 110 and/or lower siderails 112 are flexible, an additional pin or pair of pins (not shown) inserted into additional coaxial apertures (not shown) through the respective frames 40, 42, and 44 and spaced therefrom may be needed to maintain the same in the proper folded position. Each of the various apertures wherein members pivot relative to one another or wherein pins may be inserted may be made larger such that a metal or plastic bushing (not shown) may be pressfit or glued therein so as to provide a more precise fit and eliminate wear to the respective member, particularly when the members are wooden.

Referring to FIG. 8, a rectangular, longitudinally flexible seat 174 has a head end 176, a foot end 178, and typically has a canvas top layer 180 and a canvas bottom layer 182 which surround a padded core 184 such as sheet foam, which extends for most of the length thereof. Head end 176 is retained in place by a portion thereof 186 which contains no padded core 184 and which is partially wrapped around backrest frame upper cross member 50, completely wrapped around cross member 52, and retained such as by a riveted or sewn seam 188. Foot end 178 is retained in place by a portion thereof 190, part of which contains padded core 184, which is partially wrapped around seat frame upper cross member 84, with padded core 184 acting to cushion a user's legs, completely wrapped around cross member 86, and retained such as by a riveted or sewn seam 192. Seat 174 is typically of such a length as to conform to a person's sitting posture in a chair position. Seat 174 is typically of such a width as to span most of the distance between backrest frame side members 46 and 48 so as to provide a comfortable width seat. An airtight version of the seat (not shown) can be made similarly for use with the chair such as by using plastic coated cloth such as canvas with a glued or heat-sealed perimeter seam and sealing air valve to selectively add or exhaust air. A resilient, thicker open-cell foam is preferable for such use since air is admitted through the air valve by the foam core expanding. Likewise, air is exhausted therefrom by compressing the foam core to expel excess air. This allows the user thereof to customize the feel of the seat with less air providing a more flexible seat and with more air providing a stiffer seat.

Referring to FIG. 9, there is shown the unfolded chair with footrest frame 44 extended and with the relative motions of backrest frame 40, seat frame 42, footrest frame 44, upper siderails 110, and lower siderails 112 shown as the chair rocks from a rear position (solid lines) to a forward position (dotted lines). Straps 127, shown in a relaxed position, limit the forward travel of backrest 40 to help prevent the chair from tipping over in the forward direction. Foot support 94 is shown in a horizontal position with spring-loaded plungers 97 disengaged from detentes 100 where it would normally be stored with pad 95 against seat surface 174 and footrest frame pinned in place so as to provide back support to the user. In the stored position foot support member 94 can also be stored with ball plungers 97 engaging detentes 101 which positions pad 95 away from the seat surface.

Referring to FIGS. 1 and 11, each of the side members 80 and 82 have a plurality of lateral apertures therethrough. The apertures closest to the seat frame upper cross members are apertures 116 and 118 to which upper siderails 110 are typically connected. The chair seat frame 42 typically also has three other pairs of coaxial apertures 210 and 212, 214 and 216, and 218 and 220 through seat frame side members 80 and 82, respectively (FIG. 1). The preferred backrest frame 40 also has two other pairs of coaxial apertures 222 and 224, and 226 and 228 through backrest frame side members 46 and 48, respectively, with all of the these apertures which allow positioning of the chair in various operational positions.

The chair is shown in FIG. 11 in the cot position such as for sleeping, wherein the end of each of upper siderails 110 are moved from apertures 116 and 118, respectively, to apertures 210 and 212. In such a position seat 174 is typically substantially taut so as to function as a generally horizontal sleeping surface. The tautness thereof can be adjusted by providing a lengthened or shortened seat 174. The chair may be pinned in the cot position by providing suitable apertures (not shown) in backrest frame side members 46 and 48 and in seat frame side members 80 and 82. When the chair is used as a cot, footrest frame 44 may be deployed and tilted appropriately to support the user's legs as shown so as to form a full length cot or it may be stowed within the backrest frame 40 so as to form a three-quarter length cot. In the cot position, footrest frame 44 is typically at the lower of the two elevational heights so as to be at substantially the same vertical height as is seat 174 for comfort reasons. Adjustable legs 236 (FIG. 13) or fixed length legs 104 (FIG. 11) may be deployed when in the full cot position for added stability though such deployment is not necessary.

Referring to FIGS. 10 and 12, therein is shown the means by which footrest frame 44 is angled up or down so as to change the vertical height of footrest frame 44 and foot support 94. In the raised position of footrest frame 44, backrest frame lower cross member 54 is secured by bolts 60 in apertures 65 and 66 while backrest lower cross member 56 is secured by bolts 60 in apertures 67 and 69 of backrest side members 46 and 48, respectively, such that footrest lower cross member 93 contacts backrest frame lower cross member 54 and the lower pair of pads 106 on footrest frame side members 90 and 91 contact backrest cross member 56 to distribute the load therebetween and hold footrest frame 44 in an upper vertical position (FIG. 10). In the lower position of footrest frame 44, backrest frame lower cross member 54 is secured by bolts 60 in apertures 63 and 64 while backrest lower cross member 56 is secured by bolts 60 in apertures 69 and 70 such that footrest lower cross member 93 contacts backrest frame lower cross member 54 and the upper pair of pads 106 on footrest frame side members 90 and 91 contact backrest cross member 56 to distribute the load therebetween to hold footrest frame 44 in a lower vertical position (FIG. 12). Such change in the position of backrest frame cross member 56 is easily made by removing wingnuts 62, removing bolts 60, and reattaching cross member 56. The length of footrest frame 44 may also be changed by moving axles 148 from apertures 144 and 146 of footrest side members 90 and 91, respectively, to either apertures 229 and 230 or apertures 231 and 232 so as to accommodate shorter people and children.

In all of the positions shown the chair has an oscillating or rocking function. In some instances, it might be desired to restrain the rocking. In such cases spring ball bearing pins 156 (FIG. 1) may be inserted into pairs of apertures in backrest frame side members 46 and 48 and seat frame side members 80 and 82. FIG. 13 illustrates the chair as restrained in a semi-reclining position wherein pins 156 are disposed in the pair of apertures 214 and 226, and the pair of apertures 216 and 228 of seat frame 42 and backrest frame 40, respectively. In FIG. 14 is illustrated a full reclining position wherein spring ball bearing pins 156 are disposed in the pair of apertures 218 and 222, and the pair of apertures 220 and 224 of seat frame 42 and backrest frame 40, respectively. Likewise, the cot position of FIG. 11 may be restrained from rocking by adding additional apertures (not shown) positioned appropriately in side members 46, 48, 80, and 82 and pinning using spring ball bearing pins 156. Foot support 94 may be used as a small table to hold a food plate or other articles thereon, particularly useful when the chair is pinned in an upright position such as in FIG. 13.

Footrest frame 44 is relatively rigid in its unfolded or deployed state as supported on pads 106 by cross member 56 (FIGS. 10 and 12). There may, however, be cases wherein greater footrest rigidity is desired. In such cases, the use of fixed length legs 104 (FIGS. 1 and 11) can be used to add such rigidity. However, such legs 104 only work if they are of such a length that which corresponds with the particular chair position desired. However, FIGS. 13 and 14 illustrate how the length of legs required can vary drastically between the various chair positions. In such cases, adjustable length legs may be used to remedy the situation.

Referring to FIG. 15, an adjustable length leg 236 comprises an outer member 237 with an upper aperture 238, which outer member 237 is typically pivotally and removably attached to footrest frame outer members 90 and 91 such as by a bolt 106 and wingnut 62 as fixed length legs 104 (FIGS. 1 and 11). A cylindrical aperture 239 extends for at least a portion of the length of outer member 237 with an internally threaded insert 240 pressfit therein. An inner leg 241 having an externally threaded rod 242 and a ground contacting floor pad 244, is threaded into insert 240 in outer member 237. The effective length of leg 236 can be adjusted by threading rod 242 further into or out of outer member 237.

Alternately, an adjustable length leg 250 as illustrated in FIG. 16 may be used. Leg 250 has an outer member 252 with an upper aperture 254, which outer member 252 is typically mounted to footrest frame 44 in the same manner as outer member 232. An aperture 256 extends for at least a portion of the length of outer member 252. An inner leg 258 having a rod 260 of such size as to closely pass through aperture 256 and a ground contacting floor pad 262, is slidably disposed within aperture 256. A plurality of crosswise apertures 264 extend through rod 260 each of which are selectively positionable in alignment with coaxial apertures 266 and 268 in the lower part of outer member 252. A pin such as ring handle, spring ball bearing pin 270 is inserted therethrough so as to change the effective length of leg 250.

When the chair is equipped with wheels (FIGS. 1 and 2) there are several special uses for the chair. For example, in FIG. 17 the chair configured as a wheel chair such as for providing ease of moving the chair. Legs 70 and 72 of backrest frame side members 46 and 48 contact the ground as the chair is tipped forward to help prevent the chair from rolling backwards when the chair is tipped forward such as when entering or exiting the chair. The chair equipped with wheels can be used for moving a person injured such as while backpacking, an elderly person, or overly exhausted person in need of assistance moving about. In this configuration the chair also functions as a wheeled hauler to transport gear placed on seat 174. This is the same chair position as in FIG. 13 wherein the chair is restrained by pinning a non-rocking, semi-reclining position except for the stowed footrest and the addition of pneumatic rubber wheels. Typically wide pneumatic rubber tires are used so as to enable easier transport through soft surfaces such as sand without getting bogged-down therein. When backpacking the wheels are typically removed and the axles reversed so as not to protrude from the frame (FIG. 6). The tires may be tied to a chair frame and the pins 156 packed such that the wheel chair is available should the need arise while backpacking.

The chair with wheels can also function as a hand truck or cart such as for hauling camping equipment from an automobile to the camp site which cart is illustrated in FIG. 18. In such a position, backrest frame 40 and seat rest frame 42 are in the folded position with footrest frame 44 in the deployed position and legs 104 are in the stowed position. A pair of elongate flexible bands 280, typically having VELCRO hook and loop pads (not shown) attached to the respective ends thereof, are wrapped around footrest frame 44. Bands 280 can be positioned where needed on footrest frame 44 to help support the load carried on the footrest frame 44. A pair of end support legs 282 may be pivotally attached to footrest frame side members 90 and 91 opposite wheels 150 so as to maintain footrest frame 44 off the ground so as to help prevent unsightly scuffing thereof which may be especially visible in other chair positions. Each of end support legs 282 has a center aperture 284 and is pivotally mounted to the respective footrest frame side members 90 and 91 such as by bolts 286 disposed in apertures 288 and 290 of footrest side members 90 and 91, respectively. Each of end support legs 282 may be placed in a deployed, ground-contacting position (dotted lines) or in a stowed position (solid lines) by means of wingnuts 292. A pair of safety pins (not shown) such as the type pins 156 (FIG. 2) may be inserted one in each of apertures 274 and 276 through footrest frame side members 90 and 91 after footrest 44 is deployed so as to prevent backrest frame 40 and seat frame 42 from falling from the vertical position and injuring someone. The safety pins bear against backrest frame side members 46 and 48 and possibly also against lower siderails 112 to prevent such falling. The cart is used by loosening wingnuts 292, pivoting end support legs 282 into the vertical operational position, and tightening wingnuts 292. After adjusting bands 280 to support a load, the load such as camping gear is placed on footrest frame 44. Soft gear such as blankets and towels or hard gear such as tent posts can be carried within the loop 278 formed by seat 174 while in the cart position or while in any of the non-chair positions including the completely folded position with wheels and in the backpack position without wheels. The cart is then tilted backwards off of legs 70 and 72 of backrest frame side members 46 and 48 by holding the cart with one of the user's feet and pivoted by pulling on backrest frame 40 such that the load is supported on wheels 150 and wheeled to its destination. Once the load has been transported to its destination, the reverse procedure is used to unload the cart. As the cart is tipped forward to unload, legs 70 and 72 again contact the ground and lift the wheels 150 off of the ground so as to stop rolling of the cart. This function serves as a safety feature to prevent unwanted rolling of the cart during loading and unloading of the cart.

The angle between the backrest frame 40 and footrest frame 44 can be set at two positions if such feature is included in the chair function. FIG. 18 illustrates a first angular position for footrest frame 44 corresponding to FIG. 10. FIG. 19 illustrates a second angular position for footrest frame 44 corresponding to FIG. 12, showing the angle between backrest frame 40 and footrest frame 44 increased by moving footrest cross member 56 to the lower position. This alternate angular position may be more comfortable for a shorter person to transport a load using the cart.

There are several alternate versions of some chair components from those previously described, the first of which is the seat. The seat as illustrated in FIGS. 1 and 8 wraps around backrest frame cross members 50 and 52, and likewise around seat frame cross members 84 and 86, all of which cross members are attached such as by screws 58. Thus, if it is desired to remove seat 174 such as for laundering, the aforementioned cross members, or at least cross members 52 and 86 must be unscrewed from their respective backrest and seat frames 40 and 42 to remove them from seat 174 which process is time consuming. Alternatively, those same cross members may be attached by bolts and wingnuts (not shown) which would expedite the process.

As another alternative, a second version seat 310 is illustrated in FIGS. 20, 21, and 22. Seat 310 is rectangular, longitudinally extending cloth seat similar to seat 174 (FIG. 8), with a head end 312, a foot end 314, and similar canvas top and bottom layers 316 and 318 surrounding an enclosed padded core 320. Head end 312 is held in place by a folded over, add-on cuffed portion 322 which is wider than the portion of seat 310 between head and foot ends 312 and 314, and which is riveted or sewn such as at seam 323. Cuffed portion 322 which does not contain any portion of padded core 320, has riveted or sewn seams 324 and 326 so as to form a backrest frame receiving pocket 328 into which backrest frame upper cross members 50 and 52 removably fit along with the upper portions of backrest frame side members 46 and 48 each of which protrude through an aperture 330 and 332, respectively. Foot end 314 has a folded over, add-on cuffed portion 334 which is likewise wider than the portion of seat 310 between head and foot ends 312 and 314 and which is riveted or sewn such as at seam 336. Cuffed portion 334, part of which contains a portion of padded core 320, has riveted or sewn seams 338 and 340 so as to form a seat frame receiving pocket 342 into which seat frame upper cross members 84 and 86 removably fit along with the upper portions of backrest frame side members 80 and 82. For added user comfort, the cuffed seat (not shown) could be made wherein the a cuffed end of the seat fits over only the upper ends of the seat frame side members 80 and 82 and wherein seat cross members 84 and 86 are moved from the end of seat frame 42 and/or removed therefrom such that the seat conforms to and cradles a user's legs rather than being held substantially flat by cross members 84 and 86.

A third version extra-long seat 344 is shown in FIG. 14 which converts the chair to a full-length chaise lounge. Seat 344 extends from backrest upper cross members 50 and 52 to foot support 94 and pad 95. Seat 344 is a rectangular, longitudinally extending cloth seat similar to seat 174 (FIG. 8), with a head end 345, a foot end 346, and similar canvas top and bottom layers 347 and 348 surrounding an enclosed padded core (not shown). Seat 344 is typically removably attached to the chair such by VELCRO hook pads 349, 350, and 351 affixed such as by riveting or sewing to head and foot ends 345 and 346, respectively, and VELCRO loop pads 352, 353, and 354 affixed such as by adhesives to backrest upper cross members 50 and 52, and to foot support pad 95, respectively. Alternatively, foot support pad 95 may be omitted and loop pad 354 attached directly to foot support 94. Seat 344 drapes over but is typically not attached to seat frame upper cross members 84 and 86. While this particular version of the seat is removable, the other three versions of the seat may be made longer and the foot end adapted to mate with the foot support member so as to form a chaise lounge.

A fourth version seat 360 is shown in FIGS. 23 and 24. Seat 360 differs from seats 174 and 310 as it does not comprise canvas or other cloth with a foam core, but rather comprises a plurality of spaced apart, laterally extending substantially rigid slats 362 each typically made of wood with a substantially rectangular cross section. Each of slats 362 typically has a pair of laterally extending apertures 364 and 366 therethrough, one adjacent each respective end thereof, and through each of which extends an elongate flexible member, typically nylon ropes 368 and 370, respectively, having a plurality of knots 372 and 374, respectively, which maintain slats 362 in the spaced relationship. First ends 376 and 378 of ropes 368 and 370, respectively, are attached to one or both of backrest frame upper cross members 50 and 52 such as by tying thereto. Second ends 380 and 382 of ropes 368 and 370, respectively, are attached to one or both of seat frame upper cross members 84 and 86 such as by tying thereto. Other types of elongate flexible members may also be used such as ropes made from other materials, cables, or even chains with spacing of the slats maintained by a plurality of tubular or other type of spacers (not shown) in place of knots 372 and 374. Also, a single rope, cable, or chain may be used in place of ropes 368 and 370, such that the free ends thereof are attached to an upper cross member with a loop thereof attached to the upper cross member at the opposite end of seat 360.

An alternate version wheel 390 is shown in FIG. 23 which is primarily used for decorative purposes such as around a pool to match the appearance of slat seat 360, especially when wooden natural finish or unfinished slats are used. Wheel 390 is capable of the same functions as rubber wheel 150 and is typically made from a plurality of boards 392 and 394 which are naturally finished or unfinished for maximum decorative appeal, though a solid wood or plywood disc could also be used. Wheel 390 has bushings or ball bearings (not shown) in the center thereof and mounts to axle 148 in the same manner as wheel 150 (FIGS. 1 and 5). An optional rubber tread (not shown) can be secured to the outer periphery of wheel 390 to cushion the ride thereof against the ground.

An alternate version of footrest frame 44 is illustrated in FIGS. 25, 26, and 27, which typically directly interchanges with footrest frame 44. Footrest frame 410 comprises a pair of longitudinal members 412 and 413, a pair of cross members 56 and 414, and a pair of end members 416 and 417 attached together such as by screws 58. End members 416 and 417 have axle apertures 418 and 419, respectively, through which bushing 147 and axle 148 extend so as to attach footrest frame 410 to the chair as is footrest frame 44. Alternatively, bushings 147 and axles 148 may extend through apertures 420 and 421 or apertures 422 and 423 or apertures 429 and 431 to shorten footrest frame 410 for shorter people and children. The box structure formed by cross members 56 and 414, and end members 416 and 418, together with the spaced relationship of longitudinal members 412 forms the reasonably rigid structure of frame 410.

A pivotable foot support 424 having pad 95 affixed to the top thereof and a pair of brackets 425 attached to the bottom thereof using screws 426 is pivotally mounted to footrest frame 410 by means of bolt 427 inserted through a pair of apertures 428 in brackets 422, a pair of apertures 430 and 432 in longitudinal members 412 and 413, respectively, and through an aperture 434 in a block 435 sandwiched between longitudinal members 412 and 413 and secured thereto by means of wingnut 62. A bolt 436 extends through apertures 438 and 439 in longitudinal members 412 and 413, and aperture 448 in block 440, and is secured by nut 130. A fixed or adjustable height leg such as adjustable height leg 236 can be attached to footrest frame 410 by means of bolt 442 inserted into apertures 444 and 446 of longitudinal members 412 and aperture 234 of adjustable leg 236 and secured by wingnut 62 (FIGS. 11, 15, and 16). The use of block 435 allows longitudinal members 412 and 413 to be firmly held together by fully tightened bolt 436 and nut 130 while bolts 426 and 442, both with wingnuts 62, can be loosened then tightened to hold adjustable leg 236 and foot support 420, respectively, in the desired position. Foot support 424 is typically used in the solid line position, and is stowed in the dotted line position (FIG. 25). When footrest frame 410 is in the stowed position pins 156 (FIG. 1) are inserted through apertures 448 and 449 of end members 416 and 417, respectively, to secure footrest frame 410 in the stowed position.

The angle of footrest frame 410 can be changed in the same manner as footrest frame 44 by moving backrest lower cross member 56 so as to restrict the downward movement of footrest frame end members 416 and 418. A pair of elongate pads 450 shown in FIGS. 25 and 26 are mounted to each of longitudinal members 412 and 413 using screws 107 which can be used with either of footrest frames 44 and 410 in place of pads 106 (FIGS. 10 and 12).

The chair can be equipped for backpacking as shown in FIGS. 28 and 29. The chair is shown in the folded position with each of pins 156 engaging backrest frame 40, seat frame 42, lower siderails 112, and footrest frame 44. A pair of shoulder straps 470 each have a strap 471 with an upper end 472 and a lower end 474 with upper end 472 having removable holding means such as a VELCRO loop pad 476 and a VELCRO hook pad 478 sewn thereto. Upper end 472 can thus be looped over seat frame upper cross member 84 or 86 and pads 476 and 478 engaged to removably hold straps 470 thereto. Lower end 474 has a loop 480 which is of such size to allow backrest frame lower cross member 54 to be passed therethrough, which loop is held by rivets or sewn seams 482. Shoulder straps 470 can be assembled to and removed from lower cross member 54 by removing wingnuts 62 and removing lower cross member 54. Each of shoulder straps 470 also have a pad 484 which may be tubular in cross section and movable along strap 471 so as to accommodate various size persons, or it may be fixed as by sewing or riveting thereto. A belt 486 may be used along with shoulder straps 470 to aid in stabilizing the chair. Belt 486 comprises first and second belts 488 and 490 adjustably held together by a standard type belt buckle 492. Each of first and second belts 488 and 490 have a free end 494 and 496, respectively, each of which have an end aperture 498 and 500, respectively. Belt 486 is removably attached to the chair by free ends 494 and 496 being sandwiched between backrest frame lower cross member 54 and backrest frame side members 46 and 48, respectively, with bolts 60 passing through the respective apertures 498 and 500. When backpacking foot support 94 or 420 with attached pad 95 can pivotally adjust to the angle of the user's back and shoulders so as to cushion and provide greater comfort to the user along with additional support.

A canvas or nylon pack 502, particularly useful for back-packing and camping may be permanently or removably attached to the chair. The design of the pack is not critical and custom designed packs or standard store-bought packs can be adapted for use thereon. A typical pack 502 has an upper flap 504, a pouch 506, and lower pocket 508, an umbrella loop 510, and is removably attached to seat 174 as by a VELCRO loop pad 512 riveted or sewn laterally across seat 174 and a VELCRO hook pad 514 riveted or sewn to upper flap 504 (FIGS. 8, 21, and 22). Pouch 506 has a hinged top 516 connected to a pouch body 518 by means of a zipper 520 half of which is sewn to each of top 516 and body 518 around about three quarters of the perimeter thereof. Pouch top 516 is hingedly attached to pouch body 518 such as at hinge portion 522 of pouch 506. A smaller pouch or pocket 524 may be attached to pouch 506 to hold small items. Lower pocket 508 can be used for larger items to which quick access is desired but which are too large to fit within pocket 524. An umbrella (not shown) can be inserted and snugly held in umbrella loop 510. Likewise cart bands 280 may be stored in one of the pouches or pockets. Other designs of permanently attached and removable packs may include pockets for other commonly used camping and backpacking items such as magazines, compact disc player, mist bottles, etc.

A second embodiment of the chair specially designed for backpacking with frames that telescope and partially collapse is illustrated in FIGS. 30, 31, 32, and 33. The overall structure of comprises a backrest frame 540, a seat frame 542, a footrest frame 544, upper siderails 704, and lower siderails 706. All of the frames and siderails are typically made from aluminum for light weight, though other metals such as stainless steel, plastics, or composites may likewise be used in their construction.

Backrest frame 540 comprises a pair of elongate telescoping side members 546 and 548. Backrest frame side member 546 comprises a center tube 550, an upper side bar 552, a lower sidebar 554, and a pair of externally threaded spring-loaded plungers 556. Upper sidebar 552 and lower sidebar 554 have threaded apertures 558 and 560, respectively, into each of which is threaded a spring-loaded plunger 556 with the ball thereof 562 extending slightly from the respective aperture (FIGS. 31 and 32). Upper sidebar 552 and lower sidebar 554 are sized such that each closely fits within center tube 550 at opposite ends thereof. Center tube 550 has a pair of apertures 564 and 566 through a wall thereof for ball 562 of spring-loaded plunger 556 in upper sidebar 552 to catch and another pair of apertures 568 and 570 through a wall thereof for ball 562 of spring-loaded plunger 556 in lower sidebar 554 to catch. The distance between apertures 564 and 588 and between apertures 568 and 570 is typically about six inches so as to still accommodate the other features of the chair which results in a total twelve inch reduction in length of telescoping side member 546 from an extended position to a retracted position.

Backrest frame side member 548 similarly comprises a center tube 572, an upper sidebar 574, a lower sidebar 576, and another pair of externally threaded spring-loaded plungers 556. Upper sidebar 574 and lower sidebar 576 have threaded apertures 578 and 580, respectively, into each of which is threaded a spring-loaded plunger 556 with the ball thereof 562 extending slightly from the respective aperture (FIGS. 31 and 32). Upper sidebar 574 and lower sidebar 576 are sized such that each closely fits within center tube 572 at opposite ends thereof. Center tube 572 has a pair of apertures 582 and 584 through a wall thereof for ball 562 of spring-loaded plunger 556 in upper sidebar 574 to catch and another pair of apertures 586 and 588 through a wall thereof for ball 562 of spring-loaded plunger 556 in lower sidebar 576 to catch. The distance between apertures 582 and 584 and between apertures 586 and 588 is likewise typically about six inches which results in a total twelve inch reduction in length of telescoping side member 548 from an extended position to a retracted position.

Backrest frame 540 further comprises a pair of upper cross members 590 and 592 and a pair of lower cross members 594 and 596. All of the cross members are typically tubing and attached to telescoping side members 546 and 548 such as by bolts 600 and nuts 602, except for cross members 594 and 596 which are removably attached such as by bolts 604 and wingnuts 606. The lower portion of each of side members 546 and 548 form front legs 608 and 610, respectively.

Seat frame 540 comprises a pair of elongate telescoping side members 612 and 614. Seat frame side member 612 comprises a center tube 616, an upper sidebar 618, and an externally threaded spring-loaded plunger 556. Upper sidebar 618 has a threaded aperture 620 into which is threaded a spring-loaded plunger 556 with the ball thereof 562 extending slightly from therefrom (FIGS. 31 and 32). Upper sidebar 618 is sized such as to closely fit within center tube 616 at an end thereof. Center tube 616 has a pair of apertures 622 and 624 through a wall thereof for ball 562 of spring-loaded plunger 556 in upper sidebar 618 to catch. The distance between apertures 622 and 624 is typically about six inches and results in a six inch reduction in length of side member 612 from an extended position to a retracted position.

Seat frame side member 548 comprises a center tube 626, an upper sidebar 628, and an externally threaded spring-loaded plunger 556. Upper sidebar 628 has a threaded aperture 630 into which is threaded a spring-loaded plunger 556 with the ball thereof 562 extending slightly from therefrom (FIGS. 31 and 32). Upper sidebar 628 is sized such as to closely fit within center tube 626 at an end thereof. Center tube 626 has a pair of apertures 632 and 634 through a wall thereof for ball 562 of spring-loaded plunger 556 in upper sidebar 628 to catch. The distance between apertures 632 and 634 is typically about six inches and results in a six inch reduction in length of telescoping side member 614 from an extended position to a retracted position.

Seat rest frame 542 further comprises a pair of upper cross members 636 and 638 and a lower cross members 640. All of the cross members are typically tubing, and all are attached to telescoping side members 612 and 614 such as by bolts 600 and nuts 602. The lower portion of each of side members 612 and 614 form front legs 642 and 644, respectively.

Footrest frame 544 comprises a pair of elongate telescoping side members 646 and 648. Side member 646 comprises a center tube 650, a lower sidebar 652, and an externally threaded spring-loaded plunger 556. Lower sidebar 652 has a threaded aperture 654 into which is threaded a spring-loaded plunger 556 with the ball thereof 562 extending slightly from therefrom. Lower sidebar 652 is sized such as to closely fit within center tube 650 at an end thereof. Center tube 650 has a pair of apertures 656 and 658 through a wall thereof for ball 562 of spring-loaded plunger 556 in lower sidebar 652 to catch. The distance between apertures 656 and 658 is typically about six inches and results in a six inch reduction in length of side member 646 from an extended position to a retracted position.

Footrest frame side member 648 comprises a center tube 660, a lower sidebar 662, and an externally threaded spring-loaded plunger 556. Lower sidebar 662 has a threaded aperture 664 into which is threaded a spring-loaded plunger 556 with the ball thereof 562 extending slightly from therefrom (FIGS. 31 and 32). Lower sidebar 662 is sized such as to closely fit within center tube 660 at an end thereof. Center tube 660 has a pair of apertures 666 and 668 through a wall thereof for ball 562 of spring-loaded plunger 556 in lower sidebar 662 to catch. The distance between apertures 666 and 668 is typically about six inches and results in a six inch reduction in length of side member 648 from an extended position to a retracted position.

Footrest frame 544 further comprises a pair of lower cross members 670 typically of square tubular construction, inside the ends of each of which is attached such as by brazing, welding, or pressfitting an internally threaded square plug 672. Lower cross members 670 are attached to telescoping side members 646 and 648 such as by bolts 600 disposed in recessed apertures 673 and 674 in lower sidebars 652 and 662, respectively. A foot support 675, typically an aluminum plate, is pivotally attached to footrest frame center tubes 650 and 660 as by bolts 600, one each disposed in each group of recessed aperture 676, aperture 677, aperture 678, and recessed aperture 679, aperture 680, aperture 681 with washers 96 therebetween. Foot support 675 is held in a stowed position while not in use by first or second pairs of spring-loaded plungers 556 one fitted into each of plunger apertures 684, 686, 688, and 690 of foot support 675 with the ball 562 of each extending therefrom. A pair of matching apertures 692 and 694 in center tubes 650 and 660, respectively, adapted to selectively engage one or the other pairs of balls 562 of spring-loaded plungers 556 to maintain foot support 675 in a stowed position.

There are two pairs of apertures, recessed aperture 696 and aperture 698, and recessed aperture 700 and aperture 702, through the walls of center tubes 650 and 660, respectively. A pair of elongate footrest legs 104 each having an upper aperture 105 are pivotally attached to footrest center tubes 650 and 660 by means of bolts 600 extending through the respective apertures 696 and 698, or 700 and 702, being removably secured by wingnuts 62. A rubber or plastic pad 450 or a pair of pads 106 are attached to each of footrest lower bars 652 and 662 using bolts 703 so as to cushion the contact between the same with backrest lower cross member 596.

Backrest frame 540 and seat frame 542 are connected together to form a basic rocking chair by a pair of telescoping upper and lower siderails 704 and 706, respectively. Each of upper siderails 704 comprise a center tube 708, an upper sidebar 710, and an externally threaded spring-loaded plunger 556. Upper sidebar 710 has a threaded aperture 712 into which is threaded a spring-loaded plunger 556 with the ball thereof 562 extending slightly from therefrom (FIGS. 31 and 32). Upper sidebar 710 is sized such as to closely fit within center tube 708 at an end thereof. Center tube 708 has a pair of apertures 714 and 716 through a wall thereof for ball 562 of spring-loaded plunger 556 in upper sidebar 710 to catch. The distance between apertures 714 and 716 is typically about six inches to accommodate the other features of the chair. This results in a six inch reduction in length of telescoping upper siderail 704 from an extended position to a retracted position.

Each of upper siderail upper sidebars 710 have an aperture 718 which aligns with an aperture 720 and 722 in seat frame upper sidebars 618 and 628, respectively, with a washer 724 therebetween, and through which a bolt 726 is disposed and removably held in place by a wingnut 62. Each of upper siderails 704 also have a recessed aperture 728 and an aperture 730 which align with a recessed aperture 732 and aperture 734 or recessed aperture 736 and aperture 738 in backrest frame center tubes 550 and 572, respectively, with an end of a retaining strap 127 therebetween, and through which a bolt 740 is disposed and held in place by a nut 130.

Each of lower siderails 706 comprise a center tube 742, a lower sidebar 744, and an externally threaded spring-loaded plunger 556. Lower sidebar 744 has a threaded aperture 746 into which is threaded a spring-loaded plunger 556 with the ball thereof 562 extending slightly from therefrom (FIGS. 31 and 32). Lower sidebar 744 is sized such as to closely fit within center tube 742 at an end thereof. Center tube 742 has a pair of apertures 748 and 750 through a wall thereof for ball 562 of spring-loaded plunger 556 in lower sidebar 744 to catch. The distance between apertures 748 and 750 is typically about six inches and results in a six inch reduction in length of telescoping lower siderail 706 from an extended position to a retracted position.

Each of telescoping lower siderails 706 lower sidebars 744 have an axle aperture 752 which aligns with an axle aperture 754 or 756 in backrest frame lower sidebars 554 and 576, respectively, and with axle apertures 758 and 759 in footrest frame lower sidebars 652 and 662, respectively, and with washers 724 therebetween, and through which bushing 147 and threaded axle 148 are disposed with washers 152 and retained thereon by wingnuts 154. Alternatively, apertures 760 and 761 or apertures 762 and 763 may be used so as to shorten footrest frame 544 such as for short people and children. Also, each of footrest frame lower sidebars 652 and 662 have an aperture 764 and 765 therethrough, respectively. A pair of safety pins (not shown) such as the type pins 156 (FIG. 2) may be inserted one in each of apertures 764 and 765 through footrest frame lower sidebars 652 and 662 after footrest 544 is deployed so as to prevent backrest frame 540 and seat frame 542 from falling from the vertical position and injuring someone when the chair is used as a cart. The safety pins bear against backrest frame lower sidebars 554 and 576 and possibly also against each of lower siderails lower sidebars 744 to prevent such falling. Each of lower siderails 706 also have a recessed aperture 766 and an aperture 767 which align with a apertures 766 and 768 or apertures 770 and 772 in seat frame center tubes 616 and 626, respectively, with an end of a retaining strap 127 therebetween, and through which a bolt 740 is disposed and held in place by a nut 130.

The distance between apertures 718 and 728 of telescoping upper siderails 704 and between apertures 752 and 762 or 764 of telescoping lower siderails 706 are the same in the extended and the contracted positions such that the chair can fold and collapse to the position shown in FIG. 33. A pair of ring handled, spring ball bearing pins 156 are inserted through the respective apertures 774 and 776 or 778 and 780 of seat frame center tube 616 and 626, apertures 782 and 784 of lower siderail center tube 742, apertures 786 and 788 or 790 and 792 of backrest frame center tubes 550 and 572, and apertures 794 and 796 of footrest frame lower sidebars 652 and 662 so as to retain the chair in the closed or stowed position. By removing pins 156 and extending the telescoping sections the chair can be unfolded.

The same rectangular, longitudinally flexible seat 174 (FIG. 8) or the other versions thereof may be attached to the chair with the head end being held in place by a portion thereof is partially wrapped around backrest frame upper cross member 590, completely around cross member 592, and held such as by a sewn or riveted seam. The foot end is held in place by a portion thereof is partially wrapped around seat frame upper cross member 636 and completely around cross member 638, and held such as by a sewn or riveted seam.

Referring to FIGS. 1, 11, and 30, the second embodiment chair with the telescoping frame can achieve the same functional positions of the first embodiment chair previously explained, however, the frames typically are in the extended position to do so. The various functional positions are accomplished in the same manner as the first embodiment of the invention by changing the attachment locations of telescoping upper siderails 704 and 706, and/or by pinning the chair so as to restrain the chair from rocking. A plurality of apertures in second embodiment seat frame side members 612 and 614 correspond with apertures in the first embodiment seat frame 42 side members 80 and 82, with apertures 720 and 722 corresponding to apertures 116 and 118, apertures 796 and 798 to apertures 210 and 212, apertures 800 and 802 to apertures 214 and 216, and apertures 804 and 806 to apertures 218 and 220. Likewise, there are a plurality of apertures in second embodiment backrest side members 546 and 548 which correspond with apertures in first embodiment side members 46 and 48, with apertures 808, 810, and 812 to aperture 222, apertures 814, 816, and 818 to aperture 224, and apertures 820 and 822 to apertures 226 and 228.

A third embodiment folding rocking chair and chaise lounge is shown in FIGS. 34–49 comprising a backrest frame 825, a seat frame 828, and a footrest frame 831.

Backrest frame 825 is of U-shape comprising a U-shaped member 832 having a pair of elongate side portions 834 and 837 interconnected by a bottom portion 840, and an upper cross member 843. Member 843 of backrest frame 825 is typically made from hardwood, and is attached to respective side portions 834 and 837 such as by screws 846.

Seat frame 828 is of U-shape comprising a pair of elongate side portions 849 and 852 interconnected by a bottom portion 855, and an upper cross member 858. Member 858 of seat frame 828 is typically made from hardwood, and is attached to respective side portions 849 and 852 such as by screws 846.

Footrest frame 831 is of U-shape comprising a pair of elongate side portions 861 and 864 interconnected by a bottom portion 867, and a pivotal foot support 870. Foot support 870 of footrest frame 831 is typically made from hardwood, and is attached to respective side portions 861 and 864 such as by screws 846 and washers 873. An end cap 876 and a spring clip 879 having a tapered head 882 to provide a more finished appearance to side portions 861 and 864 (FIG. 46).

Foot support 870 can be held in a stowed position parallel to side portions 861 and 864 while not in use by a pair of conventional spring-loaded plungers (not shown) one each fitted into a pair of apertures (not shown) of footrest side portions 861 and 864, respectively, which selectively mate with one or the other pair of matching detentes (not shown) in foot support 870 in a similar manner to the first embodiment chair.

Backrest frame 825 and seat frame 828 are connected together so as to form the basic rocking chair by means of a pair of adjustable length, curved upper siderails 885, and a pair of lower siderails 888. Upper and lower siderails 885 and 888 are substantially rigid members. Upper siderails 885 each comprise a curved front tube 891, a straight rear tube 894, an end tube assembly 897, and a tubular cushion 900. Front tube 891 includes a front portion 903 having a single aperture 906 therethrough, and a rear portion 909 having a plurality of apertures 912, 915, and 918 therethrough. Rear tube 894 includes a front portion 921 which pilots into rear portion 909 of front tube 891 and a rear portion 924, an aperture 927 extending through front portion 921 which engages a spring clip 930 having a tapered head 933 to provide adjustability as subsequently described. End tube assembly 897 comprises a tube 936 which fits over rear portion 924 with an aperture 939 therethrough, and an end cap 942 which pressfits thereinto. Tubular cushion 900 closely fits over front tube 891 and includes a plurality of apertures 945, 948, and 951 therethrough which correspond with apertures 912, 915, and 918 of front tube 891 to provide finger access to depress tapered head 933 of spring clip 930. Tubular cushion 900 is made of urethane, sponge rubber, foam, or other such material so as to provide arm cushioning to upper siderails 885. Upper siderails 885 pivotally connect to the respective side portions 834 and 837 of backrest frame 825 and side portions 849 and 852 of seat frame 828 using respective bolts 954 each having an internally threaded end 957, nylon washers 960, and screws 963 which thread into threaded ends 957.

Each of lower siderails 888 include a front portion 966 and a rear portion 969 with respective apertures 972 and 975 extending therethrough, and a pair of end caps 978 pressfit thereinto. Rear portions 969 of lower siderails 885 pivotally connect to the respective side portions 849 and 852 of seat frame 828 using respective bolts 954, nylon washers 960, and screws 963. Front portions 969 of lower siderails 885 pivotally connect to the respective side portions 834 and 837 of backrest frame 825, along with respective side portions 861 and 864 of footrest frame 831 using respective bolts 981, nylon washers 984, and wingnuts 987. Bolts 981 are of sufficient length to allow the mounting of respective wheels (not shown) for wheeled transport as in the other embodiments previously described. Adjustable length, curved upper siderails 885 operate by depressing button 882 of spring clip 879 such that the desired aperture 945, 948, or 951 of front tube 891 can be utilized.

The placement of the pivotal connections of upper and lower siderails 885 and 888 to the respective side portions 834 and 837 of backrest frame 825 and side portions 849 and 852 of seat frame 828 must be designed such that the chair folds properly and opens to the desired positions as previously described for the other embodiments of the chair. The chair can be retained in the folded position by a pair of pins (not shown) inserted through appropriately placed apertures (not shown) as also previously described.

Footrest frame 831 is retained in the desired elevational position relative to seat frame 828 by means of respective variable incline ratchet assemblies 990 each comprising an elongate ratchet plate 993 having respective front and rear portions 996 and 999, a longitudinally extending main slot 1002, a plurality of offset angled locking slots 1005, 1008, and 1011, and an aperture 1017. Variable incline ratchet assemblies 990 further comprise a U-shaped release plate 1020 having a central portion 1023 with an aperture 1026 therethrough and respective dependent legs 1029 and 1032. Front portions 996 of ratchet plates 993 are pivotally connected to side portions 861 and 864 of footrest frame 831 using respective bolts 1035 each having an internally threaded end 1038, nylon washers 1041, and screws 1044 which thread into threaded ends 1038. Rear portions 999 of ratchet plates 993 and release plate 1020 are pivotally connected to side portions 834 and 837 of backrest frame 825 using respective bolts 1047 each having an internally threaded end 1050, nylon washers 1053, and screws 1056 which thread into threaded ends 1050.

Referring to FIGS. 39 and 40, variable incline ratchet assemblies 990 operate by applying finger pressure to upper leg 1029 of release plate 1020 to cause pivoting thereof about bolt 1026 to cause lower leg 1032 to contact and elevate ratchet plate 993 releasing bolt 1026 from slot 1005 for movement along main slot 1002 to one of slots 1008 and 1011.

A rectangular, longitudinally flexible seat 1059 of similar construction to seat 174 includes a head end 1062, a foot end 1065, and typically has a canvas top layer 1068 and a canvas bottom layer 1071 which surround a padded core 1074 such as sheet foam, which extends for most of the length thereof. Head end 1062 is retained in place by a portion thereof 1077, which contains no padded core 1074, which is completely wrapped around upper cross member 843 of backrest frame 825 and retained such as by a riveted or sewn seam 1080. Foot end 1065 is retained in place by a portion 1083 thereof which contains padded core 1074, which is completely wrapped around upper cross member 858 of seat frame 828 and retained such as by a riveted or sewn seam 1084, with padded core 1074 acting to cushion a user's legs. Seat 1059 can also include an attached pillow 1085 sewn to portion 1077 of head end 1062. The seat can also be made longer to attach to footrest 870 so as to form a chaise lounge as in previous embodiments.

An alternate, extendible length footrest frame 1086 is of U-shape comprising a pair of elongate tubular side portions 1087 interconnected by a tubular U-shaped bottom portion 1088, and pivotal foot support 870. Tubular side portions 1087 include a front portion 1089 having a single aperture 1090 therethrough, and a rear portion 1091 having a plurality of apertures 1092, 1093, and 1094 therethrough. Foot support 870 is attached to respective front portions 1089 of tubular side portions 1087 such as by screws 846 and washers 873. An end cap 876 and a spring clip 879 having a tapered head 882 provide a more finished appearance to side tubular side portions 1087. U-shaped bottom portion 1088 includes a pair of tubular legs 1095 and 1096 which are interconnected by a tubular cross leg 1097. Tubular legs 1095 and 1096 pilot into respective rear portions 1091 of tubular side portions 1087, respective apertures 1097 and 1098 extending through the wall of tubular legs 1095 and 1096, which engage respective spring clips 930 to provide adjustable length of footrest frame 1086. Footrest frame 1086 operates by depressing button 933 of each spring clip 930 such that the desired aperture 1092, 1093, and 1094 of tubular side portions 1087 can be utilized.

A fourth embodiment folding rocking chair and chaise lounge is shown in FIGS. 50–56 comprising a backrest frame 1099, a seat frame 1100, and a footrest frame 1101.

Backrest frame 1099 comprises a pair of elongate side members 1102 and 1103, a pair of upper cross members 1104 and 1105, and a plurality of lower cross members 1115, 1116, and 1117. All of the members of backrest frame 1099 are typically made from hardwood, and are attached together such as by screws 58. The lower portion of each of side members 1102 and 1103 comprise front legs 1118 and 1119, respectively.

Seat frame 1100 comprises a pair of elongate side members 1122 and 1125, a pair of upper cross members 1128 and 1131, and a pair of lower cross members 1134 and 1137. Side members 1122 and 1125 include respective ratchet plates 1140 and 1143 attached thereto by means of a plurality of screws 1146. A respective longitudinally extending main slot 1147 and 1149 extends through the respective ratchet plates 1140 and 1143, and through side members 1122 and 1125, along with a pair of offset angled locking slots 1152 and 1155. All of the members of seat frame 1092 are typically made from hardwood, and are attached together such as by screws 58. The lower portion of each of side members 1122 and 1125 comprise rear legs 1158 and 1161, respectively.

Footrest frame 1101 comprises a pair of elongate side members 1164 and 1167, a lower cross member 1170. All of the members of footrest frame 1095 are typically made from hardwood, and are attached together such as by screws 58. A foot support 1176 is pivotally attached to footrest frame side members 1164 and 1167 as by screws 58 and washers 96. Foot support 1176 can be held in a stowed position parallel to side members 1164 and 1167 while not in use by utilizing a pair of conventional spring-loaded plungers (not shown) as done for the first embodiment of the chair.

Backrest frame 1099 and seat frame 1100 are connected together so as to form the basic rocking chair by a pair of upper siderail assemblies 1174 and 1175, and a pair of lower siderails 1176. Each of upper siderail assemblies 1174 and 1175 comprise a respective upper siderail 1179 and 1182, a pivotal armrest 1185 and 1188, and a folding brace 1191 having respective upper and lower members 1194 and 1197 which are pivotally connected together. Upper and lower siderails 1179 and 1182, and 1176 are substantially rigid members. Upper siderails 1179 and 1182 include respective front portions 1200 and 1203, and rear portions 1206 and 1209, respectively. Each of upper siderails 1179 and 1182 have a recessed aperture 1212 and 1215 through respective rear portions 1206 and 1209 which aligns with respective recessed apertures 1216 and 1217 in backrest frame side members 1102 and 1103, with a first end 1218 of a retaining strap 1221 having a aperture 1222 being therebetween, and through which a bolt 1224 is disposed and held in place by a nut 1227 (FIG. 51). Armrests 1185 and 1188 each have a recessed aperture 1230 and 1233 through respective rear portions 1236 and 1239 which align with respective recessed apertures 1242 and 1245 in upper siderails 1179 and 1182, through which a bolt 1248 is disposed and held in place by a nut 1227. Front portions 1200 and 1203 of upper siderails 1179 and 1182, and lower members 1197 of folding braces 1191 are pivotally connected to respective side members 1122 and 1125 of seat frame 1092 through main slots 1147 and 1149 of ratchet plates 1140 and 1143 thereof using respective clevis pins 1251 each having a transverse hole 1254 therethrough, a cotter pin 1257, a flat washer 1260, and a pair of nylon washers 1263 and 1266. Upper members 1194 of folding braces 1191 are pivotally connected to respective front portions 1269 and 1272 of armrests 1185 and 1188 by means of respective bolts 1273, nylon washers 1274, and nuts 1275 so as to provide respective raised positions (FIGS. 51 and 52) and lowered positions (FIG. 53).

Each of lower siderails 1176 have a recessed aperture 1276 which aligns with a respective aperture 1278 and 1281 in side members 1122 and 1125 of seat frame 1092, with a second end 1284 of a retaining strap 1221 having a aperture (not shown) therebetween, and through which a bolt 1287 is disposed and removably held in place by a nut 1290. Each of lower siderails 1176 also have an axle aperture 1293 which aligns with a respective axle aperture 1296 and 1299 in side members 1101 and 1102 of backrest frame 1099, and with axle apertures 1302 and 1305 in side members 1164 and 1167 of footrest frame 44, and through which a sleeve or bushing 147 and a bolt or threaded axle 148 is disposed (FIG. 5). Bolts 148 are of sufficient length to allow the mounting of respective wheels (not shown) for wheeled transport as in the other embodiments previously described. Upper siderail assemblies 1174 and 1175 operate by lifting the respective front portion 1197 and 1200 of upper siderails 1179 to release bolts 1251 from the respective slot 1152 or 1155 into the respective main slot 1147 and moving upper siderails 1179 and seat frame 1092 to position bolts 1251 in the desired slot 1152 or 1155.

The placement of the pivotal connections of upper and lower siderails 1179 and 1176 to the respective side members 1098 and 1101 of backrest frame 1089 and side members 1098 and 1101 of backrest frame 1089, and side members 1122 and 1125 of seat frame 1092 must be designed such that the chair folds properly and opens to the desired positions as previously described for the other embodiments of the chair. The chair can be retained in the folded position by a pair of pins (not shown) inserted through appropriately placed apertures (not shown) as also previously described.

Footrest frame 1095 is retained in the desired elevational position relative to seat frame 1092 by means of respective variable incline ratchet assemblies 1308 each comprising an elongate ratchet plate 1311 having respective front and rear portions 1314 and 1317, a longitudinally extending main slot 1320, a plurality of offset angled locking slots 1323, 1326, and 1329, and an aperture 1332. Variable incline ratchet assemblies 1308 further comprise a U-shaped release plate 1335 having a central portion 1338 with an aperture 1341 therethrough and respective dependent legs 1344 and 1347. Front portions 1314 of ratchet plates 1311 are pivotally connected to side members 1164 and 1167 of footrest frame 1095 using respective bolts 1350 each having an internally threaded end 1353, nylon washers 1356, and screws 1359 which thread into threaded ends 1353. Rear portions 1317 of ratchet plates 1311 and release plate 1335 are pivotally connected to side members 1098 and 1101 of backrest frame 1089 using respective screws 1362 and nylon washers 1365. Variable incline ratchet assemblies 1308 operate in a similar manner to that of variable incline ratchet assemblies 990 as shown in FIGS. 42 and 43 and as such will not be explained further.

A rectangular, longitudinally flexible seat 1368 of similar construction to seat 174 includes a head end 1371, a foot end 1374, and typically has a canvas top layer 1377 and a canvas bottom layer 1380 which surround a padded core 1383 such as sheet foam, which extends for most of the length thereof. Head end 1371 is retained in place by a portion thereof 1386, which contains no padded core 1383, which is completely wrapped around upper cross member 1107 of backrest frame backrest frame 1089 and retained such as by a riveted or sewn seam 1389. Foot end 1374 is retained in place by a portion thereof 1392 which contains padded core 1383, which is completely wrapped around upper cross member 1131 of seat frame 1092 and retained such as by a riveted or sewn seam 1395, with padded core 1383 acting to cushion a user's legs.

Many variations of the chair and chaise lounge are possible while staying within the same inventive concept. For example, various stops such as cylindrical or of S-shaped cross-section can be bolted or otherwise connected to the respective frames to more easily retain such frames in the folded or stowed position. Likewise, the telescoping siderail tubes can be made to be infinitely adjustable by slitting the outermost tube and placing a cam lock clamp or other such clamp therearound to clamp such outermost tube to the innermost tube, eliminating the spring clip and finite number of hole positions.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A portable folding combination rocking and chaise lounge chair, comprising:

a backrest frame including a pair of elongate side-members interconnected and held in a fixed spaced-apart, substantially parallel relationship by a plurality of transverse cross members;

a seat frame including a pair of elongate side members interconnected and held in a fixed spaced-apart, substantially parallel relationship by a plurality of transverse cross members, said backrest and seat frames being adapted to nest one within the other;

a pair of substantially rigid upper siderails being of an adjustable length relative to said backrest and seat frames, each of said upper siderails having a first end portion connected to a mid-portion of the respective backrest frame side member and a second end portion connected to an upper portion of the respective seat frame side member, said siderails being of an adjustable length;

a pair of substantially rigid lower siderails each having a first end portion connected to a lower portion of the respective backrest frame side member and a second end portion connected to a lower portion of the respective seat frame side member;

a generally rectangular, flexible seat laterally extending between and attached at one end to an upper portion of said backrest frame and at the opposite end thereof to an upper portion of said seat frame; and wherein in an unfolded or chair position said pairs of upper and lower siderails cooperate to maintain said backrest frame and said seat frame in an oppositely inclined, diagonally disposed relationship so as to enable a user to sit on said seat and which chair may oscillate or rock upon urging of the user, and wherein said backrest frame and said seat frame may be moved from the chair position to a closed, folded position wherein said backrest frame and said seat frame nest substantially parallel one within the other, which along with said pairs of upper and lower siderails comprise a more compact unit for storage and transport, and wherein said upper siderails comprise first and second end portions which are longitudinally movable relative to each other and lockable in at least one fixed position relative to each other using an adjustment mechanism thereof.

2. The chair according to claim 1, wherein the respective first and second end portions of the upper siderails are tubes which closely telescope together, and wherein the adjustment mechanism releasibly locks said first and second end portions in a plurality of linear fixed positions.

3. The chair according to claim 2, wherein the adjustment mechanism comprises a spring clip disposed within an innermost of said first and second portions, said spring clip having a head which extends into a hole through a wall of said inner of said first and second end portions which is selectively engageable through said hole into each of a plurality of linearly disposed holes of a wall of an outermost of said first and second portions to releasibly lock said first and second end portions in a plurality of linear positions.

4. The chair according to claim 2, wherein the side members and one cross member of the backrest and seat frames integrally comprise respective U-shaped tubular members, said cross members being adapted to rest on a ground surface when said chair is being used in the unfolded position, and another of said cross members of said backrest and seat frames being connected across an open end of said U-shaped members.

5. The chair according to claim 4, further comprising:

a footrest comprising a footrest frame having a U-shaped tubular member which comprises a pair of side members and a cross member which interconnects said side members, and a foot support laterally disposed and pivotally connected to a first end portion of said footrest frame opposite a closed end of said U-shaped member;

a pair of variable incline ratchet assemblies each of which includes an elongate ratchet plate having respective first and second portions with a longitudinally extending main slot which includes a plurality of offset angled locking slots through said second end; and wherein a first end portion of said U-shaped member at a closed end thereof is pivotally connected to a lower portion of the backrest frame and extending longitudinally therefrom with said foot support laterally disposed between and pivotally connected to said side members at a second end portion opposite a closed end of said U-shaped member, said ratchet plates being pivotally connected at one of said first and second end portions of each of said ratchet plates to one of said backrest frame and said U-shaped tubular member, and connectable at another of said first and second end portions to another of said backrest frame and said U-shaped tubular member selectively at each of said locking slots by means of a pivot pin affixed to said another of said backrest frame and said U-shaped tubular member which extends through said main slot, said footrest frame having a deployed position wherein said second end portion of said footrest frame and said foot support are maintained in at least one elevated position relative to a ground surface by said ratchet assemblies, and a stowed position wherein said footrest frame is adapted to substantially nest within said backrest frame and the seat frame.

6. The chair according to claim 5, wherein the variable incline ratchet assemblies each include a release plate having a central portion with a central aperture therethrough and a lower leg, the pivot pin being affixed to the backrest frame through said central aperture of said central portion, said release plate being pivotally disposed thereon with said lower leg disposed closely adjacent a lower edge of said ratchet plate with said pivot pin disposed through a locking slot of the main slot, and which release plate is pivotable upon application of force sufficient to pivotally raise said ratchet plate against said lower leg such that said pivot pin is removed from said locking slot.

7. The chair according to claim 5, wherein the footrest is of an adjustable length by means of the pair of side members and the cross member which interconnects said side members of the U-shaped tubular member comprising separate pieces, said cross member being of a truncated U-shape having a pair of tubular legs interconnected by a tubular cross leg, said side members which closely telescope together with the respective tubular legs and which are retainable in a plurality of relative linear positions by means of respective retaining mechanisms.

8. The chair according to claim 7, wherein the retaining mechanisms each comprise a spring clip disposed within a telescoping portion of the respective side members with the legs, said spring clips each having a head which fits within an aperture through a wall of an innermost of said side members and said legs, and selectively engages a plurality of linearly disposed mating apertures through a wall of an outermost of said side members and said legs to provide retention thereof in a plurality of relative linear positions.

9. The chair according to claim 2, wherein the first end portion of each of said upper siderails connected to the mid-portion of the respective backrest frame side member is substantially straight and the second end portion connected to an upper portion of the respective seat frame side member is downwardly curved.

10. The chair according to claim 1, further comprising:

a footrest comprising a footrest frame having a pair of side members and a cross member affixed at a first end of said footrest frame, and a foot support laterally disposed and pivotally connected at a second end of said footrest frame;

a pair of variable incline ratchet assemblies each of which includes an elongate ratchet plate having respective first and second portions with a longitudinally extending main slot which includes a plurality of offset angled locking slots through said second end; and wherein a first end portion of said footrest frame at a closed end thereof is pivotally connected to a lower portion of the backrest frame and extending longitudinally therefrom with said foot support laterally disposed between and pivotally connected to said side members at a second end portion opposite said first end of said footrest frame, said ratchet plates being pivotally connected at one of said end portions of each ratchet plate to one of said backrest frame and said footrest frame, and connectable at the other of said end portions to another of said backrest frame and said footrest frame selectively at each of said locking slots by means of a pivot pin affixed to said another of said backrest frame and said footrest frame which extends through said main slot, said footrest having a deployed position wherein said second end portion of said footrest frame and said foot support are maintained in at least one elevated position relative to a ground surface by said ratchet assemblies, and a stowed position wherein said footrest is adapted to substantially nest within said backrest frame and the seat frame.

11. The chair according to claim 10, wherein the variable incline ratchet assemblies each include a release plate having a central portion with a central aperture therethrough and a lower leg, a pivot pin being affixed to the backrest frame through said central aperture of said central portion, said release plate being pivotally disposed thereon with said lower leg disposed closely adjacent a lower edge of said ratchet plate with said pivot pin disposed through a locking slot of the main slot, and said release plate is pivotable upon application of force sufficient to pivotally raise said ratchet plate against said lower leg such that said pivot pin is removed from said locking slot.

12. The chair according to claim 10, further comprising a pair of wheels, each being removably, rotationally mounted on a separate axle extending laterally from opposite sides of a lower portion of the chair, each of said axles able to be reversed to extend laterally inwardly when the respective wheel is removed therefrom, the chair having a cart position wherein the backrest and seat frames are in a stowed position and said footrest is in a deployed position for carrying items.

13. The chair according to claim 10, wherein the footrest is of an adjustable length, comprising first and second end portions which are longitudinally movable relative to each other, and being retainable in a plurality of relative linear positions.

14. The chair according to claim 2, wherein the upper siderails are of said adjustable length relative to the backrest and seat frames by means of corresponding end portions of each of said upper siderails being of adjustable mounting position on one of said backrest and seat frames using ratchet plates.

15. The chair according to claim 14, wherein the ratchet plates are affixed to the respective side members of the seat frame and the upper siderails pivot at the respective side members of the backrest frame.

16. The chair according to claim 15 further comprising:

a pair of elongate armrests, each being pivotally connected at a first end portion to the first end portion of the respective upper siderail adjacent the backrest frame; and a pair of support mechanisms, one connected to a second end portion of the respective upper arm rest and to the second end portion of the respective upper siderail to selectively retain said second end portion of the respective armrest in an elevated and a lowered position.

17. The chair according to claim 16, wherein the support mechanism comprises a folding brace having respective upper and lower members which are pivotally connected together, a free end of said upper member being pivotally connected to a second end portion of the respective armrest and a free end of said lower member being connected to the second end portion of the respective upper siderail.

18. The chair according to claim 14, further comprising:

a footrest comprising a footrest frame having a pair of side members and a cross member affixed at a first end of said footrest frame, and a foot support laterally disposed and pivotally connected at a second end of said footrest frame;

a pair of variable incline ratchet assemblies each of which includes an elongate ratchet plate having respective first and second portions with a longitudinally extending main slot which includes a plurality of offset angled locking slots through said second end; and wherein a first end portion of said footrest frame at a closed end thereof is pivotally connected to a lower portion of the backrest frame and extending longitudinally therefrom with said foot support laterally disposed between and pivotally connected to said side members at a second end portion opposite said first end of said footrest frame, said ratchet plates being pivotally connected at one of said end portions of each of said ratchet plates to one of said backrest frame and said footrest frame, and connectable at the other of said end portions to another of said backrest frame and said footrest frame selectively at each of said locking slots by means of a pivot pin affixed to said another of said backrest frame and said footrest frame which extends through said main slot, said footrest having a deployed position wherein said second end portion of said footrest frame and said foot support are maintained in at least one elevated position relative to a ground surface by said ratchet assemblies, and a stowed position wherein said footrest is adapted to substantially nest within said backrest frame and the seat frame.

19. The chair according to claim 18, wherein the variable incline ratchet assemblies each include a U-shaped release plate having a central portion with a central aperture therethrough and respective dependent upper and lower legs, a pivot pin being affixed to the backrest frame through said central aperture of said central portion, said release plate being pivotally disposed thereon with said lower leg disposed closely adjacent a lower edge of said ratchet plate with said pivot pin disposed through a locking slot of the main slot, and said release plate is pivotable upon application of force sufficient to pivotally raise said ratchet plate against said lower leg such that said pivot pin is removed from said locking slot.

20. The chair according to claim 18, further comprising a pair of wheels, each being removably, rotationally mounted on a separate axle extending laterally from opposite sides of a lower portion of the chair, each of said axles able to be reversed to extend laterally inwardly when the respective wheel is removed therefrom, the chair having a cart position wherein the backrest and seat frames are in a stowed position and said footrest is in a deployed position for carrying items.

21. The chair according to claim 18, wherein the footrest is of an adjustable length, comprising first and second end portions which are longitudinally movable relative to each other, and being retainable in a plurality of relative linear positions.

22. A portable folding combination rocking and chaise lounge chair, comprising:

a backrest frame including a pair of elongate side-members interconnected and held in a fixed spaced-apart, substantially parallel relationship by a plurality of transverse cross members;

a seat frame including a pair of elongate side members interconnected and held in a fixed spaced-apart, substantially parallel relationship by a plurality of transverse cross members, said backrest and seat frames being adapted to nest one within the other;

a pair of substantially rigid upper siderails being of an adjustable length relative to said backrest and seat frames, each of said upper siderails having a first end portion connected to a mid-portion of the respective backrest frame side member and a second end portion connected to an upper portion of the respective seat frame side member, said siderails being of said adjustable length;

a pair of substantially rigid lower siderails each having a first end portion connected to a lower portion of the respective backrest frame side member and a second end portion connected to a lower portion of the respective seat frame side member;

a generally rectangular, flexible seat laterally extending between and attached at one end to an upper portion of said backrest frame and at the opposite end thereof to an upper portion of said seat frame;

a footrest comprising a footrest frame having a pair of side members and a cross member affixed at a first end of said footrest frame, and a foot support laterally disposed and pivotally connected at a second end of said footrest frame;

a pair of variable incline ratchet assemblies each of which includes an elongate ratchet plate having respective first and second portions with a longitudinally extending main slot which includes a plurality of offset angled locking slots through said second end; and wherein in an unfolded or chair position said pairs of upper and lower siderails cooperate to maintain said backrest frame and said seat frame in an oppositely inclined diagonally disposed relationship so as to enable a user to sit on said seat and said chair may oscillate or rock upon urging of the user, and wherein said backrest frame and said seat frame may be moved from the chair position to a closed, folded position wherein said backrest frame and said seat frame nest substantially parallel one within the other, which along with said pairs of upper and lower siderails comprise a more compact unit for storage and transport, and wherein a first end portion of said footrest frame at a closed end thereof is pivotally connected to a lower portion of said backrest frame and extending longitudinally therefrom with said foot support laterally disposed between and pivotally connected to said side members at a second end portion opposite said first end of said footrest frame, said ratchet plates being pivotally connected at one of said end portions of each of said ratchet plates to one of said backrest frame and said footrest frame, and connectable at the other of said end portions to another of said backrest frame and said footrest frame selectively at each of said locking slots by means of a pivot pin affixed to said another of said backrest frame and said footrest frame which extends through said main slot, said footrest having a deployed position wherein said second end portion of said footrest frame and said foot support are maintained in at least one elevated position relative to a ground surface by—said ratchet assemblies, and a stowed position wherein said footrest is adapted to substantially nest within said backrest frame and the said seat frame.

23. The chair according to claim 22, wherein the variable incline ratchet assemblies each include a release plate having a central portion with a central aperture therethrough and a lower leg, a pivot pin being affixed to the backrest frame through said central aperture of said central portion, said release plate being pivotally disposed thereon with said lower leg disposed closely adjacent a lower edge of said ratchet plate with said pivot pin disposed through a locking slot of the main slot, and said release plate is pivotable upon application of force sufficient to pivotally raise said ratchet plate against said lower leg such that said pivot pin is removed from said locking slot.

24. The chair according to claim 22, further comprising a pair of wheels, each being removably, rotationally mounted on a separate axle extending laterally from opposite sides of a lower portion of the chair, each of said axles able to be reversed to extend laterally inwardly when the respective wheel is removed therefrom, the chair having a cart position wherein the backrest and seat frames are in a stowed position and said footrest is in a deployed position for carrying items.

25. The chair according to claim 22, wherein the footrest is of an adjustable length, comprising first and second end portions which are longitudinally movable relative to each other, and being retainable in a plurality of relative linear positions.

26. The chair according to claim 25, wherein the foot support includes a pad attached thereto, with said foot support positioned on said footrest frame such that when the chair is in the unfolded position with said footrest in the stowed position said foot support and said pad are positionable adjacent and generally parallel to a back and shoulder region of a person when sitting in the chair as desired by adjusting the length of said footrest so as to provide support and cushioning thereto.

27. A portable folding combination rocking and chaise lounge chair, comprising:

a backrest frame including a pair of elongate side-members interconnected and held in a fixed spaced-apart, substantially parallel relationship by a plurality of transverse cross members;

a seat frame including a pair of elongate side members interconnected and held in a fixed spaced-apart, substantially parallel relationship by a plurality of transverse cross members, said backrest and seat frames being adapted to nest one within the other;

a pair of substantially rigid upper siderails being of an adjustable length relative to said backrest and seat frames, each of said upper siderails having a first end portion connected to a mid-portion of the respective backrest frame side member and a second end portion connected to an upper portion of the respective seat frame side member, said siderails being of said adjustable length;

a pair of substantially rigid lower siderails each having a first end portion connected to a lower portion of the respective backrest frame side member and a second end portion connected to a lower portion of the respective seat frame side member;

a generally rectangular, flexible seat laterally extending between and attached at one end to an upper portion of said backrest frame and at the opposite end thereof to an upper portion of said seat frame;

a footrest comprising a footrest frame having a pair of side members and a cross member affixed at a first end of said footrest frame, and a foot support laterally disposed and pivotally connected at a second end of said footrest frame;

at least one stop device interconnecting the first end of said footrest frame and a lower portion of said backrest frame; and wherein in an unfolded or chair position said pairs of upper and lower siderails cooperate to maintain said backrest frame and said seat frame in an oppositely inclined, diagonally disposed relationship so as to enable a user to sit on said seat and which chair may oscillate or rock upon urging of the user, and wherein said backrest frame and said seat frame may be moved from the chair position to a closed, folded position wherein said backrest frame and said seat frame nest substantially parallel one with in the other which along with said pairs of upper and lower siderails comprise a more compact unit for storage and transport, and wherein said first end of said footrest frame is pivotally connected to said lower portion of said backrest frame and extends longitudinally therefrom with said foot support pivotally connected at said second end portion, said stop device being adapted to maintain said footrest in a deployed position wherein said second end portion of said footrest frame and said foot support in at least one elevated position relative to a ground surface, and a stowed position wherein said footrest is adapted to substantially nest within said backrest frame and said seat frame.

28. The chair according to claim 27, further comprising at least one retaining device which engages the backrest and seat frames to retain the chair in a preselected chair position.

29. The chair according to claim 28, wherein one of the preselected chair positions comprises a cot position with the backrest frame lowered and the seat generally parallel to a ground surface and substantially taut between the upper portions of said backrest and seat frames, being a three-quarter length cot position with the footrest stowed and a full length cot position with said footrest deployed.

30. The chair according to claim 22, wherein the variable incline ratchet assemblies each include an angled release plate having a central portion with a central aperture therethrough and a dependent lower leg, the pivot pin being affixed to the backrest frame through said central aperture of said central portion, said release plate being pivotally disposed thereon with said lower leg disposed closely adjacent a lower edge of said ratchet plate with said pivot pin disposed through a locking slot of the main slot, and said release plate is pivotable upon application of force sufficient to pivotally raise said ratchet plate against said lower leg such that said pivot pin is removed from said locking slot.

31. The chair according to claim 30, wherein the release plates are adapted to simultaneously pivot upon application of force to one of said release plates sufficient to pivotally raise the ratchet plates against the lower legs such that the pivot pins are removed from the locking slots.

32. The chair according to claim 22, wherein the flexible seat extends past the upper portion of the seat frame to which it is attached and is further attached to the foot support.

* * * * *